US006164754A

United States Patent [19]

Ide et al.

[11] Patent Number: 6,164,754

[45] Date of Patent: Dec. 26, 2000

[54] LIQUID DISCHARGING RECORDING APPARATUS WITH ELASTIC HEAD CLEANING MEMBER

[75] Inventors: Daisaku Ide; Isao Ebisawa; Tetsuhiro Nitta, all of Yokohama; Norihiro Kawatoko, Machida, all of Japan

[73] Assignee: Canon Kabushiki Kaisha, Tokyo, Japan

[21] Appl. No.: 08/964,330

[22] Filed: Nov. 4, 1997

[30] Foreign Application Priority Data

| | | | |
|---|---|---|---|
| Nov. 6, 1996 | [JP] | Japan | 8-310167 |
| Jan. 31, 1997 | [JP] | Japan | 9-019320 |
| Apr. 28, 1997 | [JP] | Japan | 9-111458 |

[51] Int. Cl.[7] ..... B41J 2/165

[52] U.S. Cl. ..... 347/33; 347/31; 347/32; 347/20; 347/22; 347/90; 103/31.27

[58] Field of Search ..... 347/31, 32, 33, 347/20, 22, 90; 106/31.27

[56] References Cited

U.S. PATENT DOCUMENTS

| | | | |
|---|---|---|---|
| 5,065,158 | 11/1991 | Nojima et al. . | |
| 5,126,765 | 6/1992 | Nakamura | 347/33 |
| 5,266,974 | 11/1993 | Koitabashi et al. | 347/33 |
| 5,381,169 | 1/1995 | Arai et al. | 347/33 |
| 5,583,547 | 12/1996 | Gast et al. | 347/22 |
| 5,612,722 | 3/1997 | Francis et al. | 347/33 |
| 5,706,038 | 1/1998 | Jackson et al. | 347/33 |
| 5,717,445 | 2/1998 | Kida et al. | 347/33 |
| 5,724,078 | 3/1998 | Kotaki | 347/33 |
| 5,782,965 | 7/1998 | Ishida et al. | 106/31.27 X |
| 5,786,830 | 7/1998 | Su et al. | 347/33 |
| 5,847,728 | 12/1998 | Lee . | |
| 5,905,514 | 5/1999 | Rhoads et al. | 347/33 |
| 5,963,228 | 10/1999 | Purwins | 347/31 |

FOREIGN PATENT DOCUMENTS

| | | |
|---|---|---|
| 0 510 894 | 10/1992 | European Pat. Off. . |
| 0 673 772 | 9/1995 | European Pat. Off. . |
| 58-128034 | 7/1983 | Japan . |
| 61-5647 | 1/1988 | Japan . |
| 2-000518 | 1/1990 | Japan . |
| 3-262646 | 11/1991 | Japan . |
| 4-338552 | 11/1992 | Japan . |
| 8-281968 | 10/1996 | Japan . |

*Primary Examiner*—Susan S. Y. Lee

*Attorney, Agent, or Firm*—Fitzpatrick, Cella, Harper & Scinto

[57] ABSTRACT

A liquid discharging apparatus using a liquid discharging head for discharging a liquid, including a cleaning unit for cleaning a nozzle section of the liquid discharging head. The cleaning unit is formed of an elastic pillar member not absorbing the liquid and is elastically deformed when it comes into contact with a face including the nozzle section of the liquid discharging head. The liquids which are discharged through the liquid discharging head include an ink and a printability improving solution which makes the dye or pigment insoluble or coagulates the dye or pigment in the ink.

52 Claims, 36 Drawing Sheets

A-A SECTION

LIQUID DISCHARGING RECORDING APPARATUS WITH ELASTIC HEAD CLEANING MEMBER

BACKGROUND OF THE INVENTION

1. Field of the Invention

The present invention relates to liquid discharging apparatuses and cleaning systems for the same, which discharge ink or liquids, such as printability improvers, onto recording media and are capable of forming high quality images.

The present invention is applicable to all the devices using recording media such as paper, cloth, unwoven fabric, and transparency sheets (OHP sheets). Examples of the devices include business machines and mass-produced machines, such as printers, copying machines and facsimiles.

2. Description of the Related Art

Ink jet recording has been used in printers, copying machines and the like due to low operation noise, low operation cost, easy size reduction, and easy color printing.

Conventional ink jet recording systems have the following inherent drawback. These systems discharge ink droplets onto a recording medium, such as paper and OHP sheet, through recording heads to record data. Fine ink droplets or mist forming when main ink droplets are discharged and ink droplets rebounded from the recording medium adhere to the discharging face of the recording head. The adhered ink will deposit around the nozzles and will clog some of them by means of adhesion of foreign matter such as powdered paper. Such nozzle clogging will cause deflection of ink discharge from the given direction and failure of ink discharge or ink non-discharge in severe cases.

The ink jet recording systems are therefore provided with recovery means to prevent these phenomena. Japanese Utility Model Laid-Open No. 58-128034 discloses, as shown in FIG. 30B, a configuration for wiping the adhered ink and foreign matters such as powdered paper on the nozzle face 208*b*, in which the top end of an elastic plate blade 208*a* is in contact with the nozzle face 208*b* and wipes the nozzle face 208*b* in the direction of the arrow 208*c*. In such an ink jet head, however, the nozzle face 208*b* may be damaged due to rubbing with the powdered paper.

A countermeasure to such a drawback is to form an indented nozzle face on the ink jet head so that the nozzle face and the other face portions do not form the same face. The above-mentioned flexible plate blade, however, does not work well with the indented nozzle face as follows.

(1) The plate blade does not come into contact with the nozzle face and thus does not wipe the dirt from it due to the step between the ink discharging face and the other faces.

(2) Some dirt will slip through the plate blade during wiping due to unstable contact pressure caused by the step.

(3) Some dirt will slip through the plate blade during wiping since the plate blade is deformed due to forced contact with the indented nozzle face and thus the contact pressure varies considerably depending on its position.

A countermeasure to the above-mentioned drawbacks of the indented nozzle face is disclosed by, for example, Japanese Utility Model Laid-Open No. 3-262646 as shown in FIG. 31A which is a sectional view of a nozzle face of a recording head and two types of cleaning members and FIG. 31B, which is a front view of such a configuration when viewed from the bottom side in FIG. 31A.

A cleaning member 209 consists of a first cleaning member 209*a* cleaning a nozzle face 209*d* which includes a nozzle 209*e* and a second cleaning member 209*b* cleaning ink-adhered portions 209*c* other than the nozzle face 209*d*. The first cleaning member 209*a* has a height which permits contact with the indented nozzle face 209*d* as shown in FIG. 31A and a width which is equal to the width of a nozzle array 209*e* as shown in FIG. 31B. The first cleaning member 209*a* moves in the direction of the arrow 209*f* and can clean the entire nozzle array 209*e*. On the other hand, the second cleaning member 209*b* has a height which permits contact with the ink-adhered portions 209*c* other than the nozzle face 209*d* as shown in FIG. 31A and can clean the ink-adhered portions 209*c*. In this case, the second cleaning member 209*b* consists of two fragments which are offset from the first cleaning member 209*a* in the direction of the arrow 209*f* and are arranged at both sides of the nozzle array 209*e*. Such a configuration having two types of cleaning members permits perfect cleaning of the nozzles and other faces of the recording head which do not form the same face.

Another countermeasure is shown in FIG. 32A which is a sectional view of a nozzle face of a recording head and two types of cleaning members and FIG. 32B, which is a front view of such a configuration when viewed from the bottom side in FIG. 32A. A first cleaning member 210*a* shown in FIGS. 32A and 32B is substantially equal to the first cleaning member 209*a* of the above-mentioned countermeasure. The second cleaning member 210*b*, however, differs from the second cleaning member 209*b* of the above-mentioned countermeasure in that it is not divided into two fragments.

In the countermeasures shown in FIGS. 31A and 31B and FIGS. 32A and 32B, wiping along the direction perpendicular to the nozzle array, that is, in the direction of the arrow 209*f* or 210*f*, may adversely affect ink discharge characteristics. Typical examples of such cases include recording using a printability improving solution which instantaneously makes the dyes insoluble and coagulates dyes in the ink and recording using a pigment ink or the like in which fine particles are dispersed.

FIG. 33 is a front view illustrating an ink discharging state by a recording head having a nozzle array for the printability improving solution, wherein 211*a* is a discharging head for the printability improving solution, 211*b* is an ink head or recording head, and 211*c* is a recording medium. The discharging head 211*a* for the printability improving solution has a solution nozzle array 211*d*, the ink head 211*b* has an ink nozzle array 211*e*, and these two heads are adjacent to each other in the scanning direction shown by the arrow 211*i*. The discharging head 211*a* for the printability improving solution discharges a droplet 211*j* of the printability improving solution on a predetermined position of the recording medium 211*c* to form an adhered layer 211*k*. Next, an ink droplet 211*l* is discharged on the adhered layer 211*k* of the printability improving solution to form a coagulated region 211 *m* by instantaneous coagulation of the ink. Such a system can improve the image quality by preventing ink bleeding between different colors and by endowing waterproof properties.

In this system, however, the ink is discharged onto the adhered layer 211*k* of the printability improving solution which is previously discharged on the recording medium 211*c*, hence a mixed mist of the printability improving solution and the ink will rebound and adhere near the ink nozzle array 211*e* to form a coagulate 211*h*. Adhered layers 211*f* and 211*g* of the mists from the printability improving solution and the ink may also be formed on the nozzle arrays 211*d* and 211*e*, respectively.

FIG. 34 is an enlarged plan view of the head shown in FIG. 33 from the recording medium side, which shows regions in which the mists from the ink and the printability improving solution adhere onto the faces including the ink nozzle array. As shown in FIG. 34, on the face of the ink head the mist of the ink adheres to a region 211*g* near the nozzle array 211*e* during discharging the ink, whereas a mixed mist 211*n* of the printability improving solution and the ink adheres to the periphery of the nozzle array 211*e* to form the coagulate 211*h*. When wiping is performed in the direction perpendicular to the nozzle array as shown in FIGS. 31 and 32, the coagulate 211*h* shown in FIG. 34 is squeezed into the nozzles. As a result, the quality of the printed image will decrease due to deflection of the discharged ink and non-discharge of the ink. Further, the coagulate squeezed into the nozzles cannot be removed by preliminary discharge of the ink after wiping, hence the image quality cannot recover from the deterioration. A measure is therefore required to prevent squeezing of the coagulate into the nozzles due to wiping along the nozzle array.

In particular, since the nozzle face and the other faces do not form the same face in the above-mentioned system, the indented nozzle face 213*c* (FIG. 35A) does not come into perfect contact with the top of the flexible plate blade 213*a* during wiping the nozzle face 213*c* along the nozzle array. As a result, the dust, powdered paper, adhered ink drops, the sticky solid component formed by drying the ink and, in particular, coagulate of the printability improving solution and the ink cannot be removed from the face near the nozzles. FIG. 35A is an outlined front view of a flexible plate blade wiping the bottom of the indented head face 213*c* including the nozzle face, and FIG. 35B is an outlined front view of a small flexible plate blade wiping only the nozzle face at the bottom of the indented head face.

In order to solve such drawbacks, the present inventors have tried wiping of the indented nozzle of the ink head along the longitudinal direction using a cleaner including a flexible wiper and a rubbing member disclosed in Japanese Utility Model Laid-Open No. 61-5647 and Japanese Patent Laid-Open No. 4-338552. The flexible wiper, however, did not come into contact with the indented nozzle face. The present inventors, therefore, have tried cleaning using only the rubbing member. Although this cleaning process is effective at an initial stage, the following drawbacks arise after repeated cycles of use.

(1) In the above-mentioned ink head, the coagulate and thickened ink gradually deposit on the surface of the rubbing member by the reaction of the ink with the printability improving solution during repeated cycles of cleaning of the face using only the rubbing member, and the deposited coagulate is retransferred to the ink jet head and squeezed into the nozzles, resulting in deflection of the discharged ink and deterioration of printing.

(2) In the discharging head for the printability improving solution, not only the printability improving solution but also the ink gradually deposit on the rubbing member during repeated cycles of cleaning of the face using only the rubbing member, and the surface of the rubbing member is covered by the coagulate of the printability improving solution and the ink. The deposited coagulate is barely removed by the rubbing member and is readily retransferred from the rubbing member to the face.

The water repellency of the face is perfectly lost by retransferring cycles, during which a large amount of printability improving solution adheres onto the face after aspiration. As a result, the deposited printability improving solution causes deflection of the discharged ink and deterioration of printing.

In addition to the deposition of the ink, the ink dye and fibrous materials also deposit on the nozzle face 208*b* of the ink jet recording head, as shown in FIG. 30, by evaporation of the solvent in the ink. A measure suitable for removing such contamination is a cleaning member composed of a porous wet elastic member disclosed in Japanese Utility Model Laid-Open No. 58-128034. Although the cleaner is smeared by repeated cleaning operation in such a cleaning system, hence the cleaning effect gradually decreases.

Ink jet recording apparatuses each provided with two cleaners, i.e., a wiper and a cleaning means are proposed. For example, FIG. 36 shows an ink jet recording apparatus provided with a wiper 32 and a cleaning means 33 proposed in Japanese Patent Laid-Open No. 2-518. Further, FIGS. 37A and 37B show an ink jet recording apparatus provided with a cleaner composed of a cleaning member 33 made of a wet porous elastic member and a protruded wiper 32 which is disclosed in Japanese Utility Model Laid-Open No. 61-5647. FIGS. 38A, 38B and 38C show an ink jet recording apparatus provided with a cleaner disclosed in Japanese Patent Laid-Open No. 4-338552 in which a wiper 32 and a water absorbable cleaning member 33 are bonded to each other with a bonding agent 81.

In the ink jet recording apparatus shown in FIG. 36, however, the cleaning means has a complicated configuration due to independent location of the wiper 32 and the cleaning member 33, hence the operation is also complicated. Since the stiffness of the cleaning member 33 is generally low, the cleaning member 33 must have a relatively large size in order to achieve a sufficient contact pressure by the cleaning member itself, and such a cleaning member 33 does not fit well to an irregular nozzle surface. In contrast, if the thickness of the cleaning member is reduced so that the cleaning member fits sufficiently to the nozzle surface, a satisfactory contact pressure cannot be achieved.

In the ink jet recording apparatus shown in FIGS. 37A and 37B, the cleaning member 33 does not form a sufficient contact pressure and thus does not cause a satisfactory result. In some case, the cleaning member 33 is not wet enough to form a suitable contact pressure. Further, the cleaner is frequently used and requires high durability.

The ink jet recording apparatus shown in FIGS. 38A to 38C requires an additional step for bonding the cleaning member 33 and the wiper 32 and has drawbacks such as the durability of the joint between them and the selection of the bonding agent. In the wiping of an indented nozzle face 213*c* with a wiper shown in FIG. 38B in the nozzle array direction, the wiper 32 does not substantially come into contact with the nozzle face as in the case shown in FIG. 35A.

SUMMARY OF THE INVENTION

It is an object of the present invention to provide a liquid discharging apparatus provided with a cleaning means which has a simplified structure, can easily remove dust, powdered paper, ink droplets, sticky solid components formed by drying the ink and, in particular, a coagulate of the printability improving solution and the ink from the nozzle face and thus does not affect the ink discharging characteristics.

It is another object of the present invention to provide a liquid discharging apparatus for discharging an ink and a printability improving solution through nozzles of a plurality of liquid discharging heads on a recording medium for printing, which can easily remove deposited materials from an indented nozzle face without squeezing the deposited materials into the nozzles, by wiping the indented nozzle face along the longitudinal direction by a flexible cleaning member having a shape other than a plate shape so as to fit to the discharging face.

In such a simplified configuration, dust, powdered paper, ink droplets, sticky solid components formed by drying the ink and, in particular, a coagulate of the printability improving solution and the ink from the nozzle face can be easily removed from a long indented discharging face without deteriorating liquid discharging characteristics by wiping the face along the longitudinal direction, i.e., the nozzle array.

A first aspect of the present invention is a liquid discharging apparatus using a liquid discharging head for discharging a liquid, comprising a cleaning means for cleaning a nozzle section of the liquid discharging head, the cleaning means being formed of an elastic pillar member not absorbing the liquid and being elastically deformed when being in contact with a face including the nozzle section of the liquid discharging head.

A second aspect of the present invention is a liquid discharging apparatus using a liquid discharging head for discharging a liquid, comprising a plurality of cleaning means for cleaning a nozzle section of the liquid discharging head, at least one of the cleaning means comprising a rubbing member absorbing the liquid and an elastic plate member not absorbing the liquid, the rubbing member being in contact with a face including the nozzle section of the liquid discharging head in cooperation with elastic deformation of the elastic plate member when the cleaning means is in contact with the face.

A third aspect of the present invention is a liquid discharging apparatus using a liquid discharging head for discharging a liquid, comprising a plurality of cleaning means for cleaning a nozzle section of the liquid discharging head, each of the cleaning means comprising a first cleaning means composed of an elastic pillar member not absorbing the liquid and a second cleaning means comprising a rubbing member absorbing the liquid and an elastic plate member not absorbing the liquid.

A fourth aspect of the present invention is a liquid discharging apparatus using a plurality of liquid discharging heads each having independent discharging mechanisms in response to different types of liquids, comprising a plurality of cleaning means for cleaning nozzle sections of the liquid discharging heads, each of the cleaning means comprising an elastic pillar member being elastically deformed when in contact with a face including each of the nozzle sections of the liquid discharging heads.

A fifth aspect of the present invention is a liquid discharging apparatus using a plurality of liquid discharging heads each having independent discharging mechanisms in response to different types of liquids, comprising a plurality of cleaning means for cleaning nozzle sections of the liquid discharging heads, at least one of the cleaning means comprising a rubbing member absorbing one of the liquid and an elastic plate member not absorbing the corresponding liquid, the rubbing member being in contact with a face including each of the nozzle sections of the liquid discharging heads in cooperation with elastic deformation of the elastic plate member when the cleaning means is in contact with the face.

A sixth aspect of the present invention is a liquid discharging apparatus using a plurality of liquid discharging heads each having independent discharging mechanisms in response to different types of liquids, comprising a plurality of cleaning means for cleaning nozzle sections of the liquid discharging heads, each of the cleaning means comprising a first cleaning means composed of an elastic pillar member not absorbing one of the liquid and a second cleaning means comprising a rubbing member absorbing the corresponding liquid and an elastic plate member not absorbing the corresponding liquid.

A seventh aspect of the present invention is a cleaning system for a liquid discharging apparatus comprising a cleaning means for cleaning a nozzle section of a liquid discharging head for discharging a liquid, the cleaning means being made of an elastic pillar member not absorbing the liquid and being elastically deformed when being in contact with a face including the nozzle section of the liquid discharging head.

An eighth aspect of the present invention is a cleaning system for a liquid discharging apparatus comprising a plurality of cleaning means for cleaning a nozzle section of a liquid discharging head for discharging a liquid, at least one of the cleaning means comprising a rubbing member absorbing the liquid and an elastic plate member not absorbing the liquid, the rubbing member being in contact with a face including each of the nozzle sections of the liquid discharging heads in cooperation with elastic deformation of the elastic plate member when the corresponding cleaning means is in contact with the face.

A ninth aspect of the present invention is a cleaning system for a liquid discharging apparatus comprising a plurality of cleaning means for cleaning a nozzle section of a liquid discharging head for discharging a liquid, each of the cleaning means comprising a first cleaning means composed of an elastic pillar member not absorbing the liquid and a second cleaning means comprising a rubbing member absorbing the liquid and an elastic plate member not absorbing the liquid.

A tenth aspect of the present invention is a cleaning system for a liquid discharging apparatus comprising a plurality of cleaning means for cleaning nozzle sections of a plurality of liquid discharging heads each having independent discharging mechanisms in response to different types of liquids, each of the cleaning means comprising an elastic pillar member and being elastically deformed when being in contact with a face including each of the nozzle sections of the liquid discharging heads.

An eleventh aspect of the present invention is a cleaning system for a liquid discharging apparatus comprising a plurality of cleaning means for cleaning nozzle sections of a plurality of liquid discharging heads each having independent discharging mechanisms in response to different types of liquids, at least one of the cleaning means comprising a rubbing member absorbing one of the liquid and an elastic plate member not absorbing the corresponding liquid, the rubbing member being in contact with a face including at least one of the nozzle sections of the liquid discharging heads in cooperation with elastic deformation of the elastic plate member when the corresponding cleaning means is in contact with the face.

A twelfth aspect of the present invention is a cleaning system for a liquid discharging apparatus comprising a plurality of cleaning means for cleaning the nozzle sections of a plurality of liquid discharging heads each having independent discharging mechanisms in response to different types of liquids, each of the cleaning means comprising a first cleaning means composed of an elastic pillar member not absorbing one of the liquid and a second cleaning means comprising a rubbing member absorbing the corresponding liquid and an elastic plate member not absorbing the corresponding liquid.

A thirteenth aspect of the present invention is liquid discharging apparatus comprising a cleaning means for cleaning a nozzle section of a liquid discharging head for discharging a liquid by contact with the nozzle section, wherein the cleaning means comprises an elastic member not absorbing the liquid and a rubbing member absorbing the liquid arranged in a linear row, the nozzle section is cleaned by at least the elastic member by means of relative movement in a given direction of the liquid discharging head and the cleaning means, and the rubbing member is supported by the elastic member from the rear side and nozzle section is cleaned by the rubbing member by means of relative movement in the opposite direction of the liquid discharging head and the cleaning means.

DETAILED DESCRIPTION OF THE PREFERRED EMBODIMENTS

The embodiments of a liquid discharging apparatus in accordance with the present invention will now be described in detail with reference to the drawings.

First Embodiment

Figure 1:
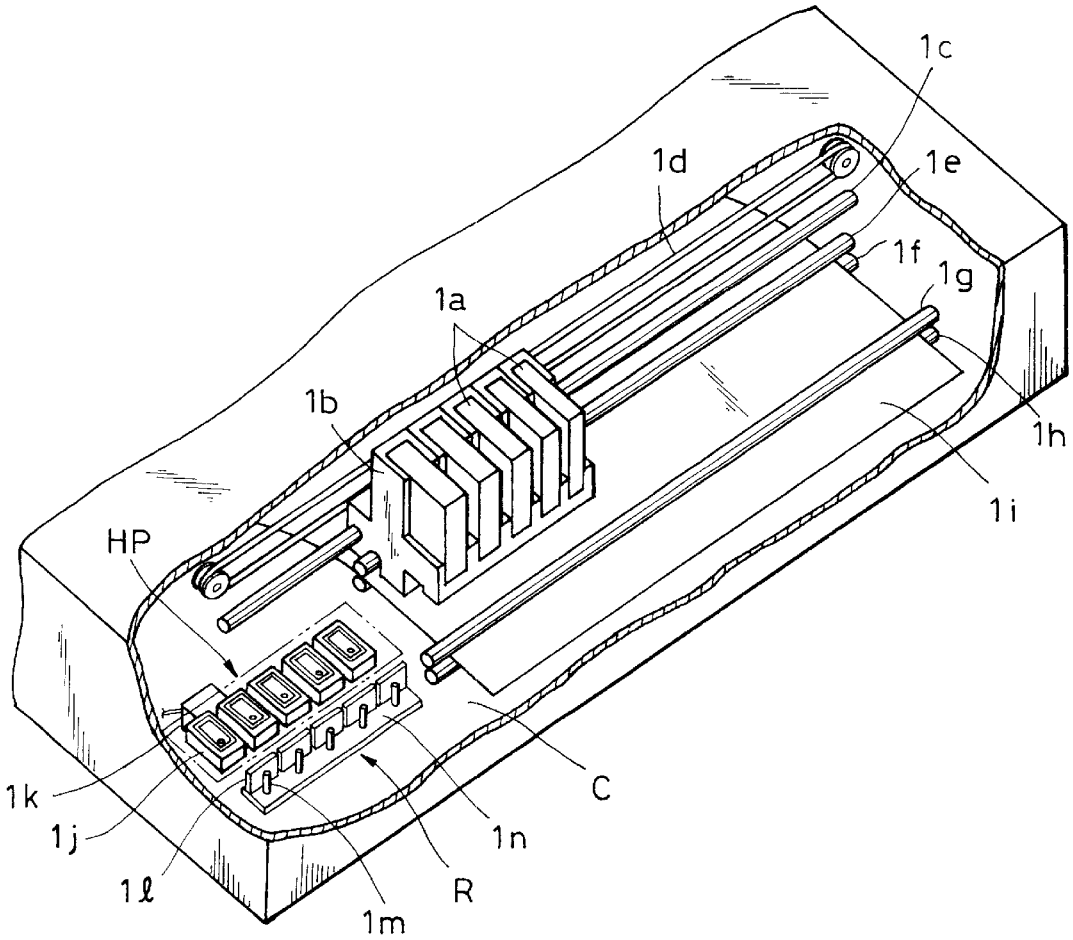
FIG. 1 is an isometric partially broken away view of an ink jet recording apparatus as an embodiment in accordance with the present invention.

FIG. 1 is an isometric partially broken away view of an ink jet recording apparatus including a liquid discharging apparatus as a first embodiment in accordance with the present invention. In FIG. 1, cartridges 1*a* for discharging liquids have reservoir sections provided on the upper section which store the liquids and heads provided under the reservoir sections which discharge the liquids onto recording paper 1*i* as a recording member.

In this embodiment, five cartridges containing different color inks, i.e., yellow, magenta, cyan and black from the left side of FIG. 1, and a printability improving solution for insolubilizing the dyes in the inks (at the right end) are mounted on a carriage 1*b*. The connector of each cartridge 1*a* is electrically connected with a connector holder of the carriage 1*b* to transmit signals for driving the heads.

The carriage 1*b* is supported by a scanning rail 1*c*, which extends in the moving direction of the recording paper 1*i*, that is, in the main scanning direction, and can be reciprocally slid by means of a driving belt 1*d* in the main scanning direction. The recording paper 1*i* is transferred by two pairs of carrying rolls, 1*e* and 1*f*, and 1*g* and 1*h* which are provided upstream and downstream from the recording position in which the head section of the cartridges is located. The transferring recording paper 1*i* is pressed by a platen (not shown in the drawing) which keeps the recording paper flat. The head section of the cartridges 1*a* loaded on the carriage 1*b* faces the recording surface (upper surface) of the recording paper 1*i* and protrudes such that it is located between the upstream carrying roll 1*e* and the downstream carrying roll 1*g*.

In the liquid discharging apparatus in accordance with the first embodiment, the solution head discharges a printability improving solution and the ink heads discharge inks onto the recording medium. Since the printability improving solution instantaneously reacts with the inks and makes the dyes in the inks insoluble to solvents such as water on the recording medium, the dyes have become waterproof and bleeding between the different colors can be prevented.

A recovery unit R is arranged at the home position HP on the left of FIG. 1. The recovery unit R has a plurality of cap units 1*j* corresponding to a plurality of cartridges 1*a*, and these cap units 1*j* are provided on a chassis C of the recording apparatus body and can be moved in the vertical direction by a moving mechanism not shown in the drawing. When the carriage 1*b* is located at the home position HP, the cap units 1*j* come into close contact with the heads of their respective cartridges 1*a* so as to cover the head section, and thus prevent unsatisfactory discharge of the inks due to thickening or drying of the inks in the nozzles on the head section.

A pump unit 1*k* in the recovery unit R is connected to the cap units 1*j* and aspirates the nozzles on the head section through the cap units 1*j* being in close contact with the heads to generate a negative pressure when the heads do not successfully discharge the solution and the inks. A first blade 1*l* and a second blade 1*m*, which correspond to each cap unit 1*j* in the recovery unit R, are cleaning members for wiping the head section and are made of an elastic material such as rubber, and a blade holder in holds the first blade 1*l* and the second blade 1*m*.

In this embodiment, when the carriage 1*b* returns to the home position HP of the recovery unit R, the blade holder 1*n* moves along the direction perpendicular to the main scanning direction of the carriage 1*b*, i.e., along the discharging face of the cartridge 1*a* and four first blades 1*l*, four second blades 1*m* on the left wipe their respective ink nozzle faces on the head section and the first blade 1*l* and the second blade 1*m* on the right wipes the solution nozzle face on the head section.

In this embodiment, an aqueous cationic polymer solution was used as a printability improving solution, and conventional inks containing acid dyes were used as recording inks. Table 1 shows a typical example of formulations of the printability improving solution and the recording inks.

TABLE 1

| | Printability improving solution | Inks | | | |
|---|---|---|---|---|---|
| | | Black | Cyan | Magenta | Yellow |
| Dye | — | 3.0 | 3.0 | 3.0 | 3.0 |
| Glycerin | 7.0 | 7.0 | 7.0 | 7.0 | 7.0 |
| Diethylene glycol | 5.0 | 8.0 | 8.0 | 8.0 | 8.0 |
| Urea | — | 5.0 | — | — | — |
| Acetylene glycol surfactant | — | — | 1.0 | 1.0 | 1.0 |
| Polyallyamine | 4.0 | — | — | — | — |
| Benzalkonium chloride | 0.5 | — | — | — | — |
| Triethylene glycol monoethyl ether | 3.0 | — | — | — | — |
| Water | | (the balance) | | | |

Figures are represented as percent by weight.

A wiping operation in accordance with the present invention will now be described with reference to FIGS. 2A to 2C, which are outlined front views for illustrating a wiping operation of the recovery unit R in the ink jet recording apparatus shown in FIG. 1. Numeral 2*a* is a wiper blade, numeral 2*b* is a wiper blade holder, and numeral 2*d* is a rail for moving the wiper blade holder 2*b*, which extends in the direction (arrow 2*e*) perpendicular to the moving direction (arrow 2*g*) of the carriage.

Figure 2A:
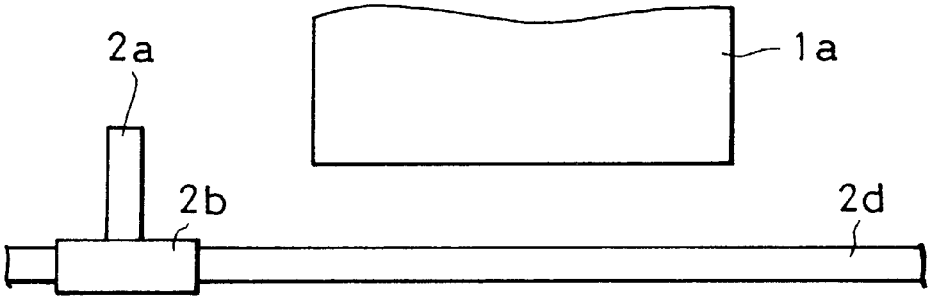
FIGS. 2A to 2C are outlined front views for illustrating a wiping operation of a recovery unit in the ink jet recording apparatus shown in FIG. 1.
Figure 2B:
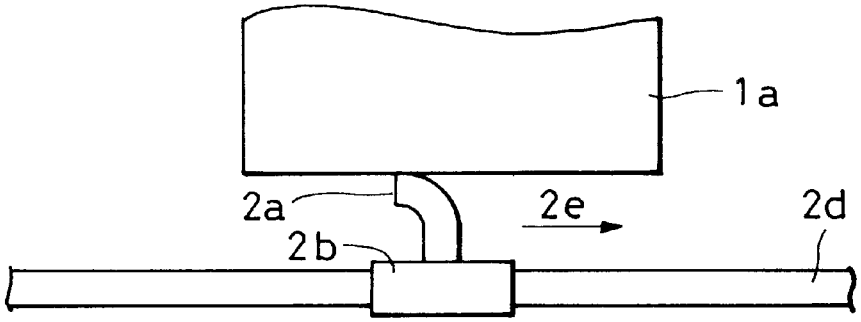
Figure 2C:
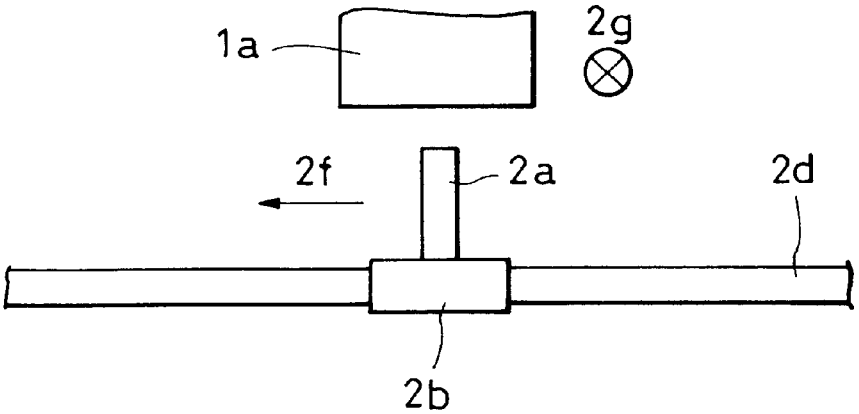

As shown in FIG. 2A, the head section of the cartridge 1*a* mounted on the carriage returns from the right side (the recording side) to the home position and stops at a position capable of wiping the head section. Next, as shown in FIG. 2B, the blade holder 2*b* having the wiper blade 2*a* moves from the standby position in the direction of the arrow 2*e* so as to come into contact with the head section with a given contact pressure in order to wipe the face of the head section. After wiping, as shown in FIG. 2C, the recording head mounted on the carriage moves to the printing zone side in the direction of the arrow 2*g* so that the wiper blade 2*a* detaches from the face of the head section, and then the blade holder 2*b* returns to the standby position in the direction of the arrow 2*f*. The wiping operation is completed in such a manner.

In this embodiment, the paper travelling zone is separated from the wiping zone along the main scanning direction of the carriage, and the wiping direction is parallel to the paper travelling direction. If droplets of the inks and the printability improving solution adhered to the wiping blade are spattered due to elasticity of the wiping blade, the spattered ink rarely reaches the travelling zone of the recording medium and thus the recording medium can be protected from contamination.

The wiping direction is not limited to the above-mentioned direction (the arrow 2*e* direction), and other wiping directions may be used. For example, wiping in the direction of the arrow 2*g* and bi-directional wiping in the direction of the arrow 2*g* and the arrow 2*e* may be available.

The wiper blade is made, with the aim of a stable long-term performance, of a material that cannot be deteriorated by the inks and the printability improving solution for long periods and cannot be easily broken during use for long periods. Examples of preferable materials include silicone rubbers, urethane rubbers, butadiene-acrylonitrile copolymers (HNBRs), and ethylene-propylene-diene terpolymers (EPDM rubbers).

EXAMPLE 1

Figure 3A:
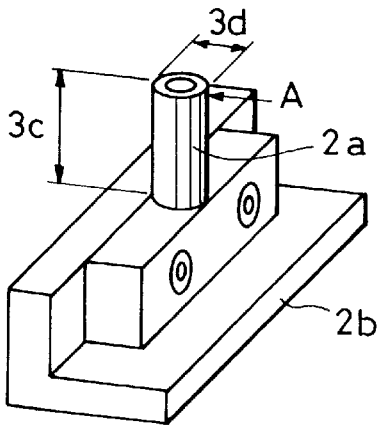
FIGS. 3A to 3F are schematic views for illustrating a correlation between a wiper blade and a head of Example 1 in accordance with the present invention.

A wiper blade configuration of a liquid discharging apparatus in accordance with the present invention will now be described with reference to FIGS. 3A to 3F. FIG. 3A is an isometric view of a wiper blade of Example 1, FIG. 3B is an isometric view of an ink jet recording head of Example 1, FIG. 3C is a sectional view of an indented nozzle face taken from section X—X of FIG. 3B, and FIGS. 3D to 3F are enlarged sectional views illustrating the wiping of the nozzle face of the head.

Figure 3B:
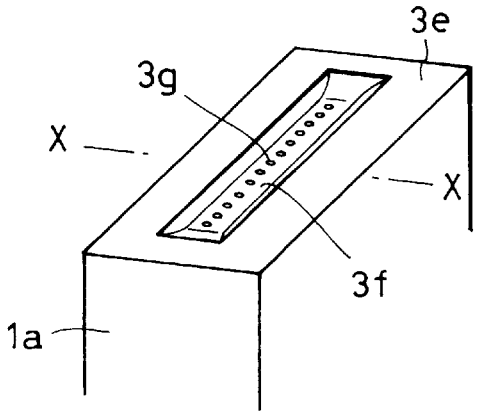

In FIG. 3A, the arrow A represents the edge of a hollow cylindrical wiper blade 2*a* which has a free length 3*c*. It is preferable that the outer diameter 3*d* of the wiper blade 2*a* be substantially equal to the width (3.0 mm in FIG. 3C) of the indented portion 3*f* of the head as shown in FIG. 3C. If the outer diameter of the wiper blade 2*a* is smaller than the width as shown in FIG. 3E, the wiper blade 2*a* can also be practically used when it comes into contact with the nozzles on the indented portion 3*f*. If the outer diameter of the wiper blade 2*a* is larger than the width, as shown in FIG. 3F, the wiper blade 2*a* can also be practically used when it comes into close contact with the nozzles on the indented portion 3*f* due to noticeable elastic deformation.

Figure 3C:
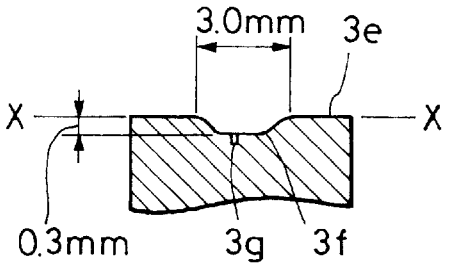
Figure 3D:
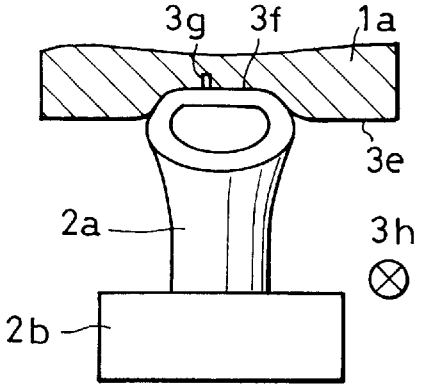
Figure 3E:
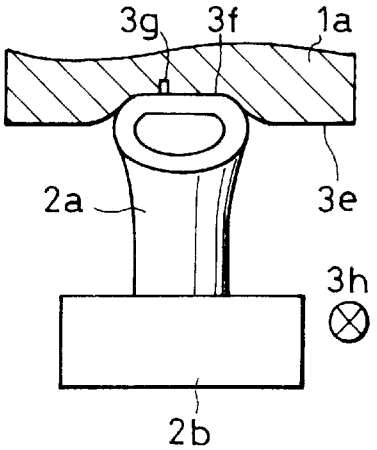
Figure 3F:
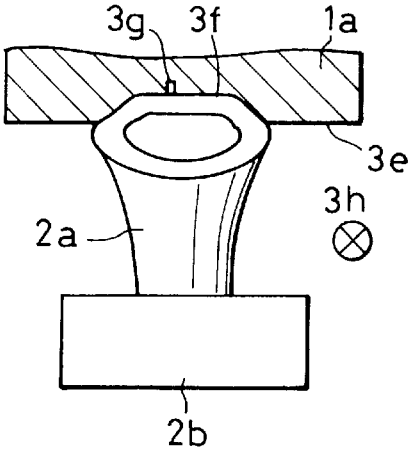

The head face 3*e* in FIG. 3C functions as a capping face during aspiration. A long indented portion 3*f* is formed so as to be surrounded by the head face 3*e* and is provided with a nozzle array 3*g* along the longitudinal direction. The indented portion 3*f* does not have an arc cross-sectional view, as shown in FIG. 3C.

When wiping the ink jet recording head shown in FIGS. 3B and 3C with the hollow cylindrical wiper shown in FIG. 3A, the edge of the hollow cylindrical wiper is noticeably deformed due to the contact pressure and fits smoothly to the indented portion, hence the wiper ensures satisfactory cleaning of the indented portion including the angled corners unless the wiper does not have a shape which is equal to the sectional shape of the indented portion.

According to the experimental results obtained by the present inventors, when a hollow cylindrical wiper having a height or free length 3*c* of 5.0 mm, an outer diameter 3*d* of 3.0 mm and an inner diameter of 1.4 mm is applied to a head, as shown in FIG. 3C, provided with a long indented portion 3*e* with a length of 3.0 mm and a depth of 0.3 mm along the nozzle array 3*g* while varying the penetration depth of the wiper to the head from 0.6 mm to 1.6 mm with a 0.2-mm step, the edge of the hollow cylindrical wiper is deformed to fit smoothly to the shape of the indented portion 3*e* and to wipe well the entire surface of the indented portion, if the center of the wiper is located between both edges of the indented portion.

In this example, HNBR rubber is used for the hollow cylindrical wiper. The experimental results demonstrate that desirable characteristics are achieved by using a rubber having an HS(A) hardness in a range from 30° to 80°, and preferably from 55° to 75°. Herein, the HS(A) hardness is determined by JIS spring-type hardness test Model A in the present invention. Table 2 shows correlations between the contact load of the HNBR-rubber hollow cylindrical wiper and the penetration depth at various hardness levels in this example. The results shown in Table 2 demonstrate that the contact load substantially does not depend on the penetration depth in all the hardness levels of 55°, 65°, and 75°. The wiper having an HS(A) hardness of 55° and the wiper having an HS(A) hardness of 65° have very similar contact loads, and the wiper having an HS(A) hardness of 75° has a contact load which is about twice that of other wipers.

TABLE 2

| HS(A) | Penetration Depth | | | | | |
|---|---|---|---|---|---|---|
| Hardness | 0.6 mm | 0.8 mm | 1.0 mm | 1.2 mm | 1.4 mm | 1.6 mm |
| 55° | 39 g | 39 g | 40 g | 40 g | 40 g | 40 g |
| 65° | 50 g | 50 g | 51 g | 53 g | 54 g | 54 g |
| 75° | 90 g | 88 g | 93 g | 93 g | 91 g | 93 g |

(at a temperature of 5° C. and a humidity of 10%)

The ink contamination can be satisfactorily removed by wiping under the contact load in the rubber having an HS(A) hardness of 55°, although a higher contact load is more effective for removing the contamination.

Accordingly, it is preferable that the hollow cylindrical wiper having the above-mentioned size has a contact load in a range from 30 g to 60 g and the HNBR rubber as the wiper material has an HS(A) hardness in a range from 55° to 65°.

When the wiping speed is too high, the contact pressure is not stabilized or a stick slip occurs, hence the contamination will not be sufficiently removed.

In this example, the wiping speed of the hollow cylindrical wiper is preferably 5 mm/sec. to 50 mm/sec., and more preferably 5 mm/sec. to 20 mm/sec. under a contact load of 30 g to 60 g in order to achieve a high contamination-removing performance.

The contamination-removing performance is affected by the curvature of the edge of the wiper which comes into contact with the head. Table 3 shows the wiping performance when the curvature of the edge is varied, in which the hollow cylindrical wiper is made of an HNBR rubber having an HS(A) hardness of 65°.

TABLE 3

| Curvature of | Wiping speed | | | |
|---|---|---|---|---|
| edge (R) | 5 mm/s | 10 mm/s | 20 mm/s | 50 mm/s |
| 0.3 mm | B | B | B | C |
| 0.1 mm | A | A | A | B |

Removal of contamination
A: Excellent
B: Good
C: Slightly inferior
D: No good
Wiping Conditions
Wiper material: HNBR rubber with an HS(A) hardness of 65°
Free length: 5.0 mm
Outer diameter: 3.0 mm TABLE 3-continued

| Curvature of edge (R) | Wiping speed 5 mm/s | 10 mm/s | 20 mm/s | 50 mm/s |
|---|---|---|---|---|

Inner diameter: 1.4 mm
Penetration depth: 1.0 mm

The results shown in Table 3 demonstrate that the sticky contamination can be removed by a wiper edge having a curvature R of 0.3 mm and more effectively removed by a wiper edge having a curvature R of 0.1 mm when the wiping speed is in a range from 5 mm/sec. to 20 mm/sec. and the contact load is in a range from 30 g to 60 g.

A flash which is left on the edge or wall of the wiper will damage the edge of the nozzle during wiping, hence the ink or the printability improving solution will not be discharged satisfactorily.

Accordingly, it is preferable that the curvature R of the wiper edge be 0.3 mm or less, and more preferably 0.1 mm or less and that the wiper edge has no flash as in Example 1. The wiper therefore must be formed in consideration of these results.

The hollow cylindrical wiper in accordance with this embodiment can be deformed in all directions including the wiping direction, whereas the conventional plate wiper can be deformed only in the wiping direction. When the conventional plate wiper is used, the wiper may be shifted relative to the head due to shifting of the stop position of the head and variation of the position of the wiper holder assembled in the apparatus.

The hollow cylindrical wiper in accordance with this embodiment, however, can be deformed to offset such a shift due to shifting of the stop position of the head and variation of the position of the wiper holder. The wiper can therefore wipe completely the entire indented nozzle face regardless of shifting between the wiper and the head.

Figure 4A:
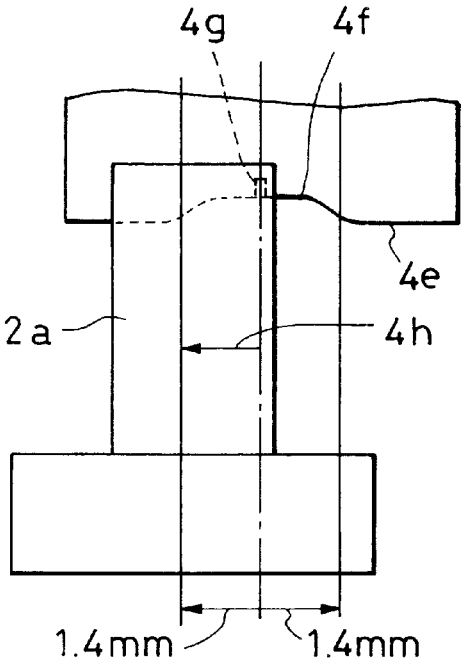
FIGS. 4A to 4C are schematic views for illustrating self amendment of a wiping path of a hollow cylindrical wiper of Embodiment 1 in accordance with the present invention.
Figure 4B:
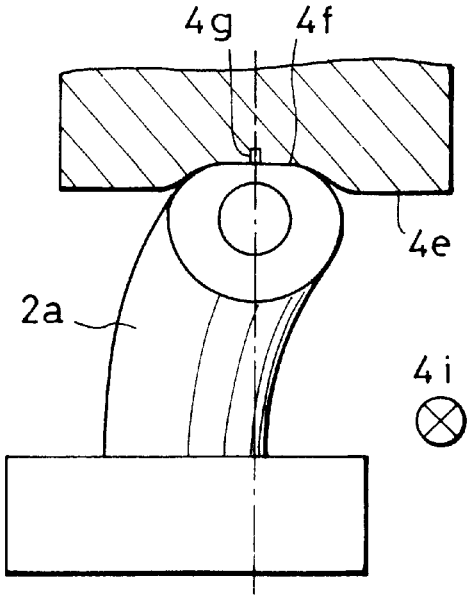
Figure 4C:
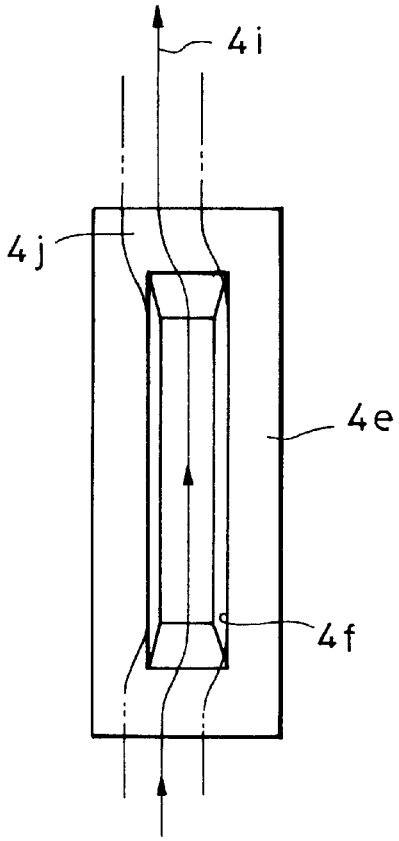

According to other experimental results obtained by the present inventors, when a hollow cylindrical wiper having a height or free length 3*c* of 5.0 mm, an outer diameter 3*d* of 3.0 mm and an inner diameter of 1.4 mm is applied to a head, as shown in FIG. 3C, provided with a long indented portion with a length of 3.0 mm and a depth of 0.3 mm along the nozzle array at a penetration depth of the wiper to the head of 1.0 mm, the edge of the hollow cylindrical wiper can be deformed to fit smoothly to the indented portion, as shown in FIGS. 4B and 4C, within a relative shift distance of ±1.4 mm on both sides between the wiper and the head as shown in FIG. 4A. Accordingly, the hollow cylindrical wiper can fit smoothly into the indented portion when the center of the hollow cylindrical wiper is located between both ends of the indented portions.

The shape and the size of the hollow cylindrical wiper and the material for the wiper are not limited to the above-mentioned example. Other shapes and sizes of the wiper and other materials having different HS(A) hardness levels may also be used in this invention. As described above, silicon rubbers, urethane rubbers and EPDM rubbers may also be used instead of the HNBR rubber used in this example.

The wiping operation in the present invention may be performed after the recovery movement which starts after a predetermined number of dotting cycles for printing are repeated.

According to the experimental results obtained by the present inventors, in a high quality printing system having high waterproof characteristics without bleeding between different colors in which a printability improving solution is discharged onto a printing zone of a recording medium then inks are discharged immediately onto the printing zone to simultaneously coagulate the ink, the amount of the mist mixture deposited on the ink head face increases in proportion to repeated dotting cycles.

The timing of the wiping operation is determined by the repeated dotting cycles just before the inks cannot be satisfactorily discharged due to coagulation of the mist mixture and deposition of the inks on the ink head face. In this example, the ink head face is wiped along the nozzle array using the hollow cylindrical wiper every $3.0\times10^7$ dotting cycles so as not to squeeze the deposition into the nozzles, in order to remove the deposition on the ink head face.

If the above dotting cycles are counted during printing and the printing is discontinued to wipe the ink head face, nonuniform printing will occur between before and after wiping. In the present invention, therefore, the wiping operation is performed after exhausting the paper even if the given dotting cycles are counted during printing.

In this example, the printability improving solution, which reacts with the dyes of the inks, is used to make the dyes insoluble on the paper. The hollow cylindrical wiper in accordance with the present invention is also effective for systems using pigment inks which include carbon and the like and are deposited by drying on the ink head face.

EXAMPLE 2

FIGS. 5A to 5E show a wiper of Example 2 in the liquid discharging apparatus in accordance with the present invention. Components having the same function as in Example 1 are referred to with the same identification numbers, and a detailed description thereof with reference to drawings has been omitted. The wiper of Example 2 can also be applied to the recording apparatus shown in FIG. 1.

Figure 5A:
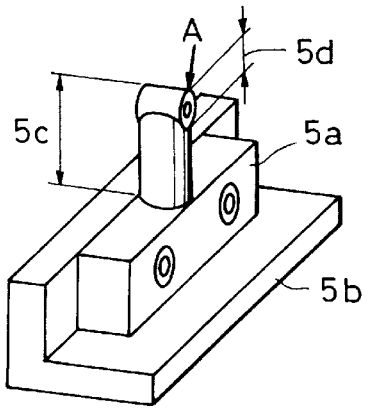
FIGS. 5A to 5E are a series of schematic views illustrating a correlation between an ink jet recording head and a wiper of Embodiment 2 in accordance with the present invention.

FIG. 5A is an isometric view of the wiper. The wiper has a hollow edge section indicated by arrow A and a free length 5*c*. It is preferable that the outer diameter 5*d* of the hollow edge section in FIG. 5A be substantially equal to the width of the indented portion of the head. As in the hollow cylindrical wiper of Example 1, if the outer diameter of the wiper blade is smaller than the width of the indented portion, the wiper blade can also be practically used when it comes into contact with the nozzles on the indented portion. If the outer diameter of the wiper blade is larger than the width, the wiper blade can also be practically used when it comes into close contact with the nozzles on the indented portion due to noticeable elastic deformation.

Figure 5B:
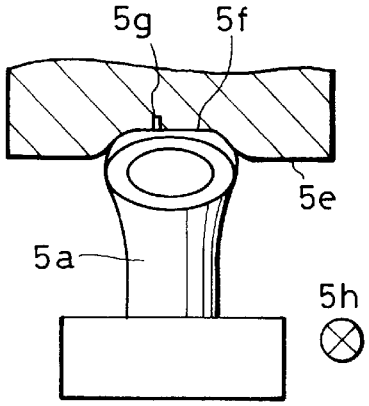
Figure 5C:
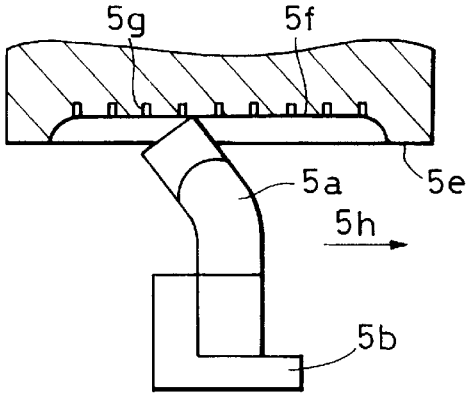

FIGS. 5B and 5C are a front view in the direction of the arrow 5*h* and a side view perpendicular to arrow 5*h*, respectively, illustrating the wiping operation by the wiper which moves along the long indented head portion having a non-arc section.

As shown in FIG. 5B, the hollow edge section of the wiper of this example can be sufficiently deformed to fit smoothly to the indented portion due to the contact pressure during wiping, even if the shape of the hollow edge section does not fit into the indented portion when no contact pressure is applied.

Figure 5D:
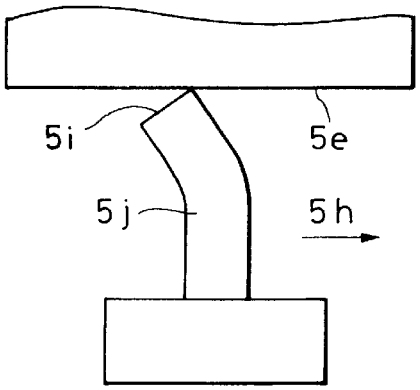
Figure 5E:
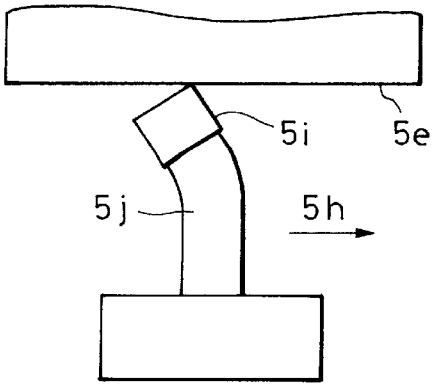

In conventional plate wipers and the hollow cylindrical wiper in accordance with Example 1, the edge face 5*i* does not come into contact with the head because the edge face 5*i* faces away from the head due to deformation during wiping as shown in FIG. 5D (hereinafter such wiping is referred to as forward wiping). In contrast, in the wiper of Example 2, the edge face 5*i* faces and comes into contact with the head due to deformation during wiping as shown in FIG. 5E (hereinafter such wiping is referred to as counter wiping). The counter wiping can more effectively remove contamination on the head face than the forward wiping under the same contact load. The counter wiping using the wiper of Example 2, as shown in FIG. 5E, is therefore suitable for removing a large amount of very sticky deposition composed of thickened or coagulated inks and the resin component of the printability improving solution compared with the forward wiping shown in FIG. 5*d*.

According to the experimental results obtained by the present inventors, when a wiper having a height or free length 5*c* of 5.0 mm, an outer diameter 3*d* of the hollow edge section of 3.0 mm and an inner diameter of 1.4 mm is applied to a head, as shown in FIG. 3C, provided with a long indented portion with a length of 3.0 mm and a depth of 0.3 m along the nozzle array while varying the penetration depth of the wiper to the head from 0.6 mm to 1.6 mm with a 0.2-mm step, the hollow edge of the wiper is deformed to fit smoothly to the shape of the indented portion and to wipe well the entire surface of the indented portion, if the center of the wiper is located between both edges of the indented portion.

In this example, wipers are made of HNBR rubbers of an HS(A) hardness of 55°, 65° and 75°, respectively. Table 4 shows correlations between the contact load of the HNBR-rubber wipers with hollow edge sections and the penetration depth at various HS(A) hardness levels in this example. The results shown in Table 4 demonstrate that the contact load depends on the penetration depth in all the HS(A) hardness levels of 55°, 65° and 75°.

TABLE 4

| HS(A) | Penetration Depth | | | | | |
|---|---|---|---|---|---|---|
| Hardness | 0.6 mm | 0.8 mm | 1.0 mm | 1.2 mm | 1.4 mm | 1.6 mm |
| 55° | 42 g | 44 g | 43 g | 49 g | 51 g | 55 g |
| 65° | 50 g | 49 g | 55 g | 56 g | 59 g | 66 g |
| 75° | 113 g | 137 g | — | — | — | — |

(at a temperature of 5° C. and a humidity of 10%)

When using the wiper of Example 2, the parameters of the wiper must be optimized in consideration of the relative position between the wiper and the head so as to achieve satisfactory wiping results even under severe conditions. The wiper having an HS(A) hardness of 55° and the wiper having an HS(A) hardness of 65° have very similar contact loads, and the wiper having an HS(A) hardness of 75° has a contact load which is at least twice that of other wipers.

The ink contamination can be satisfactorily removed by wiping under the contact load in the rubber having an HS(A) hardness of 55°, although a higher contact load is more effective for removing the contamination.

Accordingly, it is preferable that the wiper which is made of HNBR rubber and has the above-mentioned shape and size has a contact load in a range from 50 g to 80 g and the HNBR rubber as the wiper material has an HS(A) hardness in a range from 60° to 80°.

When the wiping speed is too high, the contact pressure is not stabilized or a stick slip occurs, hence the contamination will not be sufficiently removed. In this example, the wiping speed of the wiper is preferably 5 mm/sec. to 20 mm/sec. under a contact load of 30 g to 70 g in order to achieve a high contamination-removing performance.

The shape, size, and HS(A) hardness of the above-mentioned wiper are described as an example, and are not limited in the present invention. Other shapes, sizes and HS(A) hardnesses of the wiper having a hollow edge section may also be used in this invention.

As described above, silicon rubbers, urethane rubbers and EPDM rubbers may also be used instead of the HNBR rubber used in this example.

As described above, the counter wiping in accordance with Example 2 can remove a large amount of very sticky deposition composed of thickened or coagulated ink and a resin component of the printability improving solution from the head face more effectively than the forward wiping. It is preferable that the speed of the counter wiping be in a range from 5 mm/sec. to 20 mm/sec. and the contact load be in a range from 30 g to 70 g.

The contamination-removing performance is affected by the curvature of the edge of the wiper which comes into contact with the head.

TABLE 5

| Curvature of | Wiping speed | | | |
|---|---|---|---|---|
| edge (R) | 5 mm/s | 10 mm/s | 20 mm/s | 50 mm/s |
| 0.3 mm | C | C | C | D |
| 0.1 mm | A | A | B | C |

Removal of contamination
A: Excellent
B: Good
C: Slightly inferior
D: No good
Wiping Conditions
Wiper material: HNBR rubber with an HS(A) hardness of 65°
Free length: 5.0 mm
Outer diameter: 3.0 mm
Inner diameter: 1.4 mm
Penetration depth: 1.0 mm Table 5 shows the wiping performance when the curvature of the edge section is varied, in which the wiper is made by an HNBR rubber having an HS(A) hardness of 65°. The results shown in Table 5 demonstrate that the sticky contamination cannot be sufficiently removed by an edge section having a curvature R of 0.3 mm, but is effectively removed by an edge section having a curvature R of 0.1 mm when the wiping speed is in a range from 5 mm/sec. to 20 mm/sec. and the contact load is in a range from 30 g to 70 g.

A flash which is left on the edge or wall of the wiper will damage the edge of the nozzle during wiping, hence the ink or the printability improving solution will not be discharged satisfactorily.

Accordingly, it is preferable that the curvature R of the edge section of the wiper be 0.1 mm or less and that the edge section has no flash as in Example 2. The wiper therefore must be formed in consideration of these results.

EXAMPLE 3

Figure 6A:
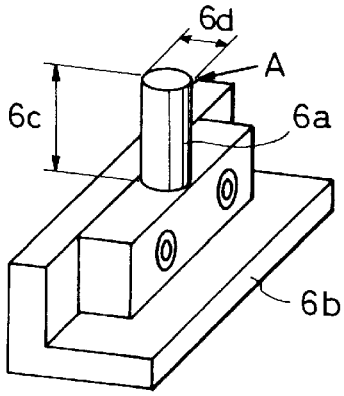
FIGS. 6A to 6F are a series of schematic views illustrating a correlation between an ink jet recording head and a wiper of Embodiment 3 in accordance with the present invention.
Figure 6B:
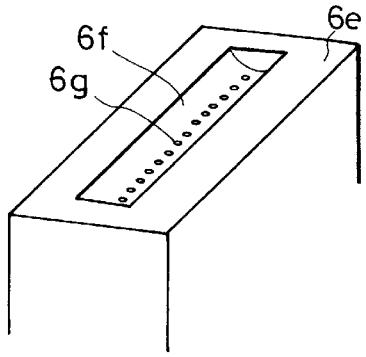
Figure 6C:
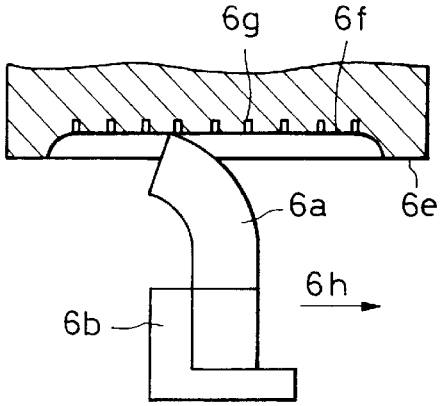
Figure 6D:
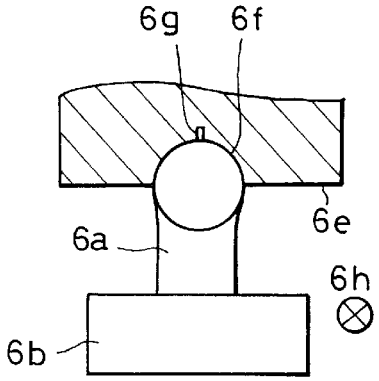
Figure 6E:
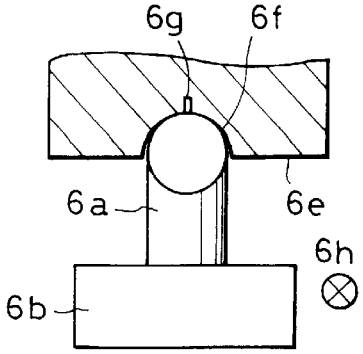
Figure 6F:
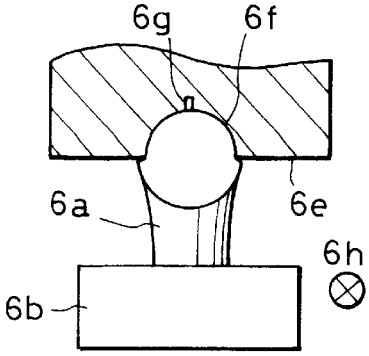

FIGS. 6A to 6F shows a wiper of a liquid discharging apparatus in Example 3 in accordance with the present invention. FIG. 6A is an isometric view of the wiper, and FIG. 6B is a recording head which has a long indented discharging face along the nozzle array and the indented face has an arc section. FIG. 6C is a front view illustrating the wiping of the indented face by moving the wiper in the direction of the arrow 6*h*, and FIG. 6D is a side view from the direction of arrow 6*h* which shows the contact state of the wiper and the head. FIGS. 6E and 6F are side views illustrating the contact states of the wipers having different outer diameters and the heads.

The wiper shown in FIG. 6A has a column shape which has an edge indicated by arrow A, a free length 6*c,* and an outer diameter 6*d.* It is preferable that the outer diameter 6*d* be substantially equal to the width of the indented head.

If the outer diameter of the wiper blade is smaller than the width of the indented portion as shown in FIG. 6E, the wiper blade can also be practically used when it comes into contact with the nozzles on the indented portion. On the other hand, if the outer diameter of the wiper blade is larger than the width as shown in FIG. 6F, the wiper blade can also be practically used when it comes into close contact with the nozzles on the indented portion due to noticeable elastic deformation.

EXAMPLE 4

Figure 7A:
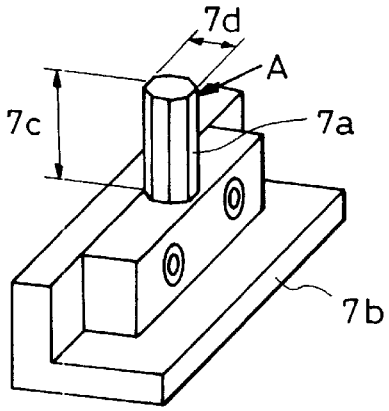
FIGS. 7A to 7E are a series of schematic views illustrating a correlation between an ink jet recording head and a wiper of Embodiment 3 in accordance with the present invention.
Figure 7B:
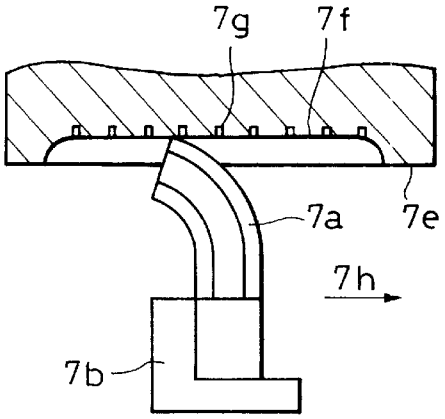
Figure 7C:
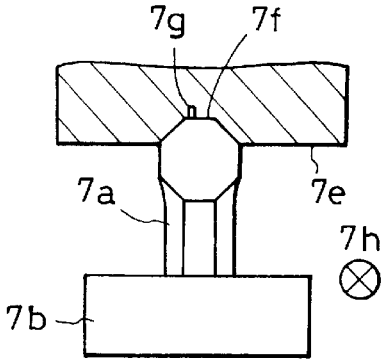
Figure 7D:
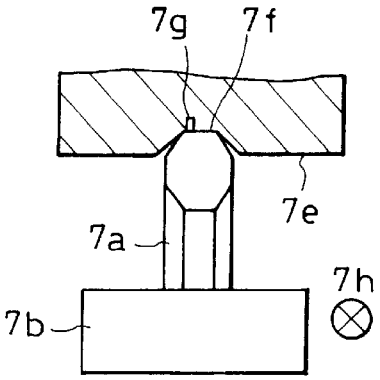

FIGS. 7A to 7E show a wiper of a liquid discharging apparatus in Example 4 in accordance with the present invention. FIG. 7A is an isometric view of the wiper, and FIG. 7B is a front view illustrating wiping of the indented face by moving the wiper in the direction of the arrow 7*h,* and FIG. 7C is a side view from the direction of arrow 7*h* which shows the contact state of the wiper and the head. FIGS. 7D and 7C are side views illustrating the contact states of the wipers having different outer diameters and the heads.

The wiper shown in FIG. 7A has a polygonal column shape which has an edge indicated by arrow A, a free length 7*c,* and an outer diameter 7*d* so as to fit well to the indented head portion having the non-arc sectional shape as shown in FIG. 7C. It is therefore preferable that the outer diameter 7*d* be substantially equal to the width of the indented head portion.

Figure 7E:
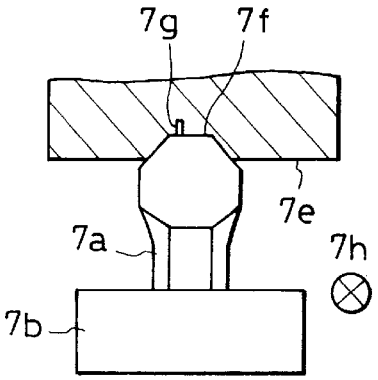

If the outer diameter of the wiper blade is smaller than the width of the indented portion, as shown in FIG. 7D, the wiper blade can also be practically used when it comes into contact with the nozzles on the indented portion. On the other hand, if the outer diameter of the wiper blade is larger than the width, as shown in FIG. 7E, the wiper blade can also be practically used when it comes into close contact with the nozzles on the indented portion due to noticeable elastic deformation.

Second Embodiment

Figure 8:
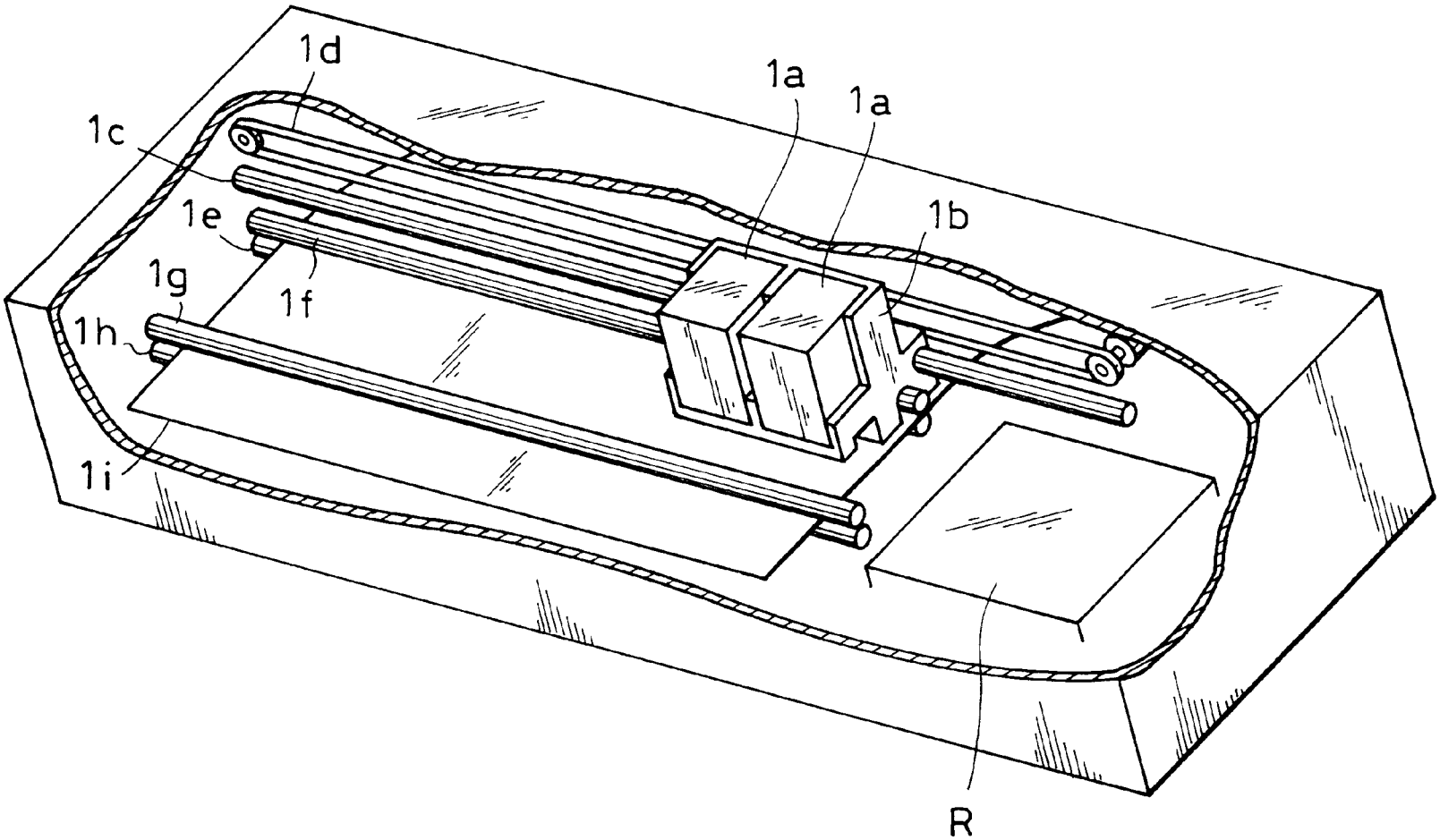
FIG. 8 is an isometric view of an ink jet recording apparatus of Embodiment 2 in accordance with the present invention.

FIG. 8 is an isometric partially broken away view of a liquid discharging apparatus in accordance with the Second Embodiment of the present invention.

Components in FIG. 8 having the same function as in Example 1 are referred to with the same identification numbers, and a detailed description thereof has been omitted.

Two ink jet cartridges 1*a* are loaded on a carriage 1*b* provided with a connector holder which is electrically connected to the recording head to send signals for driving the recording head.

Among these two ink jet cartridges 1*a,* the right cartridge contains a concentrated yellow, magenta and cyan ink and a diluted yellow, magenta and cyan ink separately, and the left cartridge contains a black ink and a printability improving solution separately. The carriage 1*b* is supported by a rail 1*c* which extends in the scanning direction of the carriage 1*b.* The carriage 1*b* is moved along the rail 1*c* by a driving belt 1*d.*

The recording head portion of the ink jet cartridge 1*a* mounted on the carriage 1*b* protrudes downwards from the carriage 1*b* and is located between carrying rolls 1*e* and 1*g* for the recording medium, such that the nozzle face of the recording head portion faces and is parallel to the recording medium 1*i* which is put on the guide face of a platen not shown in the drawing.

In this ink jet recording apparatus, a recovery unit which will be described later is provided in a recovery unit section R at the home position side on the right in FIG. 8.

The printability improving solution head discharges a printability improving solution onto a recording medium. The printability improving solution comes into contact with an ink discharged from the recording head and makes the dye in the ink insoluble to solvents such as water, hence the dye has waterproof characteristics. Since the printability improving solution simultaneously reacts with the dye in the ink, bleeding between different colors can also be prevented.

In this embodiment, the printability improving solution is composed of an aqueous cationic polymer solution and the recording ink is composed of an acid dye which has been generally used. Their composition is exemplified in Table 1.

Figure 9:
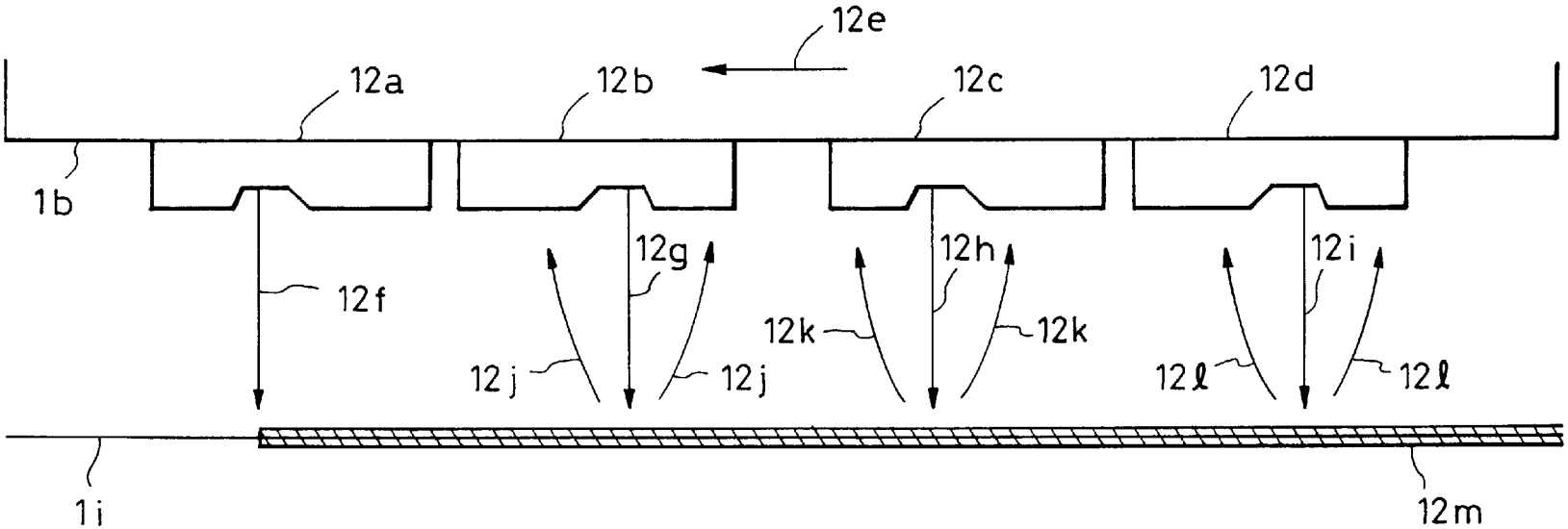
FIG. 9 is a schematic view for illustrating rebound of mists of an ink and a printability improving solution in the ink jet recording apparatus of Embodiment 2 in accordance with the present invention.

FIG. 9 is a sectional view illustrating the arrangement of a printability improving solution head and ink jet heads in this embodiment. Four ink jet cartridges provided with a printability improving solution head 12*a,* a black ink head 12*b,* a diluted color ink head 12*c* and a concentrated color ink head 12*d,* respectively, are mounted on a carriage 1*b* which moves in the direction of the arrow 12*e* during printing. In the printing process, a printability improving solution 12*f,* a black ink 12*g,* a diluted color ink 12*h* and a concentrated color ink 12*i* are discharged in that order from their respective heads onto the recording medium 1*i.*

According to the experimental results obtained by the present inventors, the quantity of mist rebounded to the ink jet head faces is different from each of the heads. That is, the quantity of rebounded mist of each ink is as follows:

$$12j > 12k > 12l$$

wherein 12*j* is the quantity of the rebounded mist of the black ink, 12*k* is the quantity of the rebounded mist of the diluted color ink, and 12*l* is the quantity of the rebounded mist of the concentrated color ink.

In the case that a preceding ink is discharged on the recording medium and then a succeeding ink is discharged on the medium, the quantity of the rebounded mist of the succeeding ink increases with the quantity of the preceding ink which has not penetrated into the recording medium. Such a phenomenon is also observed in the combination of an ink and the printability improving solution nevertheless either can be the preceding solution.

While ink is discharged from the ink jet heads 12*a* to 12*d* onto the recording medium 1*i* in that order, the preceding printability improving solution 12*f,* which has been discharged onto the recording medium 1*i,* penetrates into the recording medium 1*i* and thus the thickness of the layer 12*m* of the residual printability improving solution decreases toward the right side. The quantity of the rebounded mist and the quantity of the printability improving solution in the rebounded mist therefore decrease toward the right side. As a result, contaminants of the ink jet head faces have different characteristics from each other.

In brief, the contaminant of the head face is difficult to remove as the quantity of the deposited mist on the head face and the quantity of the printability improving solution in the deposited mist increase. The rank of such difficulty is as follows:

black ink head>diluted color ink head>concentrated color ink head

The contaminant on the face of the printability improving solution head has significantly different characteristics from those of the contaminants on the faces of the ink heads.

When an optimum cleaning means for these heads is determined, there is a common problem, that is, the coagulated material deposits on and near the nozzle edges. Such coagulation cannot be sufficiently removed by using only an elastic wiper blade, and in some cases the coagulation may be deeply squeezed into the nozzles. When a porous wiping member having a surface pore size, which is smaller than the diameter of the nozzle, is used, the small surface pores of the wiping member can scrape off the dust and the coagulation deposited on the nozzle edge.

In this embodiment, these heads are provided with their respective optimized cleaning units in order to effectively remove (1) the contaminants, including rebounded mist, straying mist, mist formed during discharging the printability improving solution and inks, and powdered paper, which are deposited on these heads, have different characteristics; and (2) coagulant deposited on and near the nozzle edge. These optimized cleaning units have different configurations, but are provided with at least wiping members made of porous materials.

Also, each cleaning unit is provided with a cleaning section which delays deterioration of the porous wiping member, and a cleaning mechanism for cleaning the cleaning section.

EXAMPLE 5

Figure 10A:
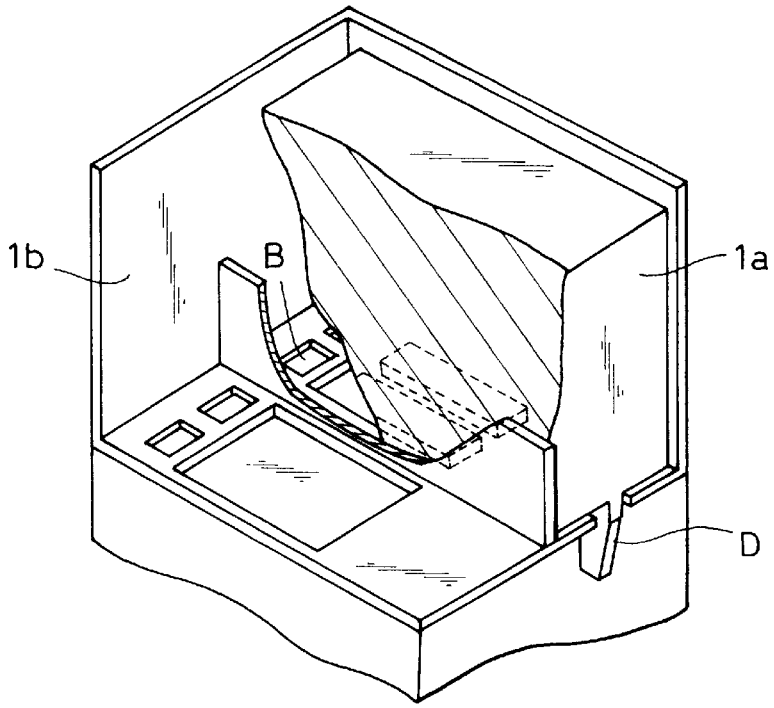
FIGS. 10A and 10B are isometric views of a recovery unit of Embodiment 5 in accordance with the present invention.
Figure 10B:
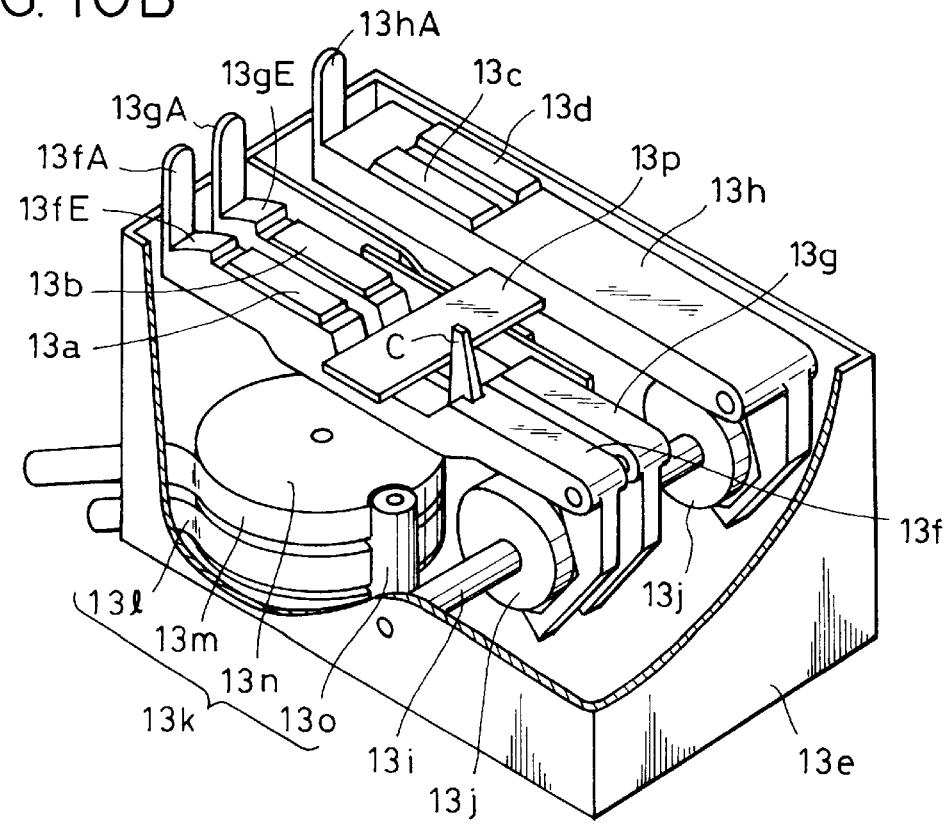

FIGS. 10A and 10B are isometric views of an example of the recovery unit in accordance with the present invention.

The recovery unit is provided with, from the left side, a cap 13*a* for the printability improving solution head, a cap 13*b* for the black ink head, a cap 13*c* for the diluted cyan, magenta and yellow ink head, and a cap 13*d* for the concentrated cyan, magenta and yellow ink head, in response to a plurality of ink jet cartridges 1*a* as shown in FIG. 8. The cap 13*a* for the printability improving solution head and the cap 13*b* for the black ink head have both aspiration and standby functions, whereas the cap 13*c* for the diluted cyan, magenta and yellow ink head and the cap 13*d* for the concentrated cyan, magenta and yellow ink head have only the standby function. The diluted cyan, magenta or yellow ink head and the concentrated cyan, magenta and yellow ink head are therefore aspirated by the cap 13*b* for the black ink head. These caps are held by cap levers 13*f*, 13*g* and 13*h* which are fixed to a recovery box 13*e* with an axle and turn on the axle by sliding on cam faces 13*j* of an aspiration cam 13*i*. The caps can therefore move upward or downward. When the carriage is located at the home position, all the caps cover their respective recording heads to prevent the nozzles of the recording heads from clogging due to thickening and depositing the inks as a result of evaporation of the solvents.

The cap levers 13*f*, 13*g* and 13*h* are provided with A-ribs 13*f*A, 13*g*A and 13*h*A, respectively, which are snap-fitted to the indented sections B of the carriage 1*b* when capping the heads.

The cap lever 13*f* for the printability improving solution cap is provided with a rib C and the ink jet cartridge 1*a* is provided with a rib D. The ribs C and D face each other when the concentrated color ink head 2*d* is covered with the cap 13*b* for aspiration-recovering treatment. The contact of the rib C with the rib D can prevent the contact of the cap 13*a* for the printability improving solution with the diluted color ink head 12*c* and thus the deposition of the reaction product of the printability improving solution with the recording ink on the face of the diluted color ink head 12*c*.

The cap levers 13*f* and 13*g* are provided with cleaners 13*f*E and 13*g*E, respectively, which are members of a cleaner unit for cleaning the wiper unit, as described later.

The caps 13*a* and 13*b* are connected to a pump unit 13*k*. When any recording head or the printability improving solution head is clogged, the head is aspirated through the pump unit 13*k* in the recovery process after the recording head or the printability improving solution is covered with the cap unit.

A tube pump is used for the pump unit 13*k* in this example. The pump unit includes tubes 13*l* and 13*m*, a roller holder 13*n* and a roller 13*o*. The roller holder 13*n* is fixed to the recovery box 13*e* by an axle and rotates on the axle. The roller 13*o* fixed to the recovery box 13*e* crushes the tubes 13*l* and 13*m* which are guided by the roller holder 13*n* to generate a negative pressure in the cap. In the pump unit, the tube 13*l* is used for aspirating only the printability improving solution and the tube 13*m* is used for aspirating only the recording inks. The printability improving solution therefore does not react with the inks in the pumping unit, and the pumping unit can be prevented from clogging due to deposition of the coagulated reaction products.

A wiper unit 13*p* includes a rubbing section which is composed of water-absorbable rubbing members made of, for example, a porous material and plate wiper blades; a pillar cleaning member made of an elastic material such as rubber; and a blade holder for holding them. The wiper unit 13*p* is fixed to the recovery box 13*e* and can move in the transverse directions.

The detailed configuration of the wiper unit 13*p* will be described with reference to FIGS. 11A to 11C and FIG. 12. Rubbing members (hereinafter referred to as wiping members) 14*a*, 14*b* and 14*c* are made of a water-absorbable material such as a porous material. Plate wiper blades 14*d*, 14*e* and 14*f* are made of an elastic material such as rubber, and function as back pads for adjusting the contact loads of the wiping members to the head faces. Hereinafter the plate wiper blade is referred to as a back wiper. Each of pillar cleaning members 14*g* and 14*h* is made of an elastic material and has a cavity (hereinafter the pillar cleaning member 14*g* is referred to as a smart power blade (SPB), and the pillar cleaning member 14*h* is referred to as a smart blade (SB)). The above-mentioned cleaning members are mounted on a blade holder.

The cleaning members clean the printability improving solution head and the ink heads of the ink jet recording apparatus in accordance with the present invention shown in FIG. 8 accompanied by movement of the blade holder in the direction of the arrow 14*j*. The wiping members, back wipers, smart blade and smart power blade in the wiper unit effectively play their different roles in the recovery operation.

Figure 11A:
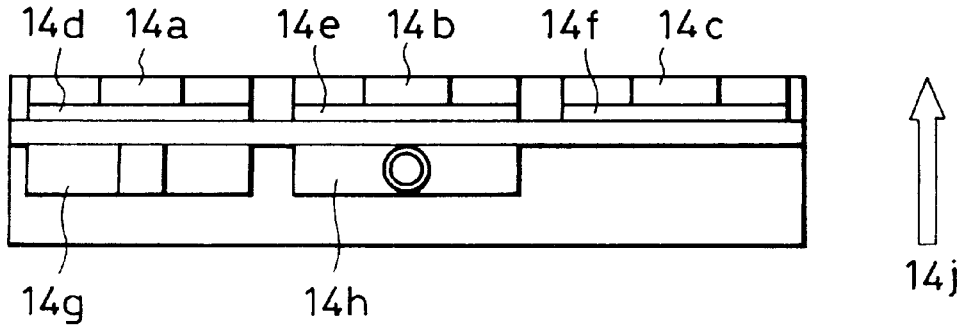
FIGS. 11A to 11C are a plan view, a rear elevation view and a front elevation view, respectively, for illustrating a configuration and an operation of a wiper unit of Embodiment 5.
Figure 11B:
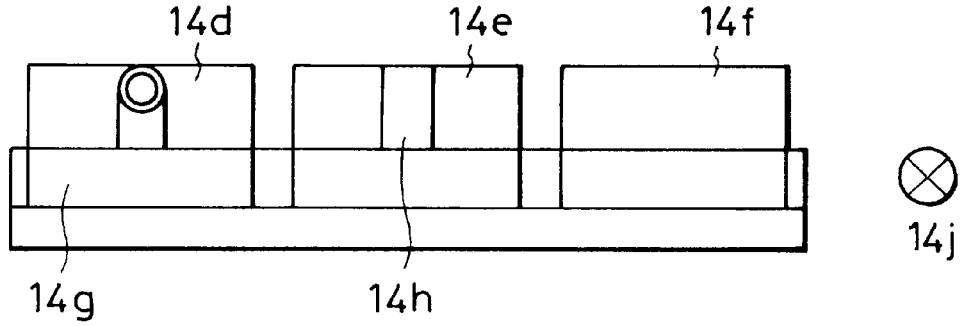
Figure 11C:
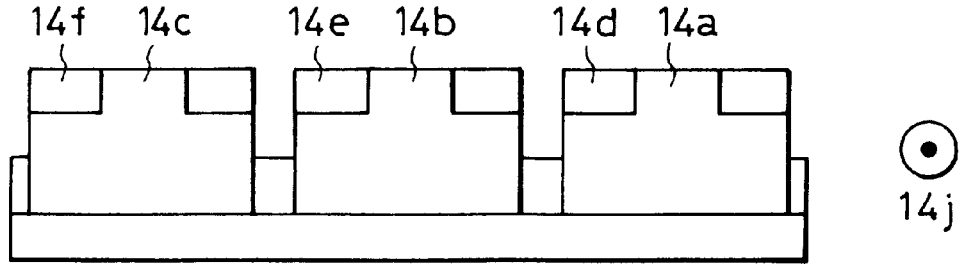

In FIGS. 11A to 11C, the heights or free lengths of the wiping members, back wipers, smart blade and smart power blade from the base are equal to each other. The height or free lengths can be varied independently so that individual members further demonstrate their functions.

Although each wiping member is placed on the corresponding back wiper in the drawings, these may be used after bonding them.

The plate wiper blade 14*d* and the pillar cleaning members 14*g* and 14*h* can be made of an HNBR rubber, and the plate wiper blades 14*e* and 14*f* can be made of a urethane rubber. The wiping members 14*a,* 14*b* and 14*c* can be made of any porous material. The use of the HNBR rubber in the plate wiper blade 14*d* and the pillar cleaning member 14*h* is due to excellent durability to the printability improving solution and the use of the HNBR rubber in the pillar cleaning members 14*g* and 14*h* is due to excellent formability of such hollow molded articles. The hardnesses of the pillar cleaning members 14*g* and 14*h* can be different from each other, even if these are made of the same material. For example, the pillar cleaning members 14*g* may have an HS(A) hardness of 65° and the pillar cleaning members 14*h* may have an HS(A) hardness of 55°. Since a hard material is suitable for the counter wiping, the pillar cleaning member 14*g* is harder than the pillar cleaning member 14*h*.

The operation of the wiper unit 13*p* will now be described with reference to FIG. 12.

The wiper unit 13*p* is provided with a rack 14*k* thereunder, and the rack 14*k* meshes with a gear 14*l*. The gear 14*l* and another gear 14*m* are mounted on the same axle, and the gear 14*m* meshes with a gear 14*n* which has a toothless section 14*o* and turns in cooperation with the aspiration cam (FIG. 10B). When the gear 14*n* turns clockwise with the aspiration cam 13*i,* the gears 14*m* and 14*l* turn counterclockwise, and the rack 14*k* moves to the left in the direction of the arrow 14*j*. The wiper unit 13*p* therefore horizontally moves toward the recording heads and wipes these heads. After completing the wiping process, the aspiration cam 13*i* stops, the recording heads are evacuated from the wiping region, then the aspiration cam 13*i* turns again. The wiper unit 13*p* moves to and is cleaned by a cleaning unit for the wiper unit (will be shown in FIGS. 13A to 13C in detail). When the gear 14*l* does not mesh the gear 14*n* due to the toothless section, the wiper unit 13*p* returns to the original position by means of the restoring force of an elastically deformed spring 14*p*. Immediately after such an aspiration process is completed or a given number of ink droplets are discharged, the wiper unit 13*p* wipes to clean the faces of the printability improving solution head and the ink heads at a given speed and a given contact pressure.

FIGS. 13A to 13C and FIGS. 14A to 14C show a configuration and operation of a cleaning unit for the wiper unit of the recovery unit in accordance with the present invention.

Figure 13A:
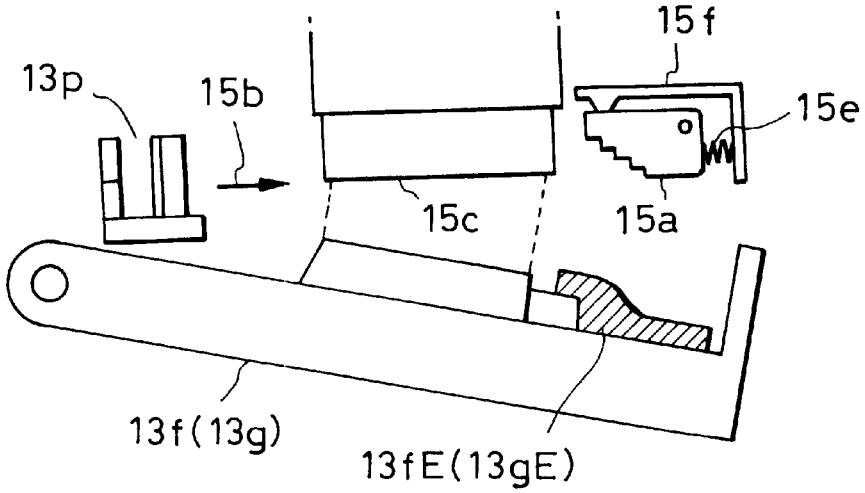
FIGS. 13A to 13C are side views for illustrating an operation for cleaning the head face by the wiper unit of Embodiment 5.
Figure 13B:
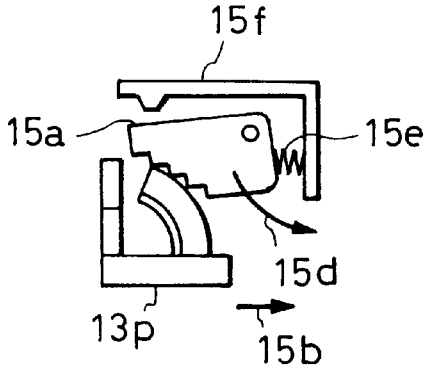
Figure 13C:
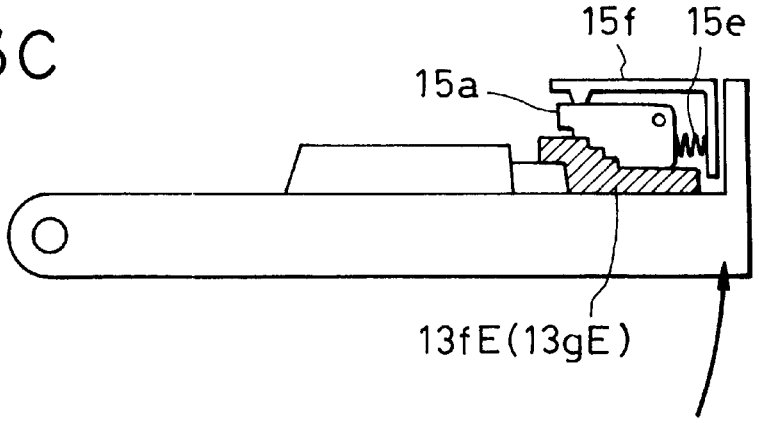

FIG. 13A is a sectional view illustrating an arrangement of the wiper unit 13*p,* the cap lever 13*f* (13*g*), a wiper unit cleaner 15*a,* the cleaner 13*f*E (13*g*E) and a recording head 15*c* when wiping is not performed. The configuration of this cleaning unit corresponds to the wiper unit section for cleaning the printability improving solution head and the wiper unit section for cleaning the black ink head and the diluted color ink head. The wiper unit cleaner 15*a* is fixed to a wiper unit cleaner piece 15*f* with an axle and turns on the axle. When the wiper unit cleaner 15*a* turns counterclockwise, a restoring force occurs by means of a spring 15*e* attached to the wiper unit cleaner piece 15*f*. The wiper unit cleaner 15*a* cannot turn clockwise due to the bent section of the wiper unit cleaner piece 15*f*. After the wiper unit 13*p* moves in the direction of the arrow 15*b* and wipes the recording head 15*c,* it is rubbed on the serrated wiper unit cleaner 15*a* as shown in FIG. 13B. FIG. 13B shows the wiper unit 13*p* in the midway of the moving path. The wiper unit 13*p* continues to move and the contaminants on the wiping members, back wipers, smart blade and smart power blade in the wiper unit 13*p* are scraped off. The wiper unit cleaner 15*a* turns counterclockwise in the direction of the arrow 15*d* and compresses the spring 15*e*. After completing the cleaning process, the wiper unit cleaner 15*a* rapidly turns clockwise and the wiper unit 13*p* simultaneously moves away from the wiper unit cleaner 15*a* rapidly. Immediately after this, as shown in FIG. 13C, the cap lever 13*f* (13*g*) fixed to the recovery box 13*e* with an axle lifts so that the cleaner 13*f*E (13*g*E) comes into close contact with the serrated wiper unit cleaner 15*a*. The contaminants adhered to the serrated wiper unit cleaner 15*a* are transferred to the cleaner 13*f*E (13*g*E). In FIGS. 13A to 13C, the wiper unit cleaner 15*a* corresponds to section A–B in FIG. 14C.

The wiper unit cleaner 15*a* may be made of a resin, such as polyacetal, by a molding process. Preferable materials for the cleaner 13*f*E (13*g*E) includes porous polyurethanes, such as Rubycell ET (trade name).

Figure 14A:
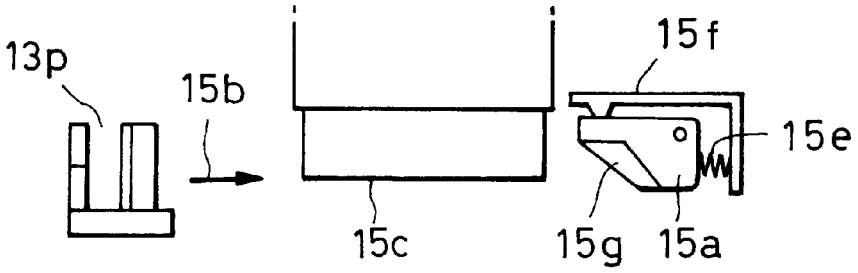
FIGS. 14A to 14C are side views for illustrating an operation for cleaning the head face by the wiper unit of Embodiment 5.
Figure 14B:
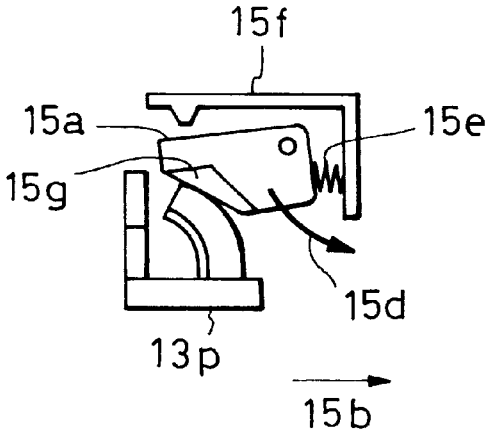
Figure 14C:
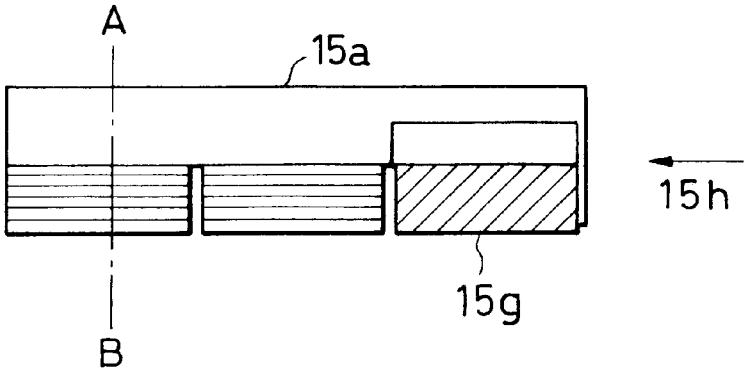

FIGS. 14A–14C show an arrangement of the wiper unit 13*p,* the wiper unit cleaner 15*g,* which is made of a porous material, such as Sunfine (trade name), and the recording head 15*c* when wiping is not performed. This cleaner unit cleans the wiper unit section which cleans the concentrated color ink head. The wiper unit cleaner 15*g* is bonded to a wiper unit cleaner substrate 15*a* which is fixed to the wiper unit cleaner piece 15*f* with an axle so as to turn on the axle. When the wiper unit cleaner 15*g* turns counterclockwise, a restoring force occurs by means of a spring 15*e* attached to the wiper unit cleaner piece 15*f*. The wiper unit cleaner 15*g* cannot turn clockwise due to the bent section of the wiper unit cleaner piece 15*f*. After the wiper unit 13*p* moves in the direction of the arrow 15*b* and wipes the recording head 15*c,* it is rubbed on the slanted face of the wiper unit cleaner 15*g* as shown in FIG. 14B. FIG. 14B shows the wiper unit 13*p* in the midway of the moving path. The wiper unit 13*p* continues to move and the contaminants on the wiping member in the wiper unit 13*p* are scraped off. The wiper unit cleaner 15*g* turns counterclockwise in the direction of the arrow 15*d* and compresses the spring 15*e*. After completing the cleaning process, the wiper unit cleaner 15*g* rapidly turns clockwise and the wiper unit 13*p* simultaneously moves away from the wiper unit cleaner 15*g* rapidly. The contaminants scraped by the wiper unit cleaner 15*g* move downward on the slanted face of the wiper unit cleaner 15*g* by the rubbing effect of the wiping member and are not retransferred to the wiping member. FIG. 14C is a sectional view of the wiper unit cleaner substrate 15*a* and the wiper unit cleaner 15*g* when viewed from the wiper unit 13*p*. In FIGS. 14A and 14B, the wiper unit cleaner substrate 15*a* and the wiper unit cleaner 15*g* are viewed from the arrow 15*h* in FIG. 14C.

Figure 12:
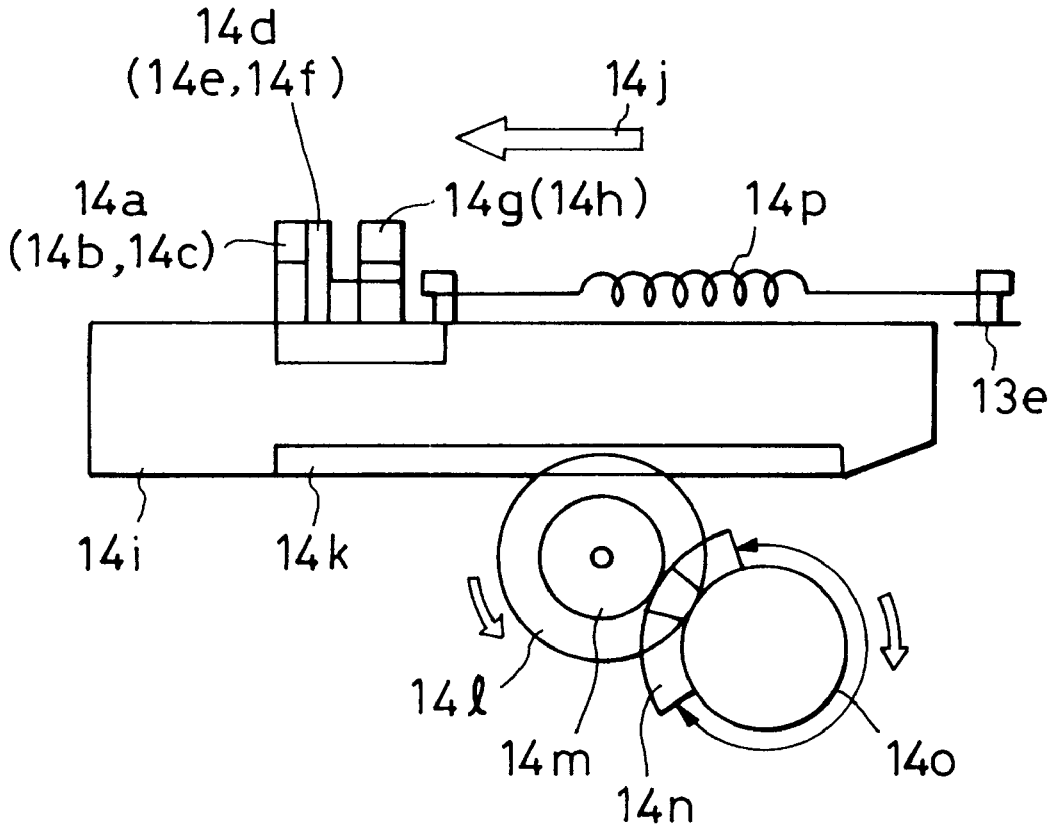
FIG. 12 is a side view for illustrating a configuration and an operation of a cleaner unit for the wiper unit of Embodiment 5.
Figure 15A:
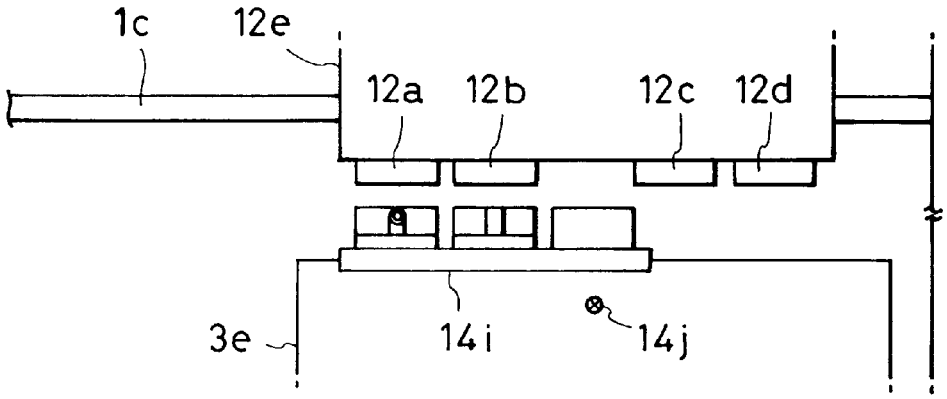
FIGS. 15A to 15C are side views for illustrating cleaning of the face by a rubbing member comprising a cleaning member and a rear pad.
Figure 15B:
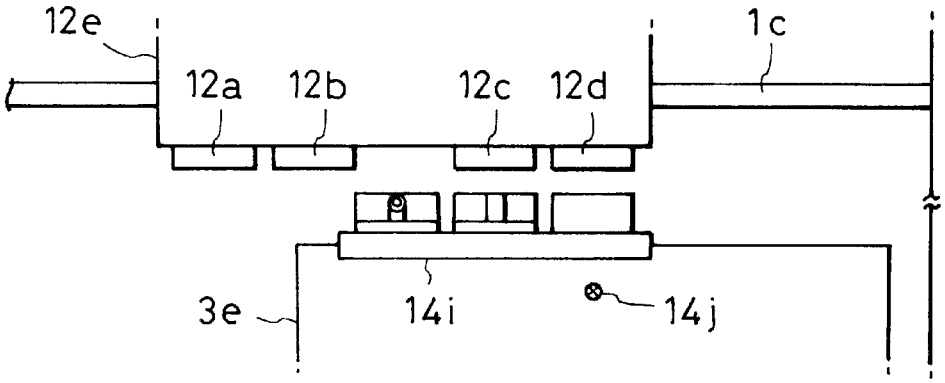
Figure 15C:
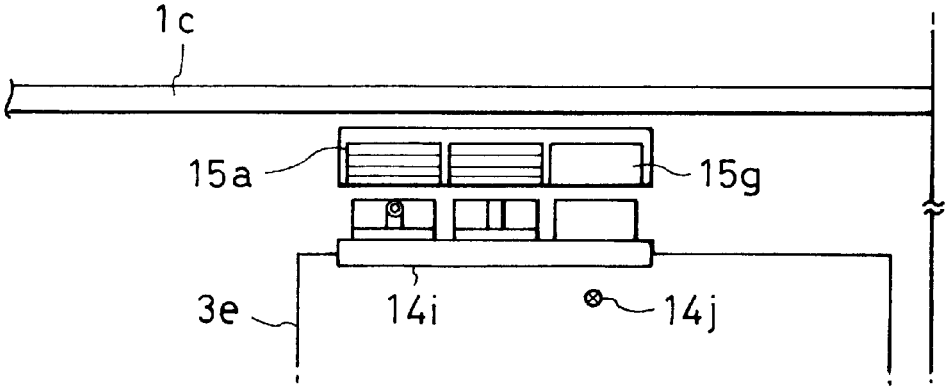

FIGS. 15A to 15C show the operation for cleaning the printability improving solution head and the ink jet heads of the ink jet recording apparatus shown in FIG. 8 using the cleaning means shown in FIGS. 11 and 12. In FIGS. 15A to 15C, although the heads are separated from the cleaning means to illustrate clearly the configuration of the present invention, the heads actually come into close contact with the cleaning means at some places perpendicular to the moving direction of the carriage (in the direction of the arrow 14*j*). The same relationship holds in FIGS. 22A to 22C and FIG. 23 described later.

After a given number of ink droplets are discharged from the printability improving solution head 12*a* or the black ink head 12*b,* the carriage 12*e* returns from the recording zone on the left in FIG. 8 to the home position and stops at a position which permits wiping as shown in FIG. 15A. Also, the carriage 12*e* stops at this position immediately after the aspiration process is completed. The blade holder 14*i* moves in the direction of the arrow 14*j* at a given speed and cleans the faces of the printability improving solution head 12*a* and the black ink head 12*b*.

Also, after a given number of ink droplets are discharged from the diluted color ink head 12*c* or the concentrated color ink head 12*d,* or immediately after the aspiration process is completed, the carriage 12*e* moves to a position shown in FIG. 15B and stops there. The blade holder 14*i* moves in the direction of the arrow 14*j* at a given speed and cleans the faces of the diluted color ink head 12*c* and the concentrated color ink head 12*d.* That is, the wiping member 14*a,* the back wiper 14*d* and the smart power blade 14*g* clean the printability improving solution head 12*a,* and the wiping member 14*b,* the back wiper 14*e* and the smart blade 14*h* clean the black ink head 12*b* and the diluted color ink head 12*c.* Further, the wiping member 14*c* and the back wiper 14*f* clean the concentrated color ink head 12*d.*

As shown in FIG. 15C, after the blade holder 14*i* cleans the faces of these heads, it dashes onto the cleaner unit 15*a* for the wiper unit to clean the wiping members 14*a,* 14*b* and 14*c,* the back wipers 14*d,* 14*e* and 14*f,* the smart power blade 14*g* and the smart blade 14*h* (refer to FIG. 13).

A wiper for exclusively cleaning the nozzle face of the printability improving solution head 12*a* may be provided in addition to the above-mentioned cleaning means. Although the nozzle array of the heads is arranged in the direction of the arrow 14*j* in this example, this exclusive wiper moves in the direction perpendicular to the nozzle array in the cleaning process (a so called transverse cleaning type). The transverse cleaning type of the exclusive wiper can ensure removal of the residual contaminants which are unavoidably left after cleaning by the above-mentioned cleaning means. The exclusive wiper is operated, for example, when a recording process to a sheet of recording paper is completed.

Since the wiping direction is the same as the carrying direction of the recording medium, the droplets adhered to the blade due to wiping will barely spatter on the carrying section of the recording medium. The recording medium can therefore be prevented from unexpected contamination.

The direction of cleaning is not limited to the above-mentioned direction. Wiping in different directions may be also available in order to enhance the wiping efficiency. For example, wiping from the back side to the front side in the drawings and reciprocal wiping are also effective.

According to such a wiping process, the cleaning means is cleaned immediately after wiping, hence the cleaning means can maintain a high cleaning efficiency for very long periods.

The back wiper, smart blade and smart power blade must be made of materials which are resistant to deterioration due to inks and printability improving solutions and damage due to mechanical stress in repeated cycles of use for long periods, in order to ensure long-term stable performance. Examples of preferable materials for such a purpose include silicone rubbers, urethane rubbers, HNBR rubbers, and EPDM rubbers.

In particular, it is preferable that the back wiper and smart power blade for the printability improving solution head be made of HNBR rubbers which are barely deteriorated and deformed by the contact for long periods with the printability improving solution.

The wiping member in the present invention must be made of a material which is resistant to deterioration due to inks and printability improving solutions and damage due to mechanical stress in repeated cycles of use for long periods, in order to ensure long-term stable performance. Examples of preferable materials for such a purpose include porous polyurethanes such as Rubycell (trade name).

The operation for cleaning the printability improving solution head and the ink heads of the ink jet recording apparatus shown in FIG. 8 using the cleaning means shown in FIGS. 11 and 12, and in particular, functions and advantages of each rubbing means and wiping means will now be described.

The cleaning of the face by the wiping member and the back wiper is described with reference to FIGS. 16A to 16F. FIG. 16A is an isometric view of the wiping member and the back wiper mounted on the blade holder. Numeral 17*a* is a water-absorbable porous wiping member and numeral 17*b* is a back wiper. The nozzle face of the head is indented from the capping face. Since the wiping member 17*a* is provided with cutout sections 17*c* at upper corners, the indented nozzle face is cleaned by the wiping member 17*a* and the capping face is cleaned by the back wiper 17*b.* Such a configuration of the porous wiping member is determined based on the cleaning effect as follows.

According to the experimental results obtained by the present inventors, satisfactory cleaning by the wiping member is achieved such that the wiping member absorbs the inks and printability improving solution inside the nozzles when the wiping member travels on the nozzle array. As shown in FIG. 16B, when the wiping member comes into contact with the face and wipes in the direction of the arrow 17*d,* a recovered region 17*f* surrounding the nozzle array occurs, which has water repellant characteristics and thus is less contaminated. A number of lines in the direction of the arrow 17*d* due to remnants, however, occur to form a remnant region 17*g.* The area of the remnant region 17*g* greatly depends on the moving speed of the wiping member.

When the moving speed is noticeably high, the face is almost occupied by the remnant region 17*g* and the recovered region 17*f* is left only near the nozzle array. The recovered region 17*f* will not occur when the nozzles do not contain the ink or the printability improving solution. If the printing and recovery processes are repeated under such conditions, the quality of the printed images gradually deteriorates due to irregular ink discharge or clogging.

When the moving speed is significantly low, the face is substantially occupied by the recovered region 17*f* and the remnant region 17*g* occurs only on the periphery of the face. Irregular ink discharge or clogging was not observed after the printing and recovery processes were repeated under such a condition. Accordingly, the inks and the printability improving solution can be stably discharged from the nozzles when a sufficiently wide recovered region 17*f* is formed so as to surround the nozzle array.

The wiping mechanism for illustrating the above-mentioned phenomena is as follows. When the ink in the nozzle is not absorbed into the porous member during the wiping process of the face, the contaminant trapped into fine pores on the surface of the porous member is partially retransferred onto the face by the contact pressure applied to the porous wiping member, hence a sufficiently wide recovery region does not occur.

In contrast, when the ink in the nozzle is absorbed into the porous member during the wiping process of the face, the ink is always supplied to the porous member and the contaminant trapped and absorbed into fine pores of the porous member is not transferred on the face due to the contact pressure. As a result, a sufficiently wide recovered region 17*f* occurs and ink discharging is stabilized.

Figure 16D:
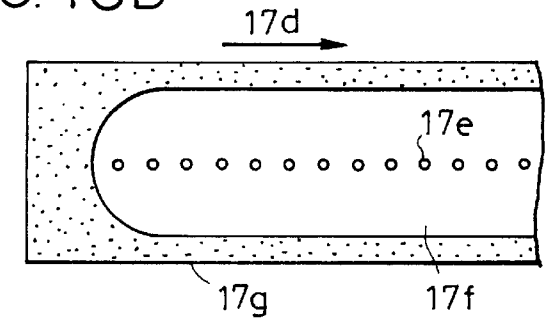
FIGS. 16B to 16D and FIG. 16F are front elevation views and FIG. 16E is a side sectional view for illustrating a configuration of a wiper unit of Embodiment 6 in accordance with the present invention.
Figure 16E:
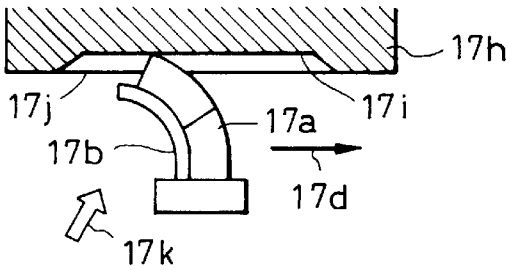

In the printability improving solution head and ink heads of the ink jet recording apparatus, as shown in FIG. 8, in accordance with the present invention, the wiping member 17*a* cleans, as shown in FIG. 16E, the indented nozzle face 17*i* in which the ink is sufficiently absorbed by the wiping member 17*a* and supplied from the nozzle, and both corners of the back wiper 17*b* scrape the remnants from the capping face 17*j*.

Figure 16F:
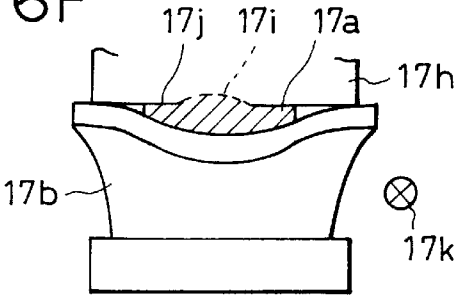
Figure 16A:
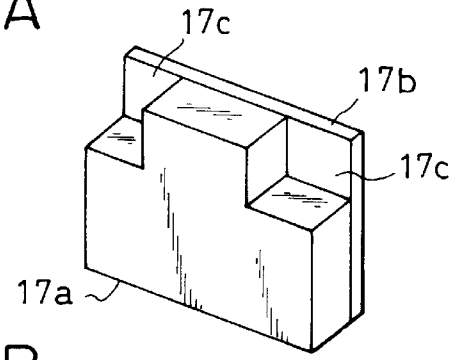
FIG. 16A is an isometric view.
Figure 16B:
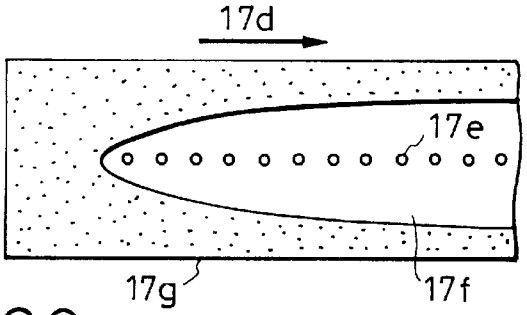
Figure 16C:
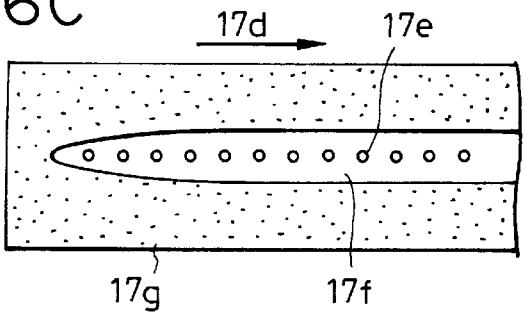

FIG. 16F is a view illustrating the wiping of the nozzle face 17*i*, viewed from the direction of the arrow 17*k* in FIG. 16E. FIG. 16F demonstrates that the wiping member 17*a* fits well into the indented nozzle face 17*i* to ensure the wiping.

The wiping member has other advantages. It is difficult to remove dust adhered to the edge of the nozzle and contaminants having high viscosity, such as coagulations of the printability improving solution and the inks, with an elastic wiper blade, and the contaminants may be squeezed into the nozzles by the wiper blade in some cases. Since the pore size of the porous wiping member is smaller than the diameter of the nozzle, the dust and the contaminants on the nozzle edges are scraped and trapped by these fine surface pores.

In this experiment, Rubycell (trade name) used as a material for the wiping member provides excellent advantages under the following conditions. The wiping member has excellent wiping characteristics in a thickness ranging from 0.5 mm to 3.0 mm, and preferably 1.0 mm to 2.0 mm; and a wiping load ranging from 10 g to 70 g, and preferably 10 to 40 g. The wiping load is adjusted according to the thickness of the wiping member and the thickness and HS(A) hardness of the back wiper. Also, excellent characteristics can be achieved at a wiping rate in a range of from 5 mm/sec. to 30 mm/sec., and preferably 5 mm/sec. to 20 mm/sec. The specifications of the wiping member and the back wiper of Example 5 are shown in Table 6.

TABLE 6

| | Wiping member | Back wiper | |
|---|---|---|---|
| Material | Rubycell ET (trade name) | HNBR rubber | Urethane rubber |
| HS(A) hardness | — | 55° | 75° |
| a: Height | 4.0 mm | 4.0 mm | 4.0 mm |
| b: Width | 12.0 mm | 12.0 mm | 12.0 mm |
| c: Contact width | 6.0 mm | 12.0 mm | 12.0 mm |
| d: Cut width | 3.0 mm | — | — |
| e: Cut height | 2.0 mm | — | — |
| f, f': Thickness | 1.5 mm | 0.5 mm | 0.5 mm |
| g: Free length | 4.0 mm | 4.0 mm | 4.0 mm |
| h: Penetration depth | 1.0 mm | 1.0 mm | 1.0 mm |
| Used head | Both heads | Solution head* | Ink head |

*Printability improving solution head

Figure 17A:
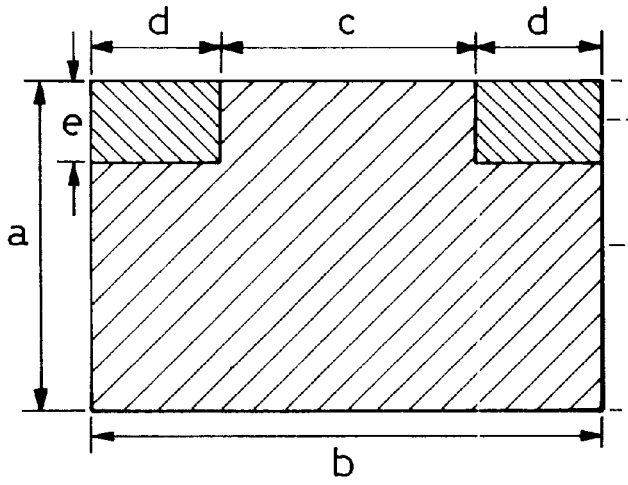
FIGS. 17A and 17B are a front elevation view and a side view, respectively, for illustrating a correlation of sizes of a cleaning member and a rear pad.
Figure 17B:
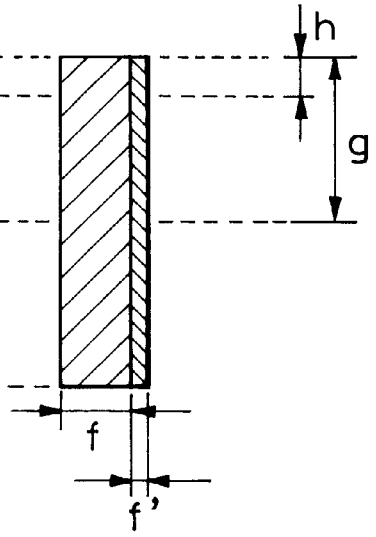

Symbols a to h in Table 6 represent the sizes of the wiping member and the back wiper as shown in FIGS. 17A and 17B.

According to the experimental results obtained by the present inventors, a drawback occurs, as described later, when the faces of the printability improving solution head and the ink heads in the ink jet recording apparatus, as shown in FIG. 8, are repeatedly cleaned with the wiping member and the back wiper. The same drawback is also observed in cleaners disclosed in Japanese Utility Model Laid-Open No. 61-5647 and Japanese Patent Laid-Open No. 4-338552, in which each cleaner is composed of a plate wiper and a rubbing member and wipes the indented nozzle face in the longitudinal direction.

When the nozzle face is repeatedly cleaned only by the rubbing member, contaminants such as coagulation and thickened ink formed by the reaction of the ink and the printability improving solution gradually deposit on the surface of the rubbing member, and the excessively deposited contaminants are retransferred to the ink jet head and squeezed into the nozzles, resulting in irregular ink discharge or clogging. Such a phenomenon is observed in the black color head on which maximum amounts of rebounded mist and printability improving solution deposit, but not observed in the diluted color ink head or the concentrated color ink head. The deposition of the coagulant and thickened ink and retransfer of the deposition onto the face are accelerated in proportion to the total quantity of the rebounded mist and the quantity of the printability improving solution contained in the mist. The rank of possibility of retransfer in the ink jet recording apparatus in accordance with the present invention is as follows:

black ink head>diluted color ink head>concentrated color ink head

Such a drawback is improved by the cleaning means shown in FIGS. 11 and 12 as described as follows. The black ink head 12*b* and the diluted color ink head 12*c* are cleaned by the wiping member 14*b*, the back wiper 14*e* and the smart blade 14*h*. In these two heads which are severely contaminated, the remnant region 17*e*, which is left after the wiping member 14*b* and the back wiper 14*e* pass across the face, is immediately cleaned by the succeeding smart blade 14*h*. The contamination of the wiping member 14*b* due to the remnant region 17*e* in the next wiping cycle therefore can be minimized. The concentrated color ink head 12*d* is cleaned only by the wiping member 14*c* and the back wiper 14*f*. The concentrated color ink head 12*d* is less contaminated compared to the above-mentioned two heads, and in particular, the black ink head, hence it does not require cleaning of the remnant region 17*e* by the smart blade 14*h*.

The above-mentioned drawback occurs as follows. When cleaning of the face is repeated by the above-mentioned rubbing means, the ink, as well as the printability improving solution, gradually adheres onto the rubbing means. When the rubbing means are severely contaminated by the ink, the coagulant of the reaction product of the ink and the printability improving solution covers the surface of the rubbing means. The rubbing means therefore loses the cleaning characteristics, on the contrary, retransfer of the contamination on the rubbing means to the face dominantly occurs.

The water-repellency on the face is completely lost as a result of repeated retransfer cycles, hence a large amount of printability improving solution is adhered onto the face after aspiration. The adhered printability improving solution causes unsatisfactory printing such as irregular ink discharge and clogging.

Such a drawback is improved in the recovery process of the face by the cleaning means shown in FIGS. 11 and 12. The improvement is described with reference to FIGS. 16A to 16F. The printability improving solution head 12*a* is cleaned by the wiping member 14*a*, the back wiper 14*d* and the smart power blade 14*g*, that is, after the wiping member 14*a* and the back wiper 14*d* clean the face, the succeeding smart power blade 14*g* immediately scrapes off the remnant region 17*g*, hence adhesion of the contaminant on the remnant region 17*g* to the wiping member 14*a* can be minimized. Further, if retransfer of the contaminant from the wiping member 14*a* gradually occurs, the retransferred contaminant on the face is scraped by the succeeding smart power blade 14*g*. The transferred contaminant is therefore not deposited on the face and the water repellency on the face can be maintained.

The grounds for use of the smart power blade 14*g*, not the smart blade 14*h*, is as follows. Since the remnant contaminant on the black ink head is composed of a mixture of the ink and the coagulant and thus can be more easily removed from the face than that on the printability improving solution head, the remnant region 17*g* can be satisfactorily cleaned by the smart blade 14*h*. On the other hand, the remnant contaminant on the printability improving solution head is composed of a mixture of the printability improving solution and the coagulant and thus barely removed from the face. The smart blade 14*h* having a low scraping ability cannot scrape off sufficiently the remnant region 17*g* and the contaminant transferred on the face. The smart power blade 14*g* has a high scraping ability and can effectively scrape off the remnant region 17*g* and the contaminant transferred on the face.

In order to maintain the cleaning characteristics of the wiping member for long periods, the wiping member is also cleaned after every cleaning process of the face in this example. The operation for cleaning the wiping member has been described with reference to FIGS. 13A to 13C and FIGS. 14A to 14C.

The moving speed of the blade holder is not limited to one speed and may be varied depending on the purpose of the cleaning. The wiping process immediately after the aspiration is performed in order to remove large droplets of the printability improving solution and the inks which are left on the head face when the aspiration cap is removed from the capping face of the head. If these large droplets are left on the head face, these will be immediately absorbed into the nozzles due to capillary action. As a result, the dust contained in the droplets and the coagulant due to the reaction of the printability improving solution and the ink will be trapped into the nozzles. Further, when three color nozzles for cyan, magenta and yellow inks are arranged onto a single face, a mixture of droplets composed of different color inks is trapped into the nozzles and color mixing occurs during printing.

In Example 5, therefore, in the cleaning immediately after the aspiration, the blade holder is moved at a speed higher than that of other cleaning steps in order to rapidly remove the large droplets. Although the preferable wiping speed ranges from 5 mm/sec. to 20 mm/sec. in this example, the highest speed, 20.0 mm/sec., is applied to this cleaning step immediately after the aspiration. In other cleaning steps, the moving speed of 10.0 mm/sec. is generally applied.

EXAMPLE 6

When the printability improving solution 12*h* is very difficult to permeate into the recording medium 1*i*, the quantity of the rebounded mist and the quantity of the printability improving solution in the mist very slightly vary between the ink head faces, and it is very difficult to remove the contaminants on these faces.

Figure 18A:
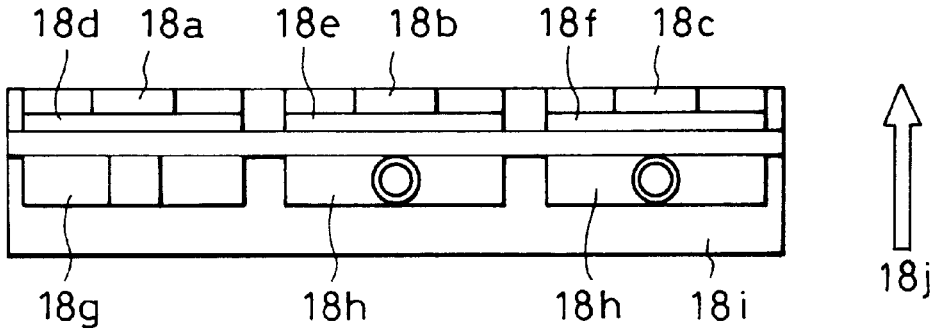
FIGS. 18A to 18C are a plan view, a rear elevation view and a front elevation view, respectively, for illustrating a configuration of a wiper unit of Embodiment 6.
Figure 18B:
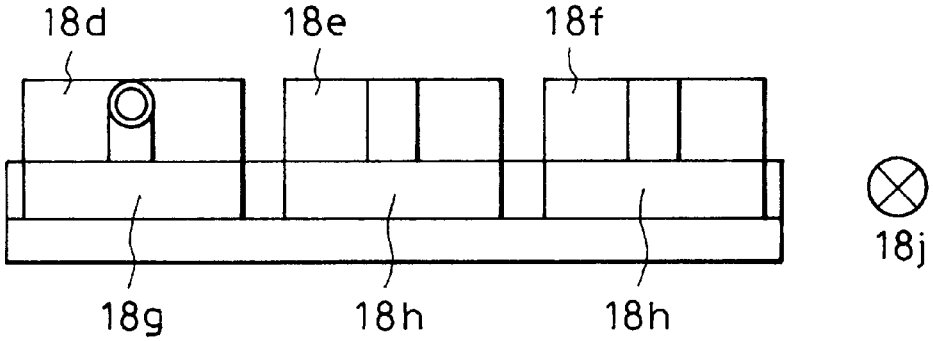
Figure 18C:
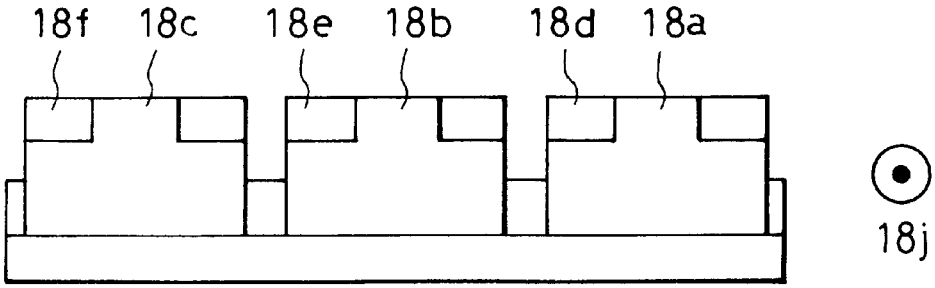

FIGS. 18A to 18C shows a configuration of a wiper unit in Example 6 in accordance with the present invention, which is suitable for removing the above-mentioned contaminants formed when the printability improving solution 12*h* is very difficult to permeate into the recording medium 1*i*.

Reference numerals 18*a*, 18*b* and 18*c* represent water-absorbable wiping members made of, for example, a porous material. Reference numerals 18*d*, 18*e* and 18*f* represent plate wiper blades made of an elastic material such as rubber, and also function as back wipers to adjust the contact load when the wiping members come into contact with the head faces. Reference numerals 18*g* and 18*h* represent hollow pillar cleaning members made of elastic materials such as rubber (hereinafter 18*g* is referred to as a smart power blade and 18*h* is referred to as a smart blade). Reference numeral 18*i* represents a blade holder for mounting these cleaning members.

These cleaning members clean the printability improving solution head and the color ink heads in the ink jet recording apparatus, as shown in FIG. 1, in accordance with the present invention in cooperation with movement of the blade holder in the direction of the arrow 18*j*. The wiping members, the back wipers, the smart power blade and the smart blades on the wiper unit have their own cleaning functions.

In FIGS. 18A to 18C, the wiping members, the back wipers, the smart power blade and the smart blades on the wiper unit have the same height from the base, that is, the same free length. The length, however, can be varied for every cleaning member in order to enhance the cleaning performance of each cleaning member.

Although each wiping member is overlapped with each back wiper in the drawings, these cleaning members may be bonded to each other.

The operation of the wiper unit in Example 6 is the same as that of the wiper unit in Example 5.

The wiper unit wipes to clean the faces of the printability improving solution head and the ink heads at a given speed and a given contact pressure immediately after the nozzles are aspirated and a given number of ink droplets are discharged.

The wiper cleaning unit of the recovery unit in FIGS. 18A to 18C has the same configuration and operation as that in FIGS. 13A to 13C.

The operation when cleaning the printability improving solution head and the color ink heads of the ink jet recording apparatus in accordance with the present invention shown in FIG. 8 by the cleaning means of Example 6 shown in FIGS. 18A to 18C is the same as that by the cleaning means of Example 5 shown in FIGS. 15A to 15C. The wiping member 18*a*, the back wiper 18*d* and the smart power blade 18*g* clean the printability improving solution head 12*a*, and the wiping member 18*b*, the back wiper 18*e* and the smart blade 18*h* clean the black ink head 12*b* and the diluted color ink head 12*c*. Further, the wiping member 18*c*, the back wiper 18*f* and the smart blade 18*h* clean the concentrated color ink head 12*d*.

When removing the contamination of the faces of the printability improving solution head and the color ink heads of the ink jet recording apparatus in accordance with the present invention shown in FIG. 8 by the cleaning means of Example 6 shown in FIGS. 18A to 18C, the rubbing means and the wiping means of Example 6 have the same functions and advantages of those of the cleaning means of Embodiment 1 (refer to FIGS. 16A to 16F).

Rubycell ET is used for the wiping member of Example 6. The configuration which is the same as in Example 5 shows excellent advantages. The moving speed of the blade holder is not limited to a single speed. A plurality of speeds may be used according to the purpose of cleaning. In Example 6, during the cleaning step immediately after the aspiration, the blade holder is moved at a speed higher than that during other cleaning steps in order to remove large droplets as rapidly as possible.

EXAMPLE 7

Figure 19A:
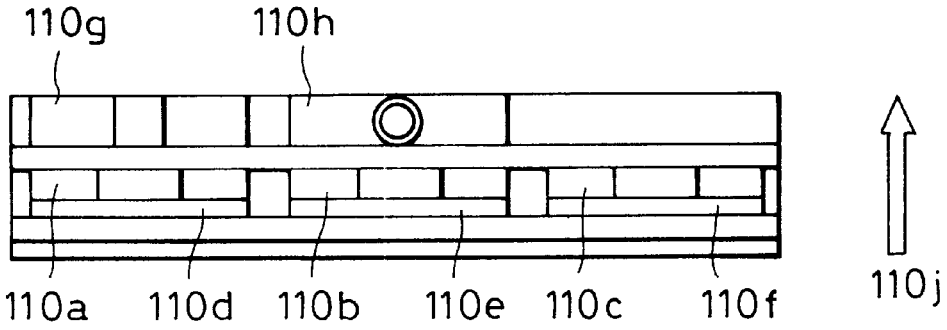
FIGS. 19A to 19C are a plan view, a rear elevation view and a front elevation view, respectively, for illustrating a configuration of a wiper unit of Embodiment 7 in accordance with the present invention.
Figure 19B:
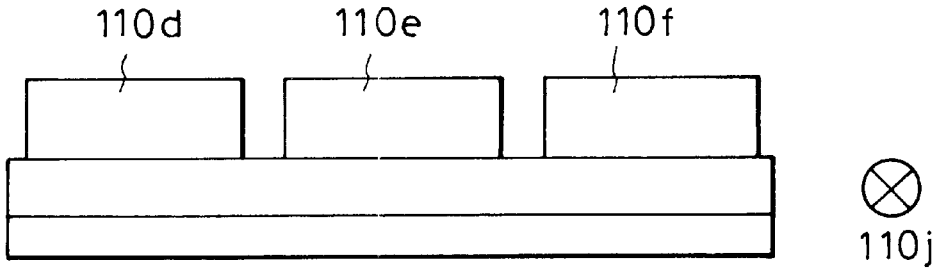
Figure 19C:
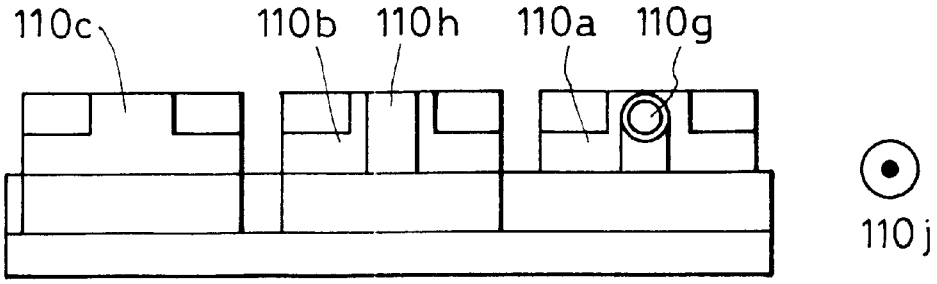

FIGS. 19A to 19C show the configuration of a wiper unit of Example 7 in accordance with the present invention. Reference numerals 110*a*, 110*b* and 110*c* represents rubbing means (hereinafter wiping member) made of water-absorbable materials such as porous material. Reference numerals represent plate wiper blades made of elastic materials such as rubber. Each plate wiper blade functions as a back wiper (hereinafter referred to as a back wiper) to adjust the contact load when the corresponding wiping member comes into contact with the head face. Reference numerals 110*g* and 110*h* represent hollow, pillar blade cleaning member made of elastic materials such as rubber, hereinafter 110*g* is referred to as a smart power blade and 110*h* is referred to as a smart blade. These cleaning members are mounted onto a blade holder 110*i*.

The blade holder moves in the direction of the arrow 110*j* to clean the printability improving solution head and the color ink heads of the ink jet recording apparatus in accordance with the present invention shown in FIG. 1. The wiping members, back wipers, smart blade and the smart power blade of the wiper unit have their own functions and advantages.

Although the heights (free lengths) of the wiping members, back wipers, smart blade and the smart power blade from the base are the same in FIGS. 19A to 19C, the heights (free lengths) may be different from each other in order to achieve excellent cleaning effects in response to individual cleaning members.

Although each wiping member is overlapped with each back wiper in the drawings, these cleaning members may be bonded to each other.

The operation of the wiper unit in Example 7 is the same as those of the wiper units in Example 5 and Example 6.

The wiper unit wipes to clean the faces of the printability improving solution head and the ink heads at a given speed and a given contact pressure immediately after the nozzles are aspirated and a given number of ink droplets are discharged.

The wiper cleaning unit for the wiper unit of Example 7 in accordance with the present invention has the same configuration and operation as those of Example 5 shown in FIGS. 13A to 13C and FIGS. 14A to 14C.

The operation when cleaning the printability improving solution head and the color ink heads of the ink jet recording apparatus in accordance with the present invention shown in FIG. 8 by the cleaning means of Example 7 shown in FIGS. 19A to 19C is the same as those by the cleaning means of Example 5 shown in FIGS. 15A to 15C and Example 6. The wiping member 110*a*, the back wiper 110*d* and the smart power blade 110*g* clean the printability improving solution head 12*a*, and the wiping member 110*b*, the back wiper 110*e* and the smart blade 110*h* clean the black ink head 12*b* and the diluted color ink head 12*c*. Further, the wiping member 110*c*, the back wiper 110*f* and the smart blade 110*h* clean the concentrated color ink head 12*d*.

The operation and advantages of the rubbing means and wiping means of the cleaning means of Example 7 will now be described in detail when the contamination on the faces of the printability improving solution head and the color ink heads of the ink jet recording apparatus shown in FIG. 8 is removed by the cleaning means shown in FIGS. 19A to 19C.

First, the removal of the contamination on the printability improving solution head will be described. The smart power blade of the cleaning means of Example 7 shown in FIGS. 19A to 19C wipes the face of the printability improving solution head and then the rubbing means including the wiping member and the back wiper cleans it.

The contaminant on the printability improving solution head is composed of a mixture of the printability improving solution and a coagulant and easily wets to the face, hence the forward wiping by the smart blade in the forward direction leaves a large amount of contaminant on the head to decrease water repellency on the face. The contaminant on the face is removed as much as possible by wiping the face with the smart power blade in the counter direction. Next, the residual contaminant on the face is removed by the rubbing means including the wiping member and the back wiper to recover the water repellency on the head. The coagulant left on the nozzles is also removed in some cases. The contaminant on the face can be completely removed by the smart power blade and the rubbing means, a stable printing procedure without irregular ink discharge and nozzle clogging is ensured.

Next, the removal of the contaminations on the black ink head and the diluted color ink head will be described. In the black ink head and the diluted color ink head, the faces are cleaned by the smart blade and then by the rubbing means including the wiping member and the back wiper of the cleaning means shown in FIGS. 19A to 19C. The contaminants on the black ink head and the diluted color ink heads are composed of mixtures of the inks and coagulants and are difficult to wet on the head faces. The contaminants can therefore be satisfactorily removed by the smart blade in the forward direction and a decrease in water repellency on the faces can be prevented. In Example 7, the contaminants on the head faces is removed by the smart blade by the forward direction wiping as much as possible, and then the residual contaminants are removed by the rubbing member including the wiping member and the back wiper to recover water repellency on the faces. Coagulants on the nozzles will be removed in some cases. The contaminants on the faces can be completely removed by the combination of the smart power blade and the rubbing means, a stable printing procedure without irregular ink discharge and nozzle clogging is ensured.

Rubycell ET is used for the wiping member of Example 7. The configuration which is the same as in Example 5 shows excellent advantages. The moving speed of the blade holder is not limited to a single speed. A plurality of speeds may be used according to the purpose of cleaning. In Example 7, during the cleaning step immediately after the aspiration, the blade holder is moved at a speed higher than that during other cleaning steps in order to remove large droplets as rapidly as possible.

EXAMPLE 8

When the printability improving solution 2*h* is very difficult to permeate into the recording medium 1*i*, the quantity of the rebounded mist and the quantity of the printability improving solution in the mist very slightly vary between the ink head faces, and it is very difficult to remove the contaminants on these faces.

Figure 20A:
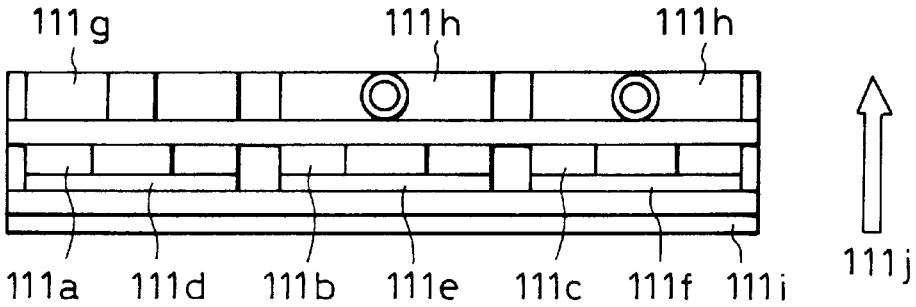
FIGS. 20A to 20C are a plan view, a rear elevation view and a front elevation view, respectively, for illustrating a configuration of a wiper unit of Embodiment 8 in accordance with the present invention.
Figure 20B:
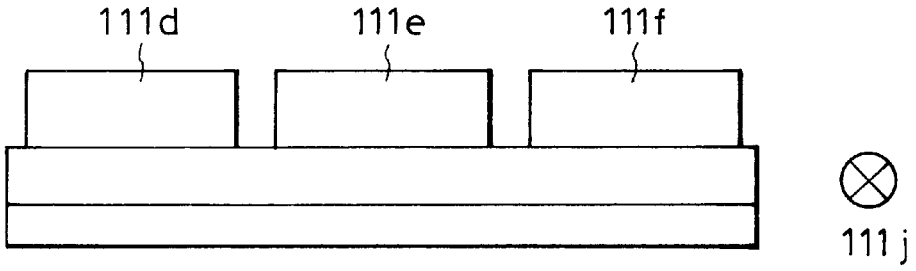
Figure 20C:
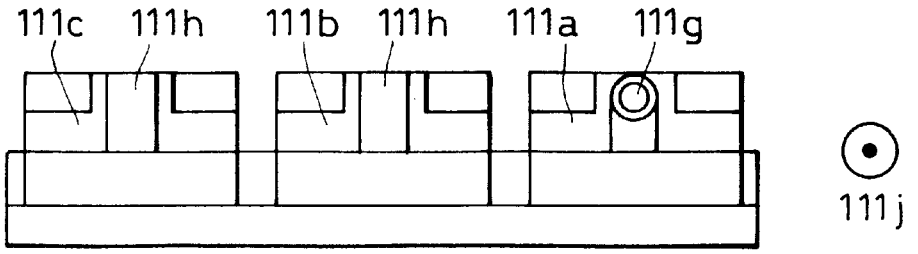

FIGS. 20A to 20C shows a configuration of a wiper unit in Example 8 in accordance with the present invention, which is suitable for removing the above-mentioned contaminants formed when the printability improving solution 2*h* is very difficult to permeate into the recording medium 1*i*.

Reference numerals 111*a*, 111*b* and 111*c* represent water-absorbable wiping members made of, for example, a porous material. Reference numerals 111*d*, 111*e* and 111*f* represent plate wiper blades made of an elastic material such as rubber, and also function as back wipers to adjust the contact load when the wiping members come into contact with the head faces. Reference numerals 111*g* and 111*h* represent hollow pillar cleaning members made of elastic materials such as rubber (hereinafter 111*g* is referred to as a smart power blade and 111*h* is referred to as a smart blade). Reference numeral 111*i* represents a blade holder for mounting these cleaning members.

These cleaning members clean the printability improving solution head and the color ink heads in the ink jet recording apparatus, as shown in FIG. 8, in accordance with the present invention in cooperation with movement of the blade holder in the direction of the arrow 111*j*. The wiping members, the back wipers, the smart power blade and the smart blades on the wiper unit have their own cleaning functions.

In FIGS. 20A to 20C, the wiping members, the back wipers, the smart power blade and the smart blades on the wiper unit have the same height from the base, that is, the same free length. The length, however, can be varied every cleaning member in order to enhance the cleaning performance of each cleaning member.

Although each wiping member is overlapped with each back wiper in the drawings, these cleaning members may be bonded to each other.

The operation of the wiper unit in Example 8 is the same as that of the wiper units in Examples 5 to 7.

The wiper unit wipes to clean the faces of the printability improving solution head and the ink heads at a given speed and a given contact pressure immediately after the nozzles are aspirated and a given number of ink droplets are discharged.

The wiper cleaning unit of the recovery unit of Example 8 has the same configuration and operation as that of Example 6 in FIGS. 14A to 14C.

The operation when cleaning the printability improving solution head and the color ink heads of the ink jet recording apparatus in accordance with the present invention shown in FIG. 8 by the cleaning means of Example 8 shown in FIGS. 20A to 20C is the same as that by the cleaning means of Examples 5 to 6 shown in FIGS. 15A to 15C. The wiping member 111*a*, the back wiper 111*d* and the smart power blade 111*g* clean the printability improving solution head 12*a*, and the wiping member 111*b*, the back wiper 111*e* and the smart blade 111*h* clean the black ink head 12*b* and the diluted color ink head 12*c*. Further, the wiping member 111*c*, the back wiper 111*f* and the smart blade 111*h* clean the concentrated color ink head 12*d*.

When removing the contamination of the faces of the printability improving solution head and the color ink heads of the ink jet recording apparatus in accordance with the present invention shown in FIG. 8 by the cleaning means of Example 8 shown in FIGS. 20A to 20C, the rubbing means and the wiping means of Example 8 have the same functions and advantages of those of the cleaning means of Example 5.

Rubycell ET is used for the wiping member of Example 8. The configuration which is the same as in Example 5 shows excellent advantages. The moving speed of the blade holder is not limited to a single speed. A plurality of speeds may be used according to the purpose of cleaning. In Example 8, during the cleaning step immediately after the aspiration, the blade holder is moved at a speed higher than that during other cleaning steps in order to remove large droplets as rapidly as possible.

EXAMPLE 9

Figure 21A:
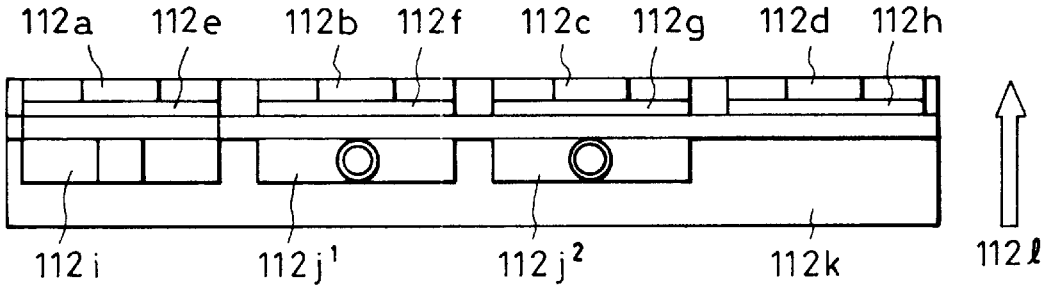
FIGS. 21A to 21C are a plan view, a rear elevation view and a front elevation view, respectively, for illustrating a configuration of a wiper unit of Embodiment 9 in accordance with the present invention.
Figure 21B:
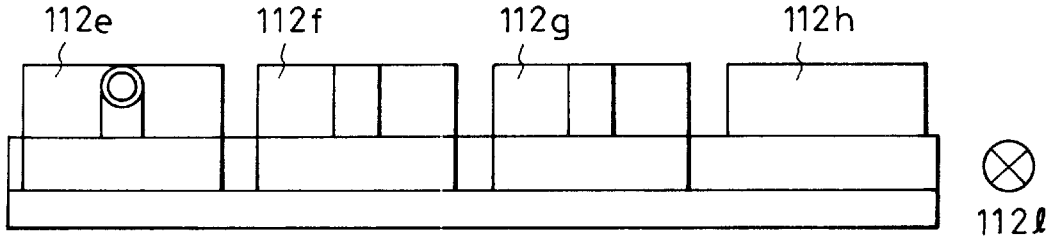
Figure 21C:
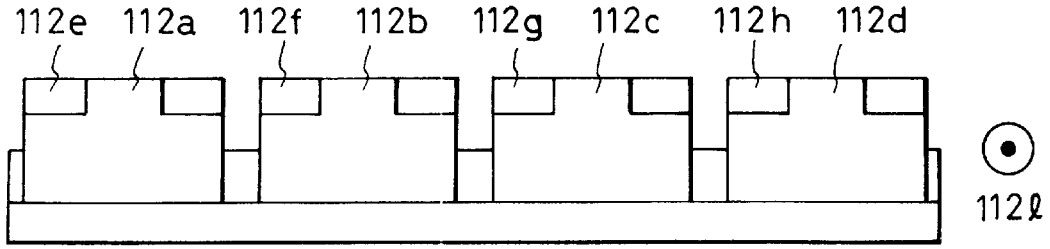

FIGS. 21A to 21C show the configuration of a wiper unit of Example 9 in accordance with the present invention, wherein four rubbing members are used for four types of heads, hence each rubbing member cleans only the corresponding head, whereas one rubbing means cleans two types of heads in Examples 5 to 8 since three rubbing means are used for four types of heads.

Reference numerals 112*a*, 112*b* and 112*c* represent water-absorbable rubbing members (hereinafter referred to as a wiping member) made of, for example, a porous material. Reference numerals 112*d*, 112*e* and 112*f* represent plate wiper blades made of an elastic material such as rubber, and also function as back wipers to adjust the contact load when the wiping members come into contact with the head faces. Reference numerals 112*g* and 112*h* represent hollow pillar cleaning members made of elastic materials such as rubber (hereinafter 112*g* is referred to as a smart power blade and 112*h* is referred to as a smart blade). Reference numeral 112*k* represents a blade holder for mounting these cleaning members.

These cleaning members clean the printability improving solution head and the color ink heads in the ink jet recording apparatus, as shown in FIG. 8, in accordance with the present invention in cooperation with movement of the blade holder in the direction of the arrow 112*i*. The wiping members, the back wipers, the smart power blade and the smart blades on the wiper unit have their own cleaning functions.

In FIGS. 21A to 21C, the wiping members, the back wipers, the smart power blade and the smart blades on the wiper unit have the same height from the base, that is, the same free length. The length, however, can be varied for every cleaning member in order to enhance the cleaning performance of each cleaning member.

Although each wiping member is overlapped with each back wiper in the drawings, these cleaning members may be bonded to each other.

The function performed by the combination of the wiping member 4*b*, back wiper 14*e* and smart blade 14*h* in Example 5 is performed by a combination of the wiping member 112*b*, back wiper 112*g* and smart blade 112*j*1 and by a combination of the wiping member 112*c*, back wiper 112*g* and smart blade 112*j*2.

Accordingly, the contaminations on the faces can be effectively removed by, (1) adding the smart blade downstream of the wiping member 112 and the back wiper 112*h* in the wiping direction, (2) exchanging the position of the combination of the wiping member and the back wiper for the position of the smart blade or the smart power blade, or (3) using the smart power blade instead of the smart blade.

The operation of the wiper unit in Example 9 is the same as that of the wiper units in Examples 5 to 8.

The wiper unit wipes to clean the faces of the printability improving solution head and the ink heads at a given speed and a given contact pressure immediately after the nozzles are aspirated and a given number of ink droplets are discharged.

The wiper cleaning unit of the recovery unit of Example 9 has the same configuration and operation as the wiper cleaning units of the recovery units in FIGS. 13A to 13C and FIGS. 14A to 14C.

The operation will now be described with reference to FIGS. 22A to 22C when the printability improving solution head and the color ink heads of the ink jet recording apparatus in accordance with the present invention shown in FIG. 8 is cleaned by the cleaning means shown in FIGS. 21A to 21C.

Figure 22A:
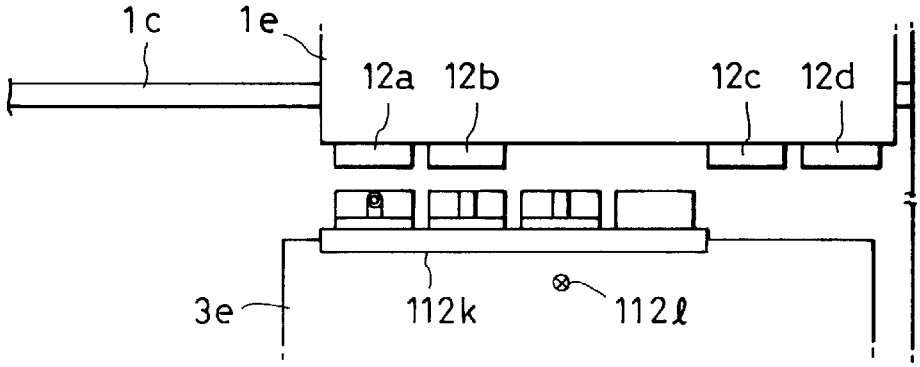
FIGS. 22A to 22C are front views for illustrating an operation for cleaning the head face by the wiper unit of Embodiment 9.

After a given number of ink droplets are discharged from the printability improving solution head 12*a* or the black ink head 12*b*, the carriage 2*e* returns from the recording zone on the left in FIG. 8 to the home position and stops at a position which permits wiping as shown in FIG. 22A. Also, the carriage 2*e* stops at this position immediately after the aspiration process is completed. The blade holder 112*k* moves in the direction of the arrow 112*l* at a given speed and cleans the faces of the printability improving solution head 12*a* and the black ink head 12*b*.

Figure 22B:
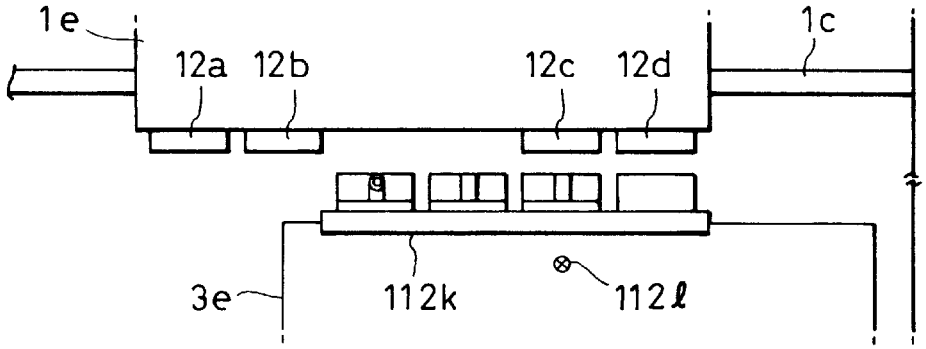

Also, after a given number of ink droplets are discharged from the diluted color ink head 12*c* or the concentrated color ink head 12*d*, or immediately after the aspiration process is completed, the carriage 12*e* moves to a position shown in FIG. 22B and stops there. The blade holder 112*k* moves in the direction of the arrow 112*l* at a given speed and cleans the faces of the diluted color ink head 12*c* and the concentrated color ink head 12*d*. That is, the wiping member 112*a*, the back wiper 112*e* and the smart power blade 112*i* clean the printability improving solution head 12*a*, and the wiping member 112*b*, the back wiper 112*f* and the smart blade 112*j*1 clean the black ink head 12*b*. Further, the wiping member 112*c*, the back wiper 112*g* and the smart blade 112*j*2 clean the diluted color ink head 12*c*, and the wiping member 112*d* and the back wiper 112*h* clean the concentrated color ink head 12*d*.

Figure 22C:
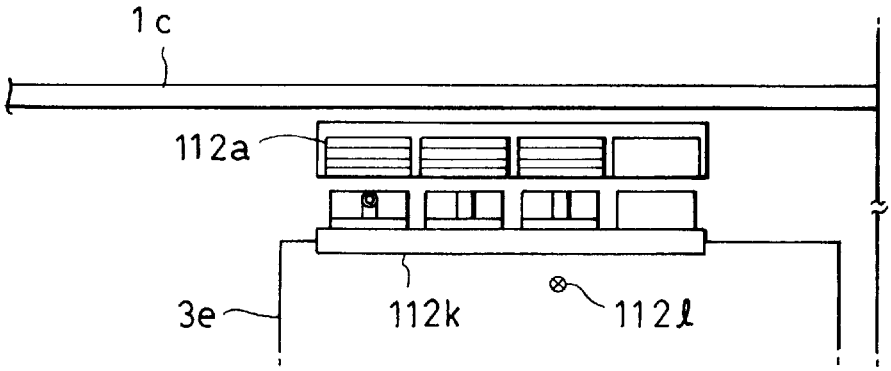

As shown in FIG. 22C, after the blade holder 112*k* cleans the faces of these heads, it dashes onto the cleaner unit 113*a* for the wiper unit to clean the wiping members 112*a*, 112*b*, 112*c* and 112*d*, the back wipers 112*e*, 112*f*, 112*g* and 112*h*, the smart power blade 112*i* and the smart blades 112*j*1 and 112*j*2 (refer to FIGS. 13A to 13C and FIGS. 14A to 14C).

Figure 23:
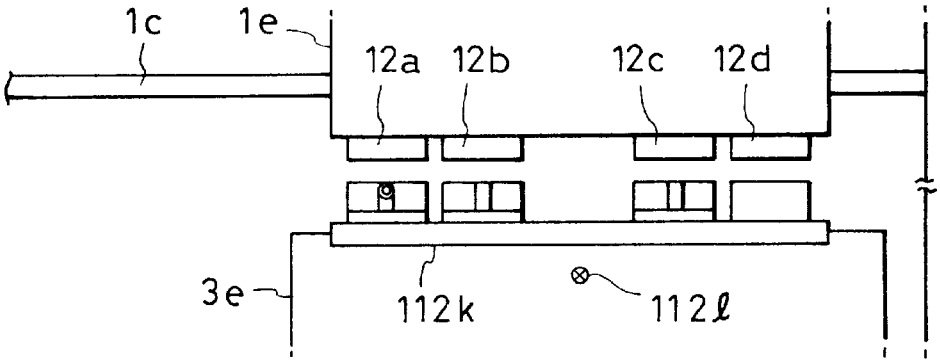
FIG. 23 is a front view for illustrating an operation for cleaning the head face by a modified wiper unit of Embodiment 9.

The positions of the cleaning members of the wiper unit of Example 9 are adjusted so as to face their respective heads to clean simultaneously four types of heads by only one scanning process as shown in FIG. 23.

After a given number of ink droplets are discharged from the printability improving solution head 12*a*, the black ink head 12*b* or the diluted color ink head 12*c*, the carriage 2*e* returns from the recording zone on the left in FIG. 8 to the home position and stops at a position R which permits wiping as shown in FIG. 23. Also, the carriage 2*e* stops at this position immediately after the aspiration process is completed. The blade holder 112*k* moves in the direction of the arrow 112*l* at a given speed and cleans the faces of the printability improving solution head 12*a*, the black ink head 12*b*, the diluted color ink head 12*c* and the concentrated color ink head 2*d*.

That is, the wiping member 112*a*, the back wiper 112*e* and the smart power blade 112*i* clean the printability improving solution head 12*a*, and the wiping member 112*b*, the back wiper 112*f* and the smart blade 112*j*1 clean the black ink head 12*b*. Further, the wiping member 112*c*, the back wiper 112*g* and the smart blade 112*j*2 clean the diluted color ink head 12*c*, and the wiping member 112*d* and the back wiper 112*h* clean the concentrated color ink head 12*d*.

In the cleaning process described above, the rubbing means and the wiping means of other cleaning means have substantially the same functions and advantages as the rubbing means and the wiping means of the cleaning means in Examples 5 to 8.

Rubycell ET is used for the wiping member of Example 9. The configuration which is the same as in Example 5 shows excellent advantages. The moving speed of the blade holder is not limited to a single speed. A plurality of speeds may be used according to the purpose of cleaning. In Example 9, during the cleaning step immediately after the aspiration, the blade holder is moved at a speed higher than that during other cleaning steps in order to remove large droplets as rapidly as possible.

EXAMPLE 10

Figure 24A:
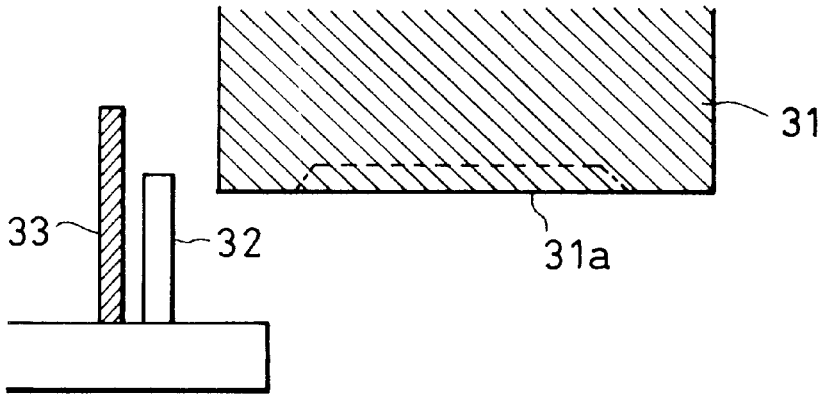
FIGS. 24A to 24C are schematic views illustrating a cleaning mechanism of Embodiment 10 in accordance with the present invention.
Figure 24B:
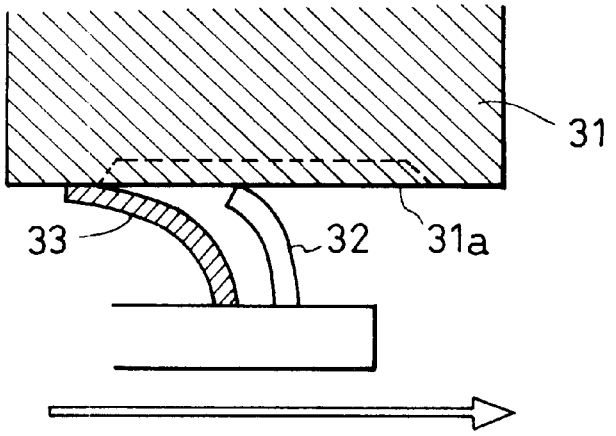
Figure 24C:
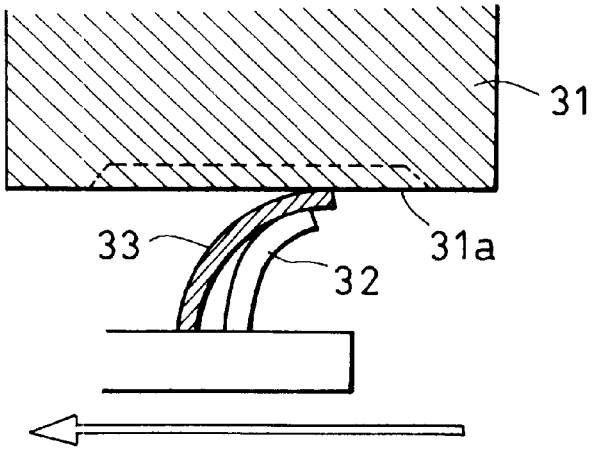

FIGS. 24A to 24C are schematic views of a cleaner of Example 10 in accordance with the present invention. FIG. 24A shows a standby state, FIG. 24B shows a cleaning operation by a wiper, and FIG. 24C shows a cleaning operation on a nozzle face by a wiping member. In FIG. 24A, an ink jet head 31 stops at a stop position. A wiper 32 and a wiping member 33 must be made of materials which are not deteriorated or modified by inks. Examples of suitable wiper materials include urethane rubbers, silicone rubbers and HNBRs. Examples of suitable wiping member 33 include porous materials having high ink resistance and high water absorption, such as Rubycell Clean (trade name, made by Toyo Polymer Co., Ltd.) and nonwoven fabric using fine fibers.

Figure 25:
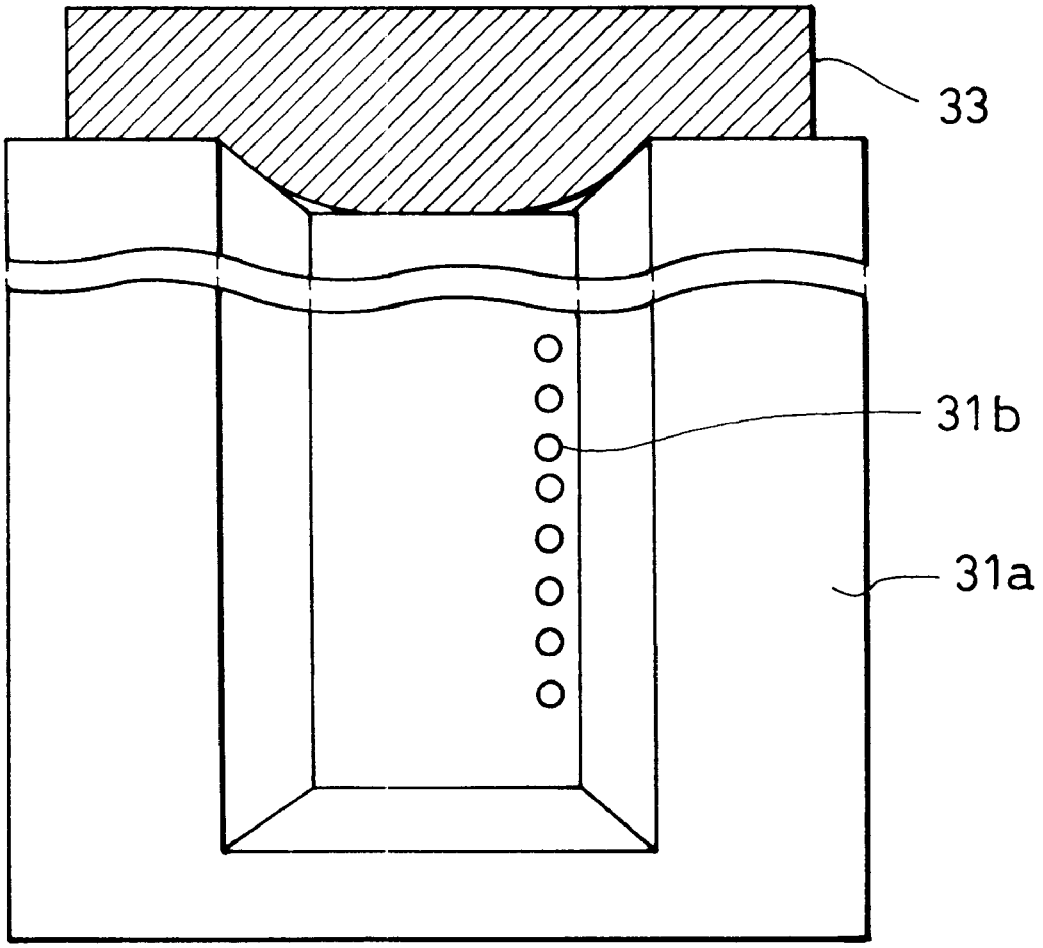
FIG. 25 is a schematic view illustrating wiping of an indented face by a conventional cleaning member.

According to the experiments, cleaning by the wiper must be frequently performed in general use conditions, and the contact load of the wiper on the ink jet recording head for ensuring satisfactory advantages is 5 g/cm or more. On the other hand, the wiping member 33 requires a contact load in a range of from 50 g/cm to 100 g/cm and an overall load of 100 g to 300 g to reduce damage of the head, although the frequency of the wiping operation of the wiping member 33 is very low. In prior art, a thick wiping member is deeply penetrated into the nozzle face to achieve a large contact load. Such a thick wiping member does not follow the indented nozzle face. FIG. 25 shows a plan view of a head nozzle which is cleaned by the prior art wiping member 33. The some portions, that is, corners of the indented nozzle face do not come into contact with the wiping member 33.

In the cleaner in accordance with the present invention, the wiper 32 comes into contact with the nozzle face 31*a* of the ink jet recording head due to the contact load of the wiper itself as shown in FIG. 24B, whereas the wiping member 33 comes into contact with the nozzle face 31*a* while being elastically supported by the wiper 32 having a relatively high rigidity from the rear surface. The wiping member 33 therefore can come into contact with the nozzle face with a contact load higher than that of the wiping member 33. For example, when the wiper is made of a urethane rubber having a thickness of 1 mm, an HS(A) hardness of 75°, and a free length of 8 mm and the wiping member 33 is made of Rubycell Clean (trade name, made by Toyo Polymer Co., Ltd.) having a thickness of 1.5 mm and a free length of 10 mm, the wiper 32 has a contact load of approximately 10 g/cm during wiping, and the wiping member 33 has a contact load of approximately 80 g/cm during back wiping. The free lengths of the wiper 32 and the wiping member 33 and the distance between them can be determined so that the wiper 32 is covered with the wiping member 33 during the back wiping. The preferable thickness of the wiper 32 ranges from 0.5 mm to 1.5 mm and the preferable thickness of the wiping member 33 ranges from 1 to 5 mm. The wiping member 33 therefore is slightly thicker than the wiper 32.

The prior art wiping member requires two characteristics, that is, control of the contact pressure and wiping performance. In the present invention, the wiping member 33 shares the contact pressure with the wiper 32. Since the contact pressure of the wiping member 33 can be adjusted over a wide range by the wiper 32, the wiping member 33 can be selected from a wide range of from materials and shapes.

A set of wiper and wiping member is used for cleaning the nozzle head in Example 10. A combination of another wiper for controlling the contact pressure and the wiping member may be provided to use the wiper only in the wiping step by the wiping member. Since the second wiper is not used when the first wiper is used, the combination is suitable for use in severer conditions.

In the cases of the wiping processes as shown in FIGS. 24*b* and 24C, wiping by means of the edges of the wiper 32 and the wiping member 33 enables more effective cleaning of the nozzle faces compared to wiping by their faces, because the edge contact to the nozzle faces form a larger contact pressure and the residual ink after wiping can be reduced. The edge wiping can be achieved by adjusting the lengths, free lengths and penetration depths of the wiper and the wiping member.

EXAMPLE 11

The cleaning of the ink jet recording head is performed by moving the cleaner(s) in Example 10. In Example 11, a cleaner is arranged so as not to move and an ink jet recording head moves to be cleaned.

FIGS. 26A to 26D are schematic views of an ink jet recording apparatus in accordance with the present invention, in which a cleaner is arranged at a position in which an ink jet recording head can reach, and the recording head moves so as to come into contact with the cleaner to clean the nozzle face of the recording head. In FIGS. 26A to 26D, reference numeral 21 represents a guide shaft, reference numeral 22 represents a printing zone, and reference numeral 23 represents a cleaner including a wiper 32 and a wiping member 33.

Figure 26A:
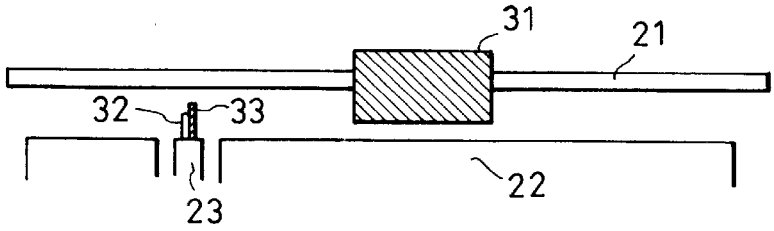
FIGS. 26A to 26D are schematic views illustrating a cleaning mechanism of Embodiment 11 in accordance with the present invention.
Figure 26B:
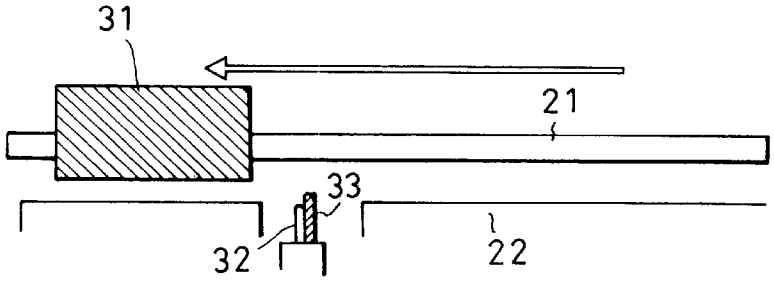

In FIG. 26A, the ink jet recording head is printing in the printing zone. When printing is not performed during a given time, the ink jet recording head returns to the standby position. In FIG. 26B, the ink jet recording head is passing through the front of the cleaner including the wiper 32 and the wiping member 33 arranged between the printing zone and the standby position to return the standby position. The cleaner can be arranged at an appropriate position in which the ink jet recording head can reach.

Figure 26C:
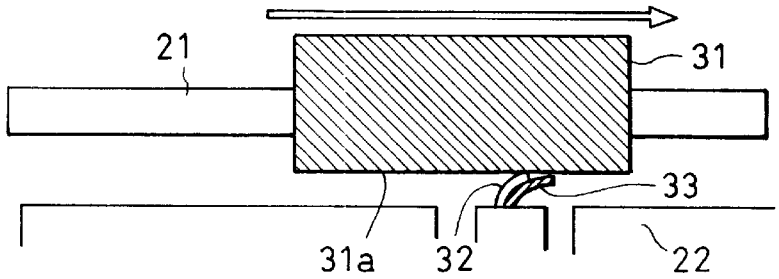

FIG. 26C shows the wiping operation by the wiper. When the ink jet recording head moves from the standby position to the printing zone, it passes thorough the front of the protruded cleaner. The nozzle face 31*a* of the recording head is wiped by the wiper 32 of the cleaner.

Figure 26D:
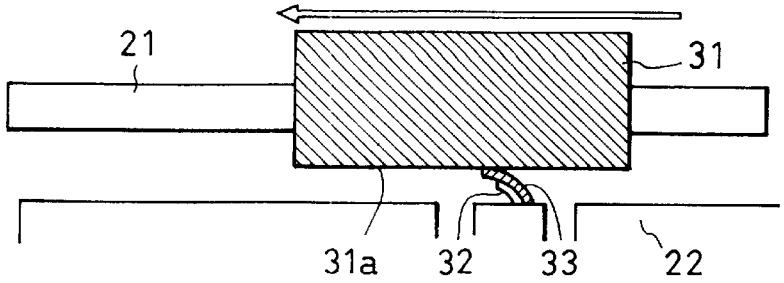

FIG. 26D shows the cleaning operation by the wiping member. After the ink jet recording head moves from the standby position to the printing zone, the cleaner moves to a position in which the cleaner interferes with the ink jet recording head and the ink jet recording head moves from the printing zone to the standby position. By the movement of the recording head, the nozzle face 31*a* of the recording head is wiped by the wiping member 33.

The wiper 32 is arranged at the standby position side compared to the wiping member 33 so that the ink adhered onto the wiper during the wiping process spatters onto the standby position side when the wiper is released from bending. If the wiper 32 is arranged at the printing zone side, the ink adhered onto the wiper spatters onto and contaminates the recording zone.

The forward wiping speed in FIG. 26C and the reverse wiping speed in FIG. 26D may be the same or different from each other. For example, satisfactory results are obtained at a forward wiping speed of 80 mm/sec. and a reverse wiping speed of 50 mm/sec.

According to experiments, the necessity of the reverse wiping is remarkably less than that of the forward wiping. The printing efficiency can therefore be improved by decreasing the time for forward wiping which is often performed. When the wiper is placed at the standby position, the printing efficiency can be improved due to a decreased moving time of the wiper after wiping.

In Example 11, the wiping operation includes the forward wiping and the reverse wiping. Any combinations of the wiping operation and other means, for example, aspiration and preliminary discharge may also be used in various orders and frequencies in order to improve the cleaning efficiency.

Figure 27:
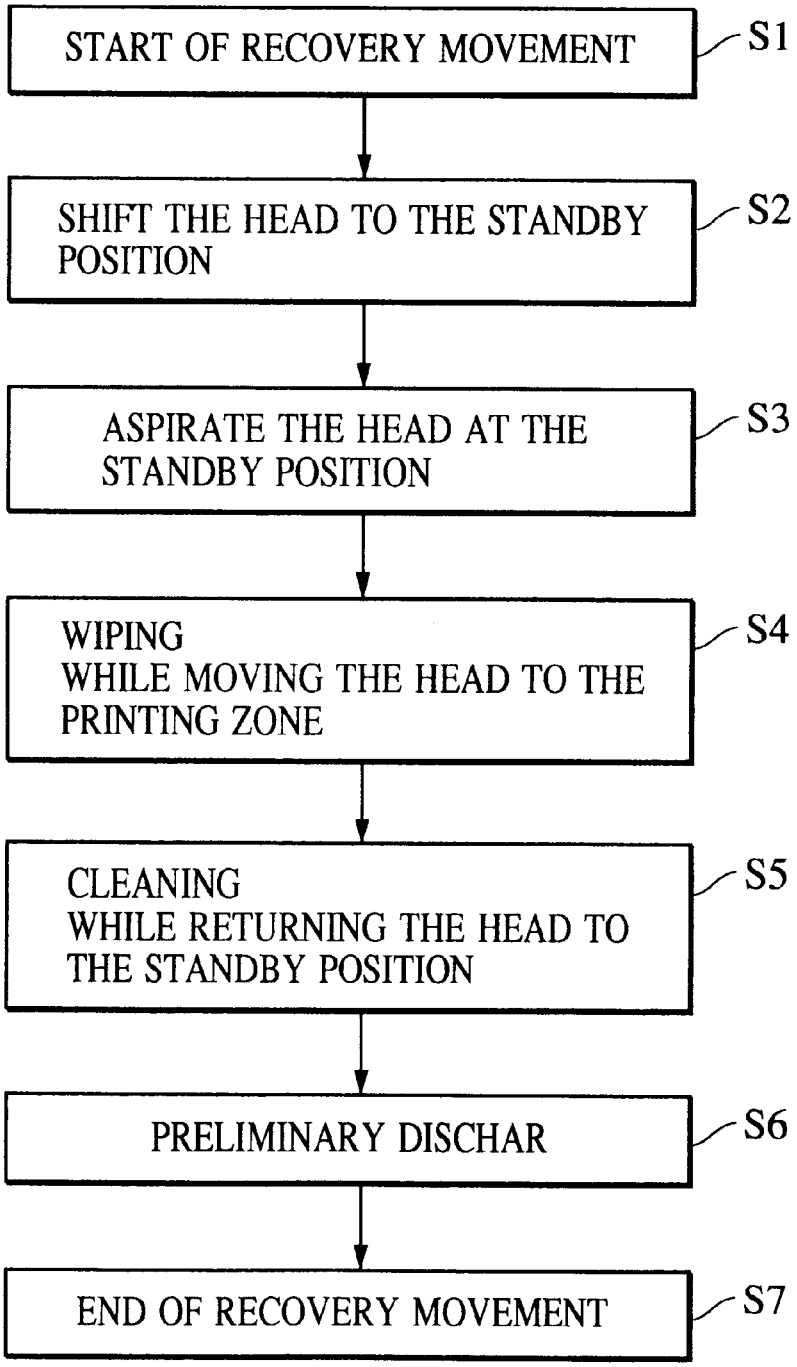
FIG. 27 is a flow chart of a recovery sequence in accordance with the present invention.

FIG. 27 is a flow chart of a recovery sequence including the above-mentioned aspiration and preliminary discharge. First, the recovery operation starts (Step 1). Next, the ink jet recording head 31 moves the standby position as shown in FIG. 26B (Step 2), in which the cleaner is shifted to the lower inactive position. After the head is aspirated at the standby position (Step 3), the ink jet recording head 31 moves to the printing zone (recording zone) to wipe the recording head with the wiper 32 (Step 4), in which the cleaner is shift to the operation position. The ink jet recording head 31 moves to the standby position to clean the recording head by the wiping member 33 as shown in FIG. 26D (Step 5). After the preliminary discharge (Step 6), the recovery operation is completed (Step 7).

EXAMPLE 12

Figure 28A:
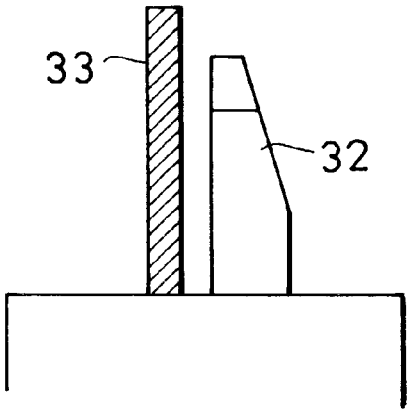
FIGS. 28A to 28D are schematic views illustrating a cleaning mechanism of Embodiment 12 in accordance with the present invention.
Figure 28B:
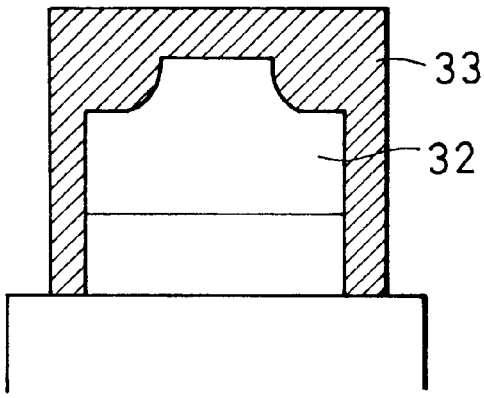
Figure 28C:
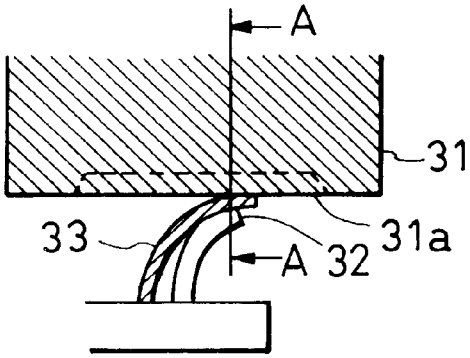
Figure 28D:
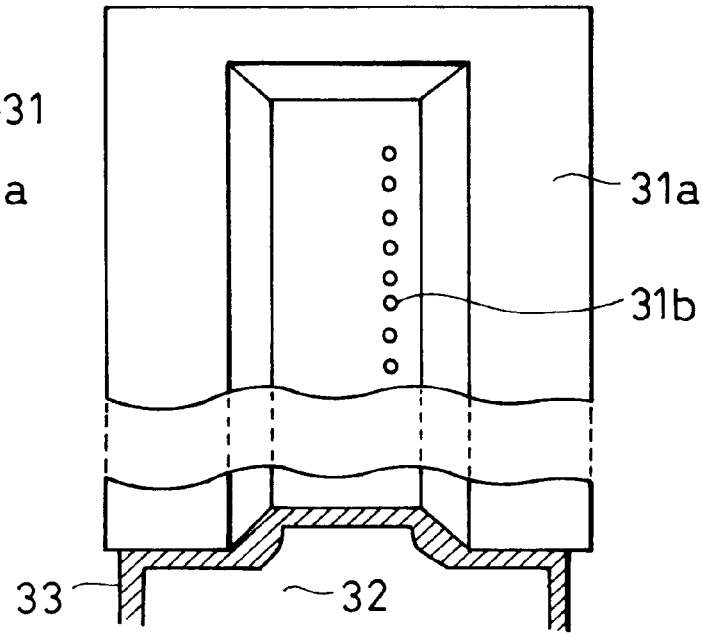

In Example 12, the shape of the wiper is varied. FIGS. 28A to 28D show an ink jet recording apparatus provided with such an wiper. FIGS. 28A and 28B are a side view and a front view from the wiper side, respectively, of the ink jet recording apparatus. Since the width of the front end of the wiper is reduced relative to the width of the bottom, that is, since the front end of the wiper is formed to supplement the indented section of the nozzle face with the front end, the nozzle face can be wiped with a larger contact pressure, and the wiping member 33 can come into close contact with the corners of the indented nozzle face 31*a* on the ink jet recording head 31, as shown in FIGS. 28C and 28D, wherein FIG. 28D is a sectional view taken from section A—A of FIG. 28C.

The contact pressure can also be increased by increasing the thickness of the bottom of the wiper 32. A desirable contact pressure having a given free length, a given width and a given penetration depth is determined by adjusting the thickness of the bottom. Although a symmetrical wiper is described, the shape is not limited to the symmetric. Although the tapered wiper from the bottom to the front end is described, the thickness reduction of the front end is not limited to the taper.

The present invention is not limited to the above-mentioned Examples and can also include any combinations between the Examples.

The present invention is particularly effective for thermal recording heads and thermal recording devices provided with thermal energy generating means, for example, electrothermal converters and laser light beams, which heats to discharge the inks in the nozzles. The thermal recording heads and devices can achieve high density and high definition recording.

Figure 29:
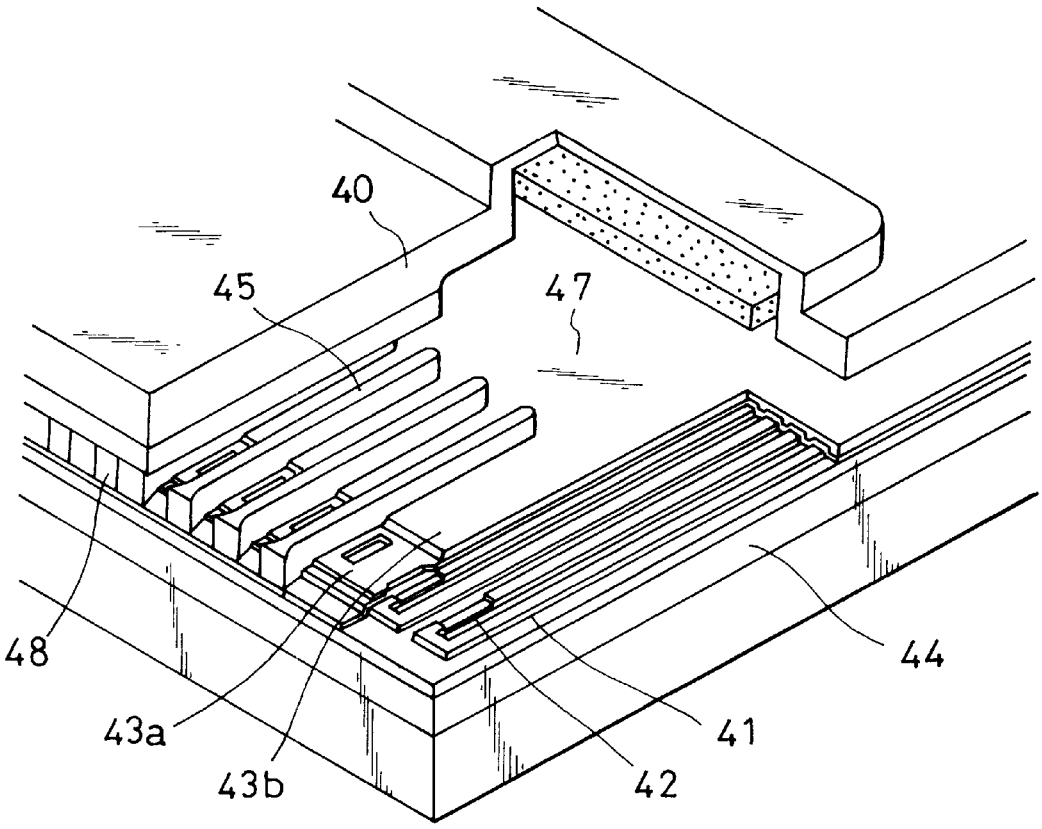
FIG. 29 is a schematic perspective view of a liquid discharging head using thermal energy in accordance with the present invention.
Figure 30A:
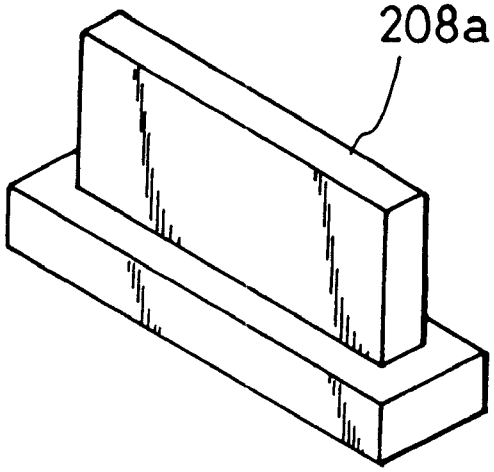
FIG. 30A PRIOR ART
FIGS. 30A and 30B are schematic views of a conventional cleaner.
Figure 30B:
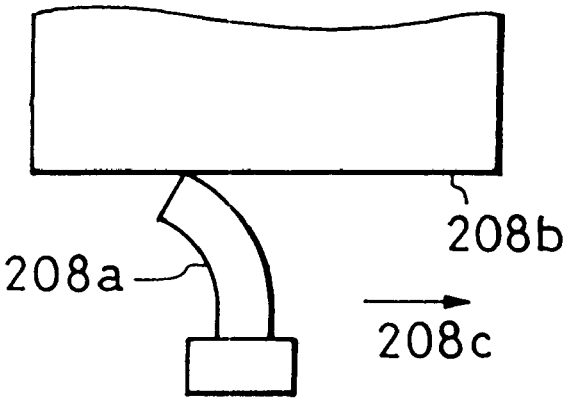
FIG. 30B PRIOR ART
Figure 31A:
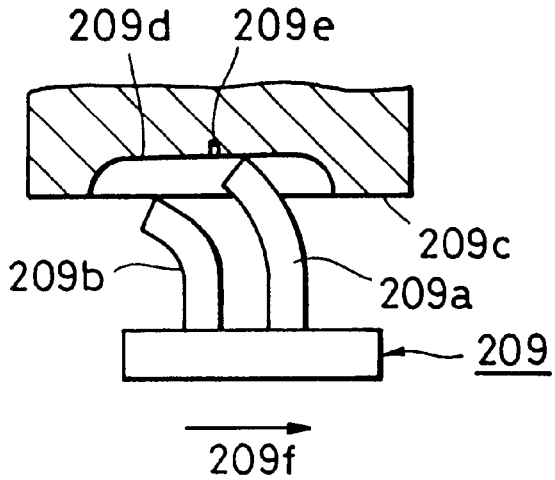
FIG. 31A PRIOR ART
FIGS. 31A and 31*b* are schematic views of another conventional cleaner.
Figure 31B:
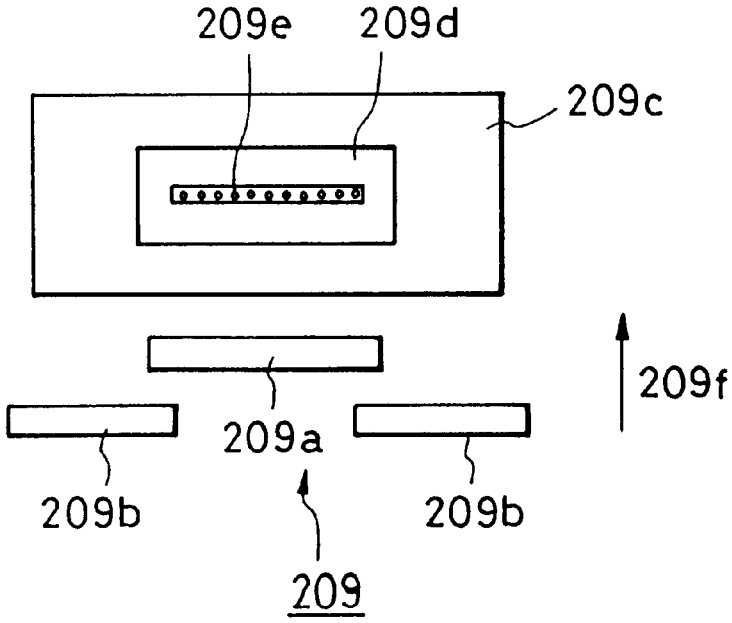
FIG. 31B PRIOR ART
Figure 32A:
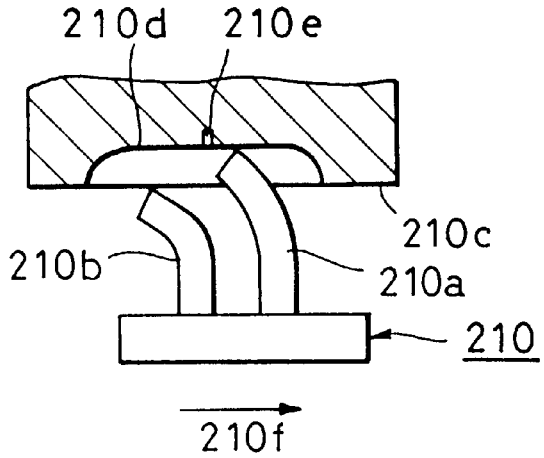
FIG. 32A PRIOR ART
FIGS. 32A and 32B are schematic views of a further conventional cleaner.
Figure 32B:
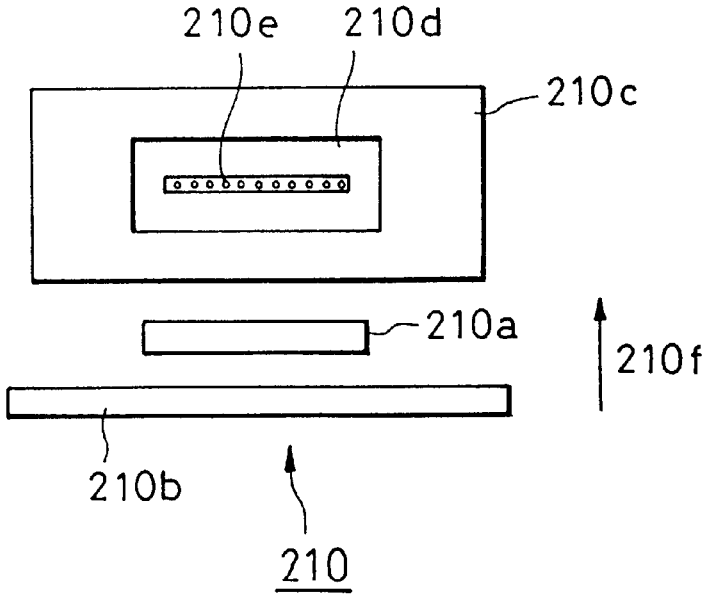
FIG. 32B PRIOR ART
Figure 33:
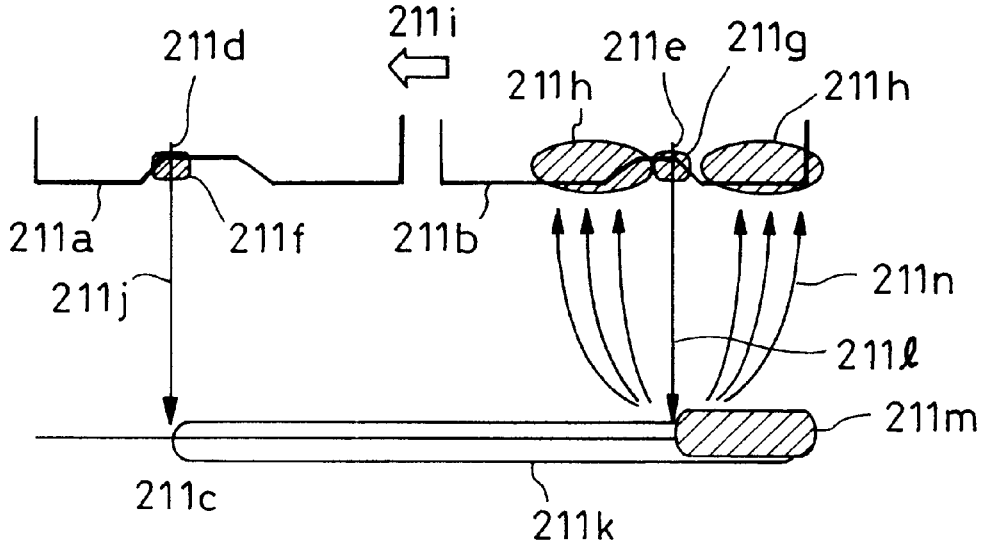
FIG. 33 is a front view illustrating a system using an ink and a printability improving solution insolubilizing a dye in the ink and rebound of mists of the ink and the like in the system.
Figure 34:
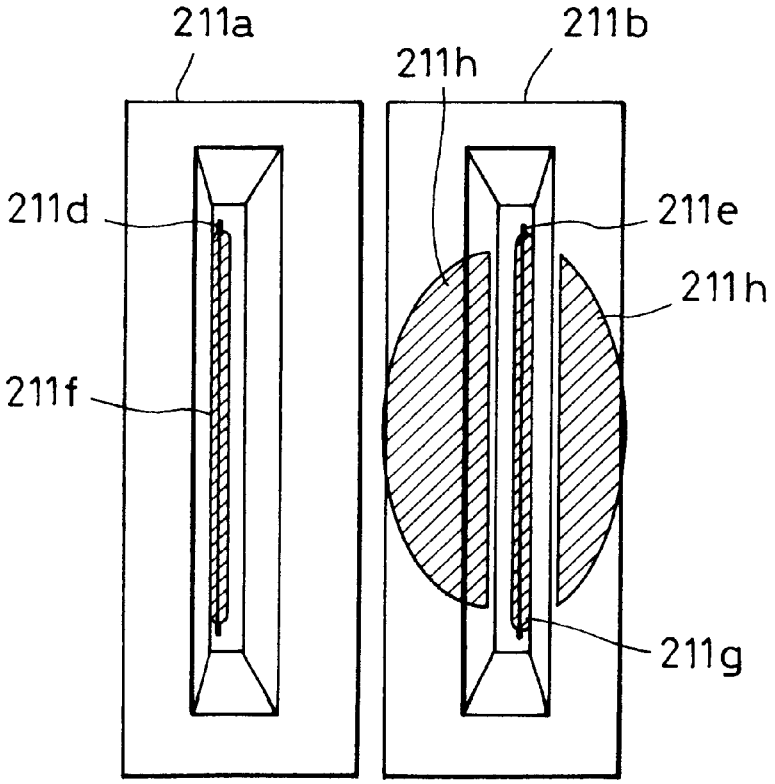
FIG. 34 is a plan view of the mist region of the ink and the like deposited on the head shown in FIG. 33 from the recording medium side.
Figure 35A:
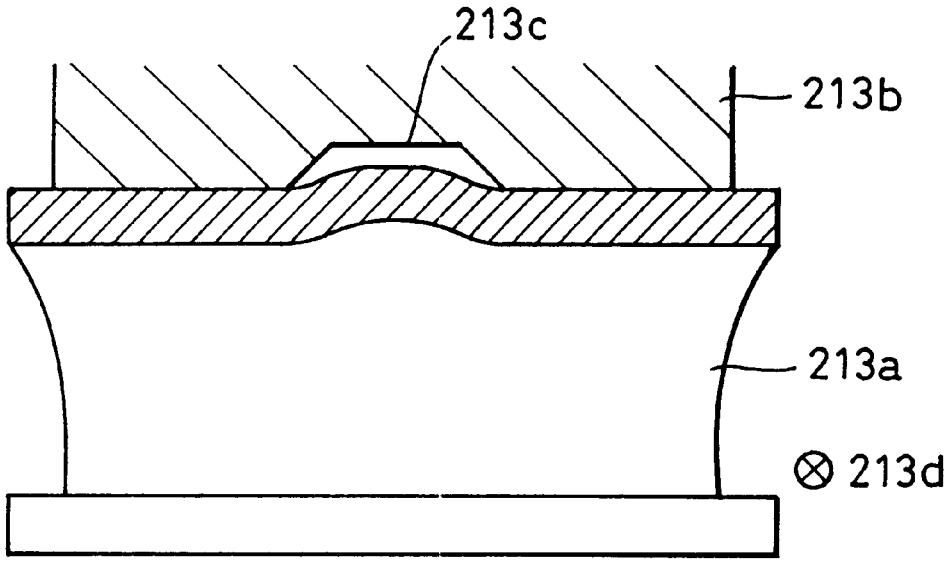
FIG. 35A PRIOR ART
FIGS. 35A and 35B are outlined front views illustrating wiping of a long indented portion by a conventional cleaner.
Figure 35B:
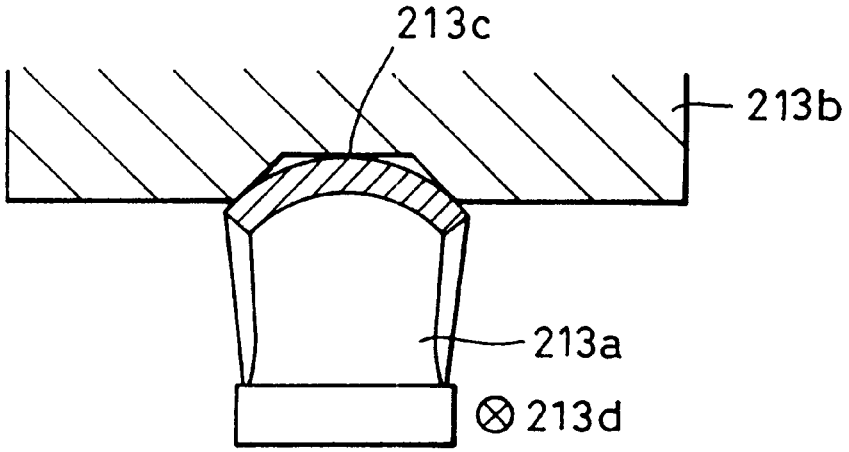
FIG. 35B PRIOR ART
Figure 36:
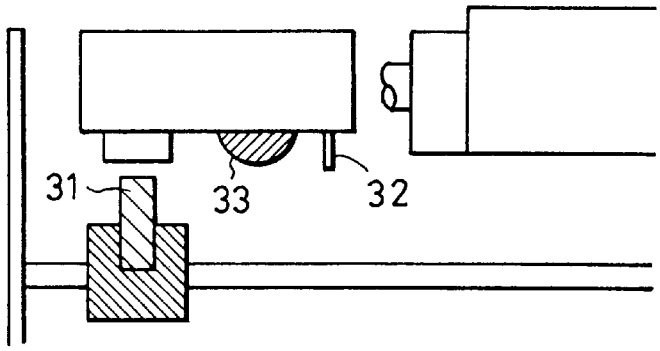
FIG. 36 PRIOR ART
FIG. 36 is a sectional view of another conventional cleaner.
Figure 37A:
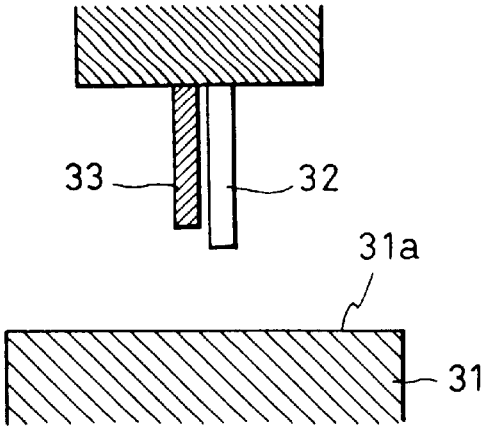
FIG. 37A PRIOR ART
FIGS. 37A and 37B are sectional views of a further conventional cleaner.
Figure 37B:
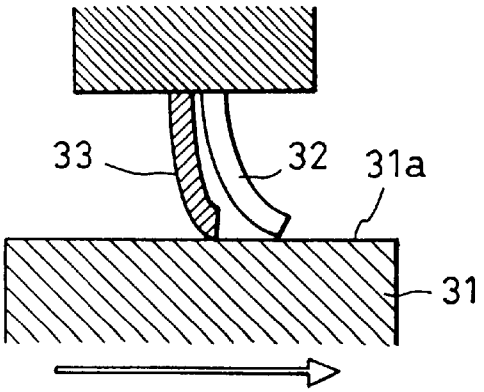
FIG. 37B PRIOR ART
Figure 38A:
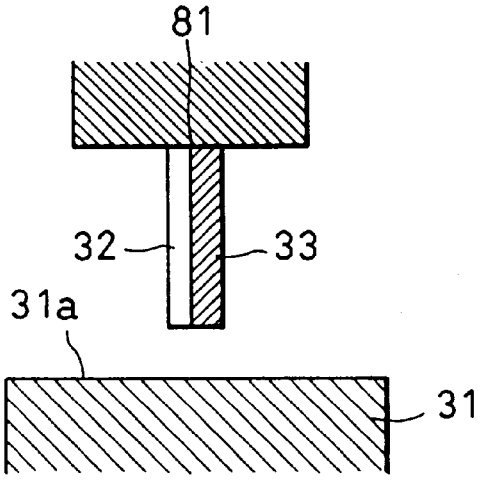
FIG. 38A PRIOR ART
FIGS. 38A to 38C are sectional views of still another conventional cleaner.
Figure 38B:
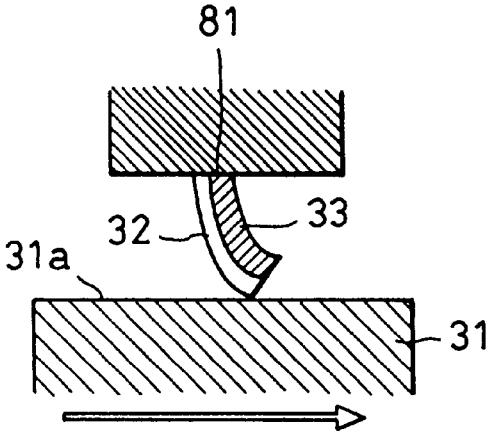
FIG. 38B PRIOR ART
Figure 38C:
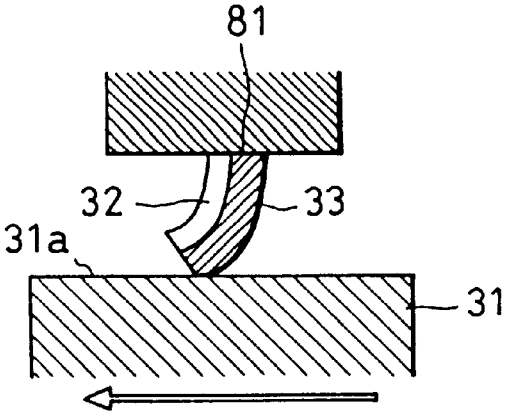

FIG. 29 is a schematic isometric view of a liquid discharging head which discharges a liquid by means of thermal energy. A voltage is applied to an electrothermal converter 42, which generates thermal energy, through an electrode 41 in response to signals. The thermal energy generated by the electrothermal converter 42 causes membrane boiling of the liquid, and discharge of the liquid through nozzles 48. The liquid is supplied to a liquid chamber 47 and led to the nozzles 48 from the liquid chamber 47 through liquid paths 45. The liquid paths 45 and the liquid chamber 47 are formed by lamination of a substrate 44 and an upper wall 45. Protective layers 43*a* and 43*b* are provided on the electrothermal converter 42 to protect it.

The liquid discharging apparatus in accordance with the present invention is generally used in ink jet recording apparatuses as image output terminals of information processing apparatuses such as computers, copying machines provided with reading units, and facsimiles provided with signal transmitting units.

As described above, the liquid discharging apparatus in accordance with the present invention can readily remove contaminants adhered onto the recording head, for example, dust, powdered paper and ink drops on the nozzle face, sticky dried inks, and coagulants formed by the reaction of inks and a printability improving solution. The liquid discharging apparatus shows therefore high recovery reliability.

When a long indented nozzle face provided with a nozzle array in the longitudinal direction on a head face is provided in a liquid discharging apparatus of an ink jet recording apparatus for discharging inks and a printability improving solution on a recording medium to form an image, a combination in accordance with the present invention of a rubbing means, which includes a plate wiper and a rubbing member, and a pillar cleaning member can readily remove the above-mentioned contaminants deposited on the indented nozzle face by wiping in the longitudinal direction. The liquid discharging apparatus shows therefore high recovery reliability.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid discharging apparatus using a liquid discharging head having a face with an indented groove having a nozzle section arranged in a longitudinal direction for discharging a liquid, comprising:

at least one cleaning means for cleaning the nozzle section of said liquid discharging head, said cleaning means being formed of an elastic pillar member not absorbing the liquid and being configured complementary to the indented groove such that said pillar member is received in and elastically deformed by the groove, and said pillar member is guided by the groove along the longitudinal direction during relative movement by said cleaning means and the nozzle section in the longitudinal direction.

2. A liquid discharging apparatus according to claim 1, further comprising an elastic plate member not absorbing liquid for cleaning the nozzle section.

3. A liquid discharging apparatus according to claim 1 or 2 further comprising a rubbing member absorbing liquid for rubbing the nozzle section.

4. A liquid discharging apparatus using a plurality of liquid discharging heads each having independent discharging mechanisms and having a face with an indented groove having a nozzle section arranged in a longitudinal direction for discharging different types of liquids, comprising:

a plurality of cleaning means for cleaning the nozzle sections of said liquid discharging heads, each of said plurality of cleaning means being formed of an elastic pillar member not absorbing the liquids and being configured complementary to the indented groove such that said pillar member is received in and elastically deformed by the groove, and said pillar member is guided by the groove along the longitudinal direction during relative movement by said cleaning means and the nozzle section in the longitudinal direction.

5. A liquid discharging apparatus according to claim 4, further comprising an elastic plate member not absorbing liquids for cleaning at least one nozzle section.

6. A liquid discharging apparatus according to claim 4 or 5, further comprising a rubbing member absorbing liquids for rubbing at least one nozzle section.

7. A liquid discharging apparatus according to any one of claims 1 and 2, wherein said liquid is an ink.

8. A liquid discharging apparatus according to claim 4 or 5, wherein one of said different types of liquids comprises an ink having a dye or a pigment and another of the liquids comprises a printability improving solution which performs one of making the dye or the pigment in the ink insoluble and coagulating the dye or the pigment in the ink.

9. A liquid discharging apparatus according to any one of claims 4 and 5, wherein said plurality of cleaning means have configurations corresponding to properties of said different types of liquids.

10. A liquid discharging apparatus according to any one of claims 1 and 4, wherein said elastic pillar member is provided with a hollow section.

11. A liquid discharging apparatus according to any one of claims 1 and 4, wherein said elastic pillar member has a tubular shape.

12. A liquid discharging apparatus according to any one of claims 1 and 4, wherein said elastic pillar member has a cylindrical shape.

13. A liquid discharging apparatus according to any one of claims 1 and 4, wherein said elastic pillar member has a prismatic shape.

14. A liquid discharging apparatus according to any one of claims 1 and 4, wherein said elastic pillar member has a cylindrical shape including a hollow section.

15. A liquid discharging apparatus according to any one of claims 1 and 4, wherein said elastic pillar member is made of a material selected from the group consisting of urethane rubbers, HNBR rubbers and EPDM rubbers.

16. A liquid discharging apparatus according to claim 15, wherein said elastic pillar member has an HS(A) hardness in a range of from 30 degrees to 80 degrees.

17. A liquid discharging apparatus according to any one of claims 1 and 4, wherein said nozzle section is arranged in an indented face which is indented from a capping face.

18. A liquid discharging apparatus according to claim 17, wherein at least one cleaning means is provided with a hollow section deformable along the indented face such that an edge of said hollow section contacts said indented face.

19. A liquid discharging apparatus according to claim 18, wherein said at least one cleaning means has an edge at a portion contacting said indented face, and said edge has a radius of curvature of 300 $\mu$m or less.

20. A liquid discharging apparatus according to any one of claims 1 and 4, wherein at least one cleaning means cleans at a scanning speed in a range of from 5 mm/sec. to 50 mm/sec.

21. A liquid discharging apparatus according to any one of claims 4 and 5, wherein each of said cleaning means can independently clean one of the liquid discharging heads.

22. A liquid discharging apparatus according to claim 21, wherein each of said cleaning means has a shape corresponding to characteristics of discharged liquid.

23. A liquid discharging apparatus according to any one of claims 1 and 4, wherein at least one cleaning means comprises a forward wiping member for wiping in a forwarding wiping direction and a reverse wiping member for wiping in a reverse wiping direction.

24. A liquid discharging apparatus according to any one of claims 1 and 4, wherein at least one cleaning means performs a cleaning operation when a number of discharged ink droplets reaches a predetermined figure.

25. A liquid discharging apparatus according to any one of claims 1 and 4, wherein at least one cleaning means performs a cleaning operation at least one of i) during a paper exhausting operation and ii) before capping.

26. A liquid discharging apparatus according to any one of claims 1 and 2, wherein said liquid discharging head is provided with an electrothermal converter generating thermal energy to cause membrane boiling in said liquid and to discharge said liquid.

27. A cleaning system for a liquid discharging apparatus using a liquid discharge head having a face with an indented groove having a nozzle section arranged in a longitudinal direction for discharging a liquid, comprising:

cleaning means for cleaning the nozzle section of the liquid discharging head, said cleaning means being formed of an elastic pillar member not absorbing the liquid and being configured complementary to the indented groove such that said pillar member is received in and elastically deformed by the groove, and said pillar member is guided by the groove along the longitudinal direction during relative movement by said cleaning means and the nozzle section in the longitudinal direction.

28. A cleaning system for a liquid discharging apparatus according to claim 27, further comprising an elastic plate member not absorbing liquid for cleaning the nozzle section.

29. A cleaning system for a liquid discharging apparatus, according to claim 27 or 28, further comprising a rubbing member absorbing liquid for rubbing the nozzle section.

30. A cleaning system for a liquid discharging apparatus using a plurality of liquid discharge heads each having independent discharging mechanisms and a face with an indented groove having a nozzle section arranged in a longitudinal direction for discharging different types of liquids, comprising:

a plurality of cleaning means for cleaning the nozzle sections of the plurality of liquid discharging heads, each of said cleaning means being formed of an elastic pillar member not absorbing the liquids and being configured complementary to the indented groove such that said pillar member is received in and elastically deformed by the groove, and said pillar member is guided by the groove along the longitudinal direction during relative movement by said cleaning means and the nozzle section in the longitudinal direction.

31. A cleaning system for a liquid discharging apparatus according to claim 30, further comprising an elastic plate member not absorbing liquids for cleaning the nozzle section.

32. A cleaning system for a liquid discharging apparatus, according to claim 30 or 31, further comprising a rubbing member absorbing liquids for rubbing the nozzle section.

33. A cleaning system for a liquid discharging apparatus according to any one of claims 27 and 28, wherein said liquid is an ink.

34. A cleaning system for a liquid discharging apparatus according to claim 30 or 31, wherein one of the different types of liquids comprises an ink having a dye or a pigment and another of the liquids comprises a printability improving solution which performs one of making the dye or the pigment in the ink insoluble and coagulating the dye or the pigment in the ink.

35. A cleaning system for a liquid discharging apparatus according to any one of claims 30 and 31, wherein said plurality of cleaning means have configurations corresponding to properties of said liquids.

36. A cleaning system for a liquid discharging apparatus according to any one of claims 27 and 30, wherein said elastic pillar member is provided with a hollow section.

37. A cleaning system for a liquid discharging apparatus according to any one of claims 27 and 30, wherein said elastic pillar member has a tubular shape.

38. A cleaning system for a liquid discharging apparatus according to any one of claims 27 and 30, wherein said elastic pillar member has a cylindrical shape.

39. A cleaning system for a liquid discharging apparatus according to any one of claims 27 and 30, wherein said elastic pillar member has a prismatic shape.

40. A cleaning system for a liquid discharging apparatus according to any one of claims 27 and 30, wherein said elastic pillar member has a cylindrical shape including a hollow section.

41. A cleaning system for a liquid discharging apparatus according to any one of claims 27 and 30, wherein said elastic pillar member is made of a material selected from the group consisting of urethane rubbers, HNBR rubbers and EPDM rubbers.

42. A cleaning system for a liquid discharging apparatus according to claim 41, wherein said elastic pillar member has an HS(A) hardness in a range of from 30 degrees to 80 degrees.

43. A liquid discharging apparatus, comprising:

cleaning means for cleaning a nozzle section disposed in an indentation of a face of a liquid discharging head for discharging a liquid by contacting said nozzle section, wherein said cleaning means comprises an elastic member not absorbing said liquid, and a rubbing member absorbing said liquid, arranged in a linear row, said face is cleaned by at least said elastic member by relative movement in a predetermined direction of said liquid discharging head and said cleaning means, and said rubbing member is supported by said elastic member from a rear side and is urged into said indentation, and said nozzle section is cleaned by contacting said rubbing member during relative movement of said liquid discharging head and said cleaning means in an opposite direction of said predetermined direction.

44. A liquid discharging apparatus according to claim 43, wherein a free length of said rubbing member is equal to or larger than a free length of said elastic member.

45. A liquid discharging apparatus according to claim 43, wherein a speed of said relative movement along the predetermined direction is equal to or larger than a speed of said relative movement in said opposite direction.

46. A liquid discharging apparatus according to claim 43, wherein said cleaning means is arranged between a recording zone in which recording is performed by said liquid discharging head and a standby position in which said liquid discharging head waits.

47. A liquid discharging apparatus according to claim 43, wherein said elastic member has a section which fits into said indentation.

48. A liquid discharging apparatus according to claim 43, wherein said liquid discharging head is provided with an electrothermal converter which generates thermal energy for discharging said liquid.

49. A liquid discharging apparatus according to any one of claims 4 and 5, wherein at least one of said different types of liquids is an ink.

50. A liquid discharging apparatus according to any one of claims 4 and 5, wherein each of said liquid discharging heads is provided with an electrothermal converter generating thermal energy to cause membrane boiling in a corresponding liquid to discharge the corresponding liquid.

51. A cleaning system for a liquid discharging apparatus according to any one of claims 30 and 31, wherein at least one of said different types of liquids is an ink.

52. A cleaning system for a liquid discharging apparatus according to claim 27 or 28, wherein said cleaning means has a configuration corresponding to properties of said liquid.

* * * * *

UNITED STATES PATENT AND TRADEMARK OFFICE

CERTIFICATE OF CORRECTION

PATENT NO. : 6,164,754
DATED : December 26, 2000
INVENTOR(S) : Ide et al.

It is certified that error appears in the above-identified patent and that said Letters Patent is hereby corrected as shown below:

Title page,
Item [54], "DISCHARGING" should read -- DISCHARGE --.

Column 1,
Line 37, "matters" should read -- matter --.

Column 4,
Line 7, "Although the" should read -- The --.

Column 16,
Line 6, "shows" should read -- show --.

Column 21,
Line 21, "cam" should read -- cam 13i --.

Column 33,
Line 45, "head 2d." should read -- head 12d. --.

Column 34,
Line 30, "The some" should read -- Some --.
Line 31, "face" should read -- face, --.

Column 36,
Line 29, "an" should read -- a --.

Column 37,
Line 63, "2" should read -- 2, --.

Signed and Sealed this

Eighth Day of January, 2002

*Attest:*

Nicholas P. Godici

*Attesting Officer*

NICHOLAS P. GODICI
*Acting Director of the United States Patent and Trademark Office*